US010438549B2

(12) United States Patent
Kabe et al.

(10) Patent No.: US 10,438,549 B2
(45) Date of Patent: Oct. 8, 2019

(54) DRIVING METHOD FOR IMAGE DISPLAY APPARATUS

(71) Applicant: Japan Display Inc., Tokyo (JP)

(72) Inventors: Masaaki Kabe, Kanagawa (JP); Amane Higashi, Aichi (JP); Yasuo Takahashi, Tokyo (JP); Akira Sakaigawa, Kanagawa (JP)

(73) Assignee: JAPAN DISPLAY INC., Tokyo (JP)

( * ) Notice: Subject to any disclaimer, the term of this patent is extended or adjusted under 35 U.S.C. 154(b) by 0 days.

(21) Appl. No.: 16/159,774

(22) Filed: Oct. 15, 2018

(65) Prior Publication Data

US 2019/0051257 A1 Feb. 14, 2019

Related U.S. Application Data

(60) Continuation of application No. 15/447,312, filed on Mar. 2, 2017, now Pat. No. 10,163,410, which is a (Continued)

(30) Foreign Application Priority Data

Jan. 28, 2010 (JP) ..... 2010-017297

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 3/3426* (2013.01); (Continued)

(58) Field of Classification Search
CPC .. G09G 3/3406; G09G 3/3413; G09G 3/3607; G09G 2300/0452; (Continued)

(56) References Cited

U.S. PATENT DOCUMENTS 7,277,075 B1 10/2007 Hirano et al.
7,362,393 B2 4/2008 Kim et al.
(Continued)

FOREIGN PATENT DOCUMENTS

CN 101620844 6/2010
JP 04-130395 5/1992
(Continued)

OTHER PUBLICATIONS

Office Action issued in corresponding Japanese Patent Application No. JP 2018-018299 dated Nov. 13, 2018 with English translation.
(Continued)

*Primary Examiner* — Xuemei Zheng
(74) *Attorney, Agent, or Firm* — Dentons US LLP

(57) ABSTRACT

A method of driving an image display apparatus which includes an image display panel having a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and a signal processing section. The signal processing section is capable of calculating a first subpixel output signal, a second subpixel output signal, a third subpixel output signal, and a fourth subpixel output signal. The method includes a step of calculating a maximum value ($V_{max}(S)$) of brightness, a saturation (S) and brightness (V(S)), and determining the expansion coefficient ($\alpha_0$).

5 Claims, 24 Drawing Sheets

Related U.S. Application Data continuation of application No. 14/688,108, filed on Apr. 16, 2015, now abandoned, which is a division of application No. 13/008,496, filed on Jan. 18, 2011, now Pat. No. 9,035,979.

(52) U.S. Cl.
CPC ..... *G09G 3/3648* (2013.01); *G09G 3/3413* (2013.01); *G09G 2300/0452* (2013.01); *G09G 2320/0233* (2013.01); *G09G 2320/0646* (2013.01); *G09G 2320/0666* (2013.01); *G09G 2330/021* (2013.01); *G09G 2340/06* (2013.01); *G09G 2360/145* (2013.01)

(58) Field of Classification Search
CPC ... G09G 2320/0646; G09G 2320/0666; G09G 2340/06
See application file for complete search history.

(56) References Cited

U.S. PATENT DOCUMENTS

2009/0059078 A1 3/2009 Kim
2009/0315921 A1* 12/2009 Sakaigawa ..... G09G 3/2003 345/694
2009/0322802 A1* 12/2009 Noguchi ..... G09G 3/2003 345/694

FOREIGN PATENT DOCUMENTS

| | | |
|---|---|---|
| JP | 2004-286814 | 10/2004 |
| JP | 3805150 | 5/2006 |
| JP | 2009-053669 | 3/2009 |
| JP | 2009-103926 | 5/2009 |
| JP | 2016-200827 | 1/2016 |
| JP | 2016-200827 | 12/2016 |
| WO | WO/2004/086128 | 10/2004 |
| WO | WO/2007/088656 | 8/2007 |

OTHER PUBLICATIONS

Japanese Office Examination Report mailed in corresponding Japanese patent application No. JP 2014-180425 dated Nov. 10, 2015.
Chinese Office Action issued in corresponding Chinese Patent Application Serial No. 2015103089083 dated May 17, 2017.
Chinese Office Action issued in corresponding Chinese Patent Application Serial No. 201510309299.3 dated May 17, 2017.
Japanese Office Action issued in corresponding Japanese Patent Application Serial No. 2016-131599 dated Jul. 4, 2017.

* cited by examiner

DRIVING METHOD FOR IMAGE DISPLAY APPARATUS

RELATED APPLICATION DATA

This application is a continuation of U.S. patent application Ser. No. 15/447,312 filed Mar. 2, 2017, which is a continuation of U.S. patent application Ser. No. 14/688,108 filed Apr. 16, 2015, now abandoned, which is a division of U.S. patent application Ser. No. 13/008,496 filed Jan. 18, 2011, now U.S. Pat. No. 9,035,979 issued May 19, 2015 the entireties of which are incorporated herein by reference to the extent permitted by law. The present application claims the benefit of priority to Japanese Patent Application No. JP 2010-017297 filed on Jan. 28, 2010 in the Japan Patent Office, the entirety of which is incorporated by reference herein to the extent permitted by law.

BACKGROUND OF THE INVENTION

1. Field of the Invention

This invention relates to a driving method for an image display apparatus.

2. Description of the Related Art

In recent years, an image display apparatus such as, for example, a color liquid crystal display apparatus has a problem in increase of the power consumption involved in enhancement of performances. Particularly as enhancement in definition, increase of the color reproduction range and increase in luminance advance, for example, in a color liquid crystal display apparatus, the power consumption of a backlight increases. Attention is paid to an apparatus which solves the problem just described. The apparatus has a four-subpixel configuration which includes, in addition to three subpixels including a red displaying subpixel for displaying red, a green displaying subpixel for displaying green and a blue displaying subpixel for displaying blue, for example, a white displaying subpixel for displaying white. The white displaying subpixel enhances the brightness. Since the four-subpixel configuration can achieve a high luminance with power consumption similar to that of display apparatus in related arts, if the luminance may be equal to that of display apparatus in related arts, then it is possible to decrease the power consumption of the backlight and improvement of the display quality can be anticipated.

For example, a color image display apparatus disclosed in Japanese Patent No. 3167026 (hereinafter referred to as Patent Document 1) includes:

means for producing three different color signals from an input signal using an additive primary color process; and means for adding the color signals of the three hues at equal ratios to produce an auxiliary signal and supplying totaling four display signals including the auxiliary signal and three different color signals obtained by subtracting the auxiliary signal from the signals of the three hues to a display unit.

It is to be noted that a red displaying subpixel, a green displaying subpixel and a blue displaying subpixel are driven by the three different color signals while a white displaying subpixel is driven by the auxiliary signal.

Meanwhile, Japanese Patent No. 3805150 (hereinafter referred to as Patent Document 2) discloses a liquid crystal display apparatus which includes a liquid crystal panel wherein a red outputting subpixel, a green outputting subpixel, a blue outputting subpixel and a luminance subpixel form on main pixel unit so that color display can be carried out, including:

calculation means for calculating, using digital values Ri, Gi and Bi of a red inputting subpixel, a green inputting subpixel and a blue inputting subpixel obtained from an input image signal, a digital value W for driving the luminance subpixel and digital values Ro, Go and Bo for driving the red inputting subpixel, green inputting subpixel and blue inputting subpixel;

the calculation means calculating such values of the digital values Ro, Go and Bo as well as W which satisfy a relationship of $$Ri:Gi:Bi=(Ro+W):(Go+W):(Bo+W)$$

and with which enhancement of the luminance from that of the configuration which includes only the red inputting subpixel, green inputting subpixel and blue inputting subpixel is achieved by the addition of the luminance subpixel.

Further, PCT/KR 2004/000659 (hereinafter referred to as Patent Document 3) discloses a liquid crystal display apparatus which includes first pixels each configured from a red displaying subpixel, a green displaying subpixel and a blue displaying subpixel and second pixels each configured from a red displaying subpixel, a green displaying subpixel and a white displaying subpixel and wherein the first and second pixels are arrayed alternately in a first direction and the first and second pixels are arrayed alternately also in a second direction. The Patent Document 3 further discloses a liquid crystal display apparatus wherein the first and second pixels are arrayed alternatively in the first direction while, in the second direction, the first pixels are arrayed adjacent each other and besides the second pixels are arrayed adjacent each other.

SUMMARY OF THE INVENTION

Incidentally, in the technique disclosed in Patent Document 1 or Patent Document 2, although the luminance of the white display subpixel increases, the luminance of the red displaying subpixel, green displaying subpixel or blue displaying subpixel does not increase. Therefore, they have a problem in that darkening in color occurs. Such a phenomenon as just described is called simultaneous contrast. Such a phenomenon occurs conspicuously particularly with regard to yellow with regard to which the visibility is high.

Meanwhile, in the apparatus disclosed in Patent Document 3, the second pixel includes a white displaying subpixel in place of the blue displaying subpixel. Further, an output signal to the white displaying subpixel is an output signal to a blue displaying subpixel assumed to exist before the replacement with the white displaying subpixel. Therefore, optimization of output signals to the blue displaying subpixel which composes the first pixel and the white displaying subpixel which composes the second pixel is not achieved. Further, since variation in color or variation in luminance occurs, there is a problem also in that the picture quality is deteriorated significantly.

Therefore, it is desirable to provide a driving method for an image display apparatus which can achieve optimization of output signals to individual subpixels and can achieve increase of the luminance with certainty.

According to an embodiment of the present invention, there is provided a driving method for an image display apparatus which includes (A) an image display panel including a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and (B) a signal processing section.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal and third subpixel input signal and outputting the calculated fourth subpixel output signal to the fourth subpixel.

The driving method includes:

(a) a step, carried out by the signal processing section, of calculating a maximum value ($V_{max}(S)$) of brightness where a saturation (S) in an HSV (Hue, Saturation and Value) color space expanded by addition of the fourth color is used as a variable;

(b) a step, carried out by the signal processing section, of calculating a saturation (S) and brightness (V(S)) of a plurality of pixels based on the subpixel input signal values to the plural pixels; and (c) a step of determining the expansion coefficient ($\alpha_0$) so that the ratio of those pixels with regard to which the value of the expanded brightness calculated from the product of the brightness (V(S)) and the expansion coefficient ($\alpha_0$) exceeds the maximum value ($V_{max}(S)$) to all pixels is equal to or lower than a predetermined value ($\beta_0$).

The saturation (S) is represented by $$S=(\text{Max}-\text{Min})/\text{Max}$$

the brightness (V(S)) being represented by $$V(S)=\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel including a plurality of pixels each configured from a first subpixel for displaying a first primary color, a second subpixel for displaying a second primary color and a third subpixel for displaying a third primary color and arrayed in a first direction and a second direction in a two-dimensional matrix such that a pixel group is configured at least from a first pixel and a second pixel arrayed in the first direction, and a fourth subpixel disposed between the first pixel and the second pixel in each pixel group for displaying a fourth color, and (B) a signal processing section.

The signal processing section is capable of, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and the expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal and third subpixel input signal to the first pixel and a fourth subpixel control second signal calculated from the first subpixel input signal, second subpixel input signal and third subpixel input signal to the second pixel and outputting the calculated fourth subpixel output signal to the fourth subpixel. The driving method includes:

(a) a step, carried out by the signal processing section, of calculating a maximum value ($V_{max}(S)$) of brightness where a saturation (S) in an HSV (Hue, Saturation and Value) color space expanded by addition of the fourth color is used as a variable;

(b) a step, carried out by the signal processing section, of calculating a saturation (S) and brightness (V(S)) of a plurality of pixels based on the subpixel input signal values to the plural pixels; and (c) a step of determining the expansion coefficient ($\alpha_0$) so that the ratio of those pixels with regard to which the value of the expanded brightness calculated from the product of the brightness (V(S)) and the expansion coefficient ($\alpha_0$) exceeds the maximum value ($V_{max}(S)$) to all pixels is equal to or lower than a predetermined value ($\beta_0$).

The saturation (S) is represented by $$S=(\text{Max}-\text{Min})/\text{Max}$$

the brightness (V(S)) being represented by $$V(S)=\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a third subpixel output signal to a (p,q)th, where p is 1, 2, . . . , P and q is 1, 2, . . . , Q when the pixels are counted along the first direction, first pixel based at least on a third subpixel input signal to the (p,q)th first pixel and a third subpixel input signal to the (p,q)th second pixel and outputting the third subpixel output signal to the third subpixel of the (p,q)th first pixel, and calculating a fourth subpixel output signal to the (p,q)th second signal based on a fourth subpixel control second signal calculated from a first subpixel input signal, a second subpixel input signal and the third subpixel input signal to the (p,q)th second pixel and a fourth subpixel control first signal calculated from a first subpixel input signal, a second subpixel input signal and a third subpixel input signal to an adjacent pixel disposed adjacent the (p,q)th second pixel along the first direction.

The driving method includes:

(a) a step, carried out by the signal processing section, of calculating a maximum value ($V_{max}(S)$) of brightness where a saturation (S) in an HSV (Hue, Saturation and Value) color space expanded by addition of the fourth color is used as a variable;

(b) a step, carried out by the signal processing section, of calculating a saturation (S) and brightness (V(S)) of a plurality of pixels based on the subpixel input signals to the plural pixels; and (c) a step of determining an expansion coefficient ($\alpha_0$) so that the ratio of those pixels with regard to which the value of the expanded brightness calculated from the product of the brightness (V(S)) and the expansion coefficient ($\alpha_0$) exceeds the maximum value ($V_{max}(S)$) to all pixels is equal to or lower than a predetermined value ($\beta_0$).

The saturation (S) is represented by $$S=(\text{Max}-\text{Min})/\text{Max}$$

the brightness (V(S)) being represented by $$V(S)=\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, and (B) a signal processing section.

Each of the pixels is configured from a first subpixel for displaying a first primary color, a second subpixel for displaying a second primary color, a third subpixel for displaying a third primary color and a fourth subpixel for displaying a fourth color.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to (p,q)th, where p is 1, 2, . . . , $P_0$ and q is 1, 2, . . . , $Q_0$ when the pixels are counted along the second direction, pixel based on a fourth subpixel control second signal calculated from a first subpixel input signal, a second subpixel input signal and a third subpixel input signal to the (p,q)th pixel and a fourth subpixel control first signal calculated from a first subpixel input signal, a second subpixel input signal and a third subpixel input signal to an adjacent pixel disposed adjacent the (p,q)th pixel along the second direction, and outputting the calculated fourth subpixel output signal to the fourth subpixel of the (p,q)th pixel.

The driving method includes:

(a) a step, carried out by the signal processing section, of calculating a maximum value ($V_{max}(S)$) of brightness where a saturation (S) in an HSV (Hue, Saturation and Value) color space expanded by addition of the fourth color is used as a variable;

(b) a step, carried out by the signal processing section, of calculating a saturation (S) and brightness (V(S)) of a plurality of pixels based on the subpixel input signals to the plural pixels; and (c) a step of determining the expansion coefficient ($\alpha_0$) so that the ratio of those pixels with regard to which the value of the expanded brightness calculated from the product of the brightness (V(S)) and the expansion coefficient ($\alpha_0$) exceeds the maximum value ($V_{max}(S)$) to all pixels is equal to or lower than a predetermined value ($\beta_0$).

The saturation (S) is represented by $$S=(\text{Max}-\text{Min})/\text{Max}$$

the brightness (V(S)) being represented by $$V(S)=\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a fourth subpixel output signal based on a fourth subpixel control second signal calculated from a first subpixel input signal, a second subpixel input signal and a third subpixel input signal to a (p,q)th, where p is 1, 2, . . . , P and q is 1, 2, . . . , Q when the pixels are counted along the second direction, second pixel and a fourth subpixel control first signal calculated from a first subpixel input signal, a second subpixel input signal and a third subpixel input signal to an adjacent pixel disposed adjacent the (p,q)th second pixel along the second direction and outputting the calculated fourth subpixel output signal to the fourth subpixel of the (p,q)th second pixel, and calculating a third subpixel output signal based at least on a third subpixel input signal to the (p,q)th second pixel and a third subpixel input signal to the (p,q)th first pixel and outputting the third subpixel output signal to the third subpixel of the (p,q)th first pixel.

The driving method includes:

(a) a step, carried out by the signal processing section, of calculating a maximum value ($V_{max}(S)$) of brightness where a saturation (S) in an HSV (Hue, Saturation and Value) color space expanded by addition of the fourth color is used as a variable;

(b) a step, carried out by the signal processing section, of calculating a saturation (S) and brightness (V(S)) of a plurality of pixels based on the subpixel input signals to the plural pixels; and (c) a step of determining the expansion coefficient ($\alpha_0$) so that the ratio of those pixels with regard to which the value of the expanded brightness calculated from the product of the brightness (V(S)) and the expansion coefficient ($\alpha_0$) exceeds the maximum value ($V_{max}(S)$) to all pixels is equal to or lower than a predetermined value ($\beta_0$).

The saturation (S) is represented by $$S=(\text{Max}-\text{Min})/\text{Max}$$

the brightness (V(S)) being represented by $$V(S)=\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel including a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and (B) a signal processing section.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal and third subpixel input signal and outputting the calculated fourth subpixel output signal to the fourth subpixel.

The driving method includes:

a step of setting the expansion coefficient ($\alpha_0$) to a value represented by $$\alpha_0=BN_4/BN_{1\text{-}3}+1$$

where $BN_{1\text{-}3}$ is a luminance of a set of a first subpixel, a second subpixel and a third subpixel which configure a pixel when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel and $BN_4$ is a luminance of a fourth subpixel which configures the pixel when a signal having a value corresponding to a maximum signal value of the fourth subpixel output signal is inputted to the fourth subpixel.

According to an embodiment of the present invention, there is provided a driving method for an image display apparatus which includes (A) an image display panel including a plurality of pixels each configured from a first subpixel for displaying a first primary color, a second subpixel for displaying a second primary color and a third subpixel for displaying a third primary color and arrayed in a first direction and a second direction in a two-dimensional matrix such that a pixel group is configured at least from a first pixel and a second pixel arrayed in the first direction, and a fourth subpixel disposed between the first pixel and the second pixel in each pixel group for displaying a fourth color, and (B) a signal processing section.

The signal processing section is capable of, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal and third subpixel input signal to the first pixel and a fourth subpixel control second signal calculated from the first subpixel input signal, second subpixel input signal and third subpixel input signal to the second pixel and outputting the calculated fourth subpixel output signal to the fourth subpixel.

The driving method includes:

a step of setting the expansion coefficient ($\alpha_0$) to a value represented by $$\alpha_0 = BN_4/BN_{1\text{-}3}+1$$

where $BN_{1\text{-}3}$ is a luminance of a set of a first subpixel, a second subpixel and a third subpixel which configure a pixel group when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel and $BN_4$ is a luminance of a fourth subpixel which configures the pixel group when a signal having a value corresponding to a maximum signal value of the fourth subpixel output signal is inputted to the fourth subpixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a third subpixel output signal to a (p,q)th, where p is 1, 2, . . . , P and q is 1, 2, . . . , Q when the pixels are counted along the first direction, first pixel based at least on a third subpixel input signal to the (p,q)th first pixel and a third subpixel input signal to the (p,q)th second pixel and outputting the third subpixel output signal to the third subpixel of the (p,q)th first pixel, and calculating a fourth subpixel output signal to the (p,q)th second signal based on a fourth subpixel control second signal calculated from a first subpixel input signal, a second subpixel input signal and the third subpixel input signal to the (p,q)th second pixel and a fourth subpixel control first signal calculated from a first subpixel input signal, a second subpixel input signal and a third subpixel input signal to an adjacent pixel disposed adjacent the (p,q)th second pixel along the first direction.

The driving method includes:

a step of setting the expansion coefficient ($\alpha_0$) to a value represented by $$\alpha_0 = BN_4/BN_{1\text{-}3}+1$$

where $BN_{1\text{-}3}$ is a luminance of a set of a first subpixel, a second subpixel and a third subpixel which configure a pixel group when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel and $BN_4$ is a luminance of a fourth subpixel which configures the pixel group when a signal having a value corresponding to a maximum signal value of the fourth subpixel output signal is inputted to the fourth subpixel.

According to an embodiment of the present invention, there is provided a driving method for an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, and (B) a signal processing section.

Each of the pixels is configured from a first subpixel for displaying a first primary color, a second subpixel for displaying a second primary color, a third subpixel for displaying a third primary color and a fourth subpixel for displaying a fourth color.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to (p,q)th, where p is 1, 2, . . . , $P_0$ and q is 1, 2, . . . , $Q_0$ when the pixels are counted along the second direction, pixel based on a fourth subpixel control second signal calculated from a first subpixel input signal, a second subpixel input signal and a third subpixel input signal to the (p,q)th pixel and a fourth subpixel control first signal calculated from a first subpixel input signal, a second subpixel input signal and a third subpixel input signal to an adjacent pixel disposed adjacent the (p,q)th pixel along the second direction, and outputting the calculated fourth subpixel output signal to the fourth subpixel of the (p,q)th pixel.

The driving method includes:

a step of setting the expansion coefficient ($\alpha_0$) to a value represented by $$\alpha_0=BN_4/BN_{1\text{-}3}+1$$

where $BN_{1\text{-}3}$ is a luminance of a set of a first subpixel, a second subpixel and a third subpixel which configure a pixel when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel and $BN_4$ is a luminance of a fourth subpixel which configures the pixel when a signal having a value corresponding to a maximum signal value of the fourth subpixel output signal is inputted to the fourth subpixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a fourth subpixel output signal based on a fourth subpixel control second signal calculated from a first subpixel input signal, a second subpixel input signal and a third subpixel input signal to a (p,q)th, where p is 1, 2, . . . , P and q is 1, 2, . . . , Q when the pixels are counted along the second direction, second pixel and a fourth subpixel control first signal calculated from a first subpixel input signal, a second subpixel input signal and a third subpixel input signal to an adjacent pixel disposed adjacent the (p,q)th second pixel along the second direction and outputting the calculated fourth subpixel output signal to the fourth subpixel of the (p,q)th second pixel, and calculating a third subpixel output signal based at least on a third subpixel input signal to the (p,q)th second pixel and a third subpixel input signal to the (p,q)th first pixel and outputting the third subpixel output signal to the third subpixel of the (p,q)th first pixel.

The driving method includes:

a step of setting the expansion coefficient ($\alpha_0$) to a value represented by $$\alpha_0=BN_4/BN_{1\text{-}3}+1$$

where $BN_{1\text{-}3}$ is a luminance of a set of a first subpixel, a second subpixel and a third subpixel which configure a pixel group when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel and $BN_4$ is a luminance of a fourth subpixel which configures the pixel group when a signal having a value corresponding to a maximum signal value of the fourth subpixel output signal is inputted to the fourth subpixel.

According to an embodiment of the present invention, there is provided a driving method for an image display apparatus which includes (A) an image display panel including a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and (B) a signal processing section.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal and third subpixel input signal and outputting the calculated fourth subpixel output signal to the fourth subpixel.

The driving method includes:

a step of setting the expansion coefficient ($\alpha_0$) to a value equal to or lower than a predetermined value when a ratio of those pixels with regard to which a hue (H) and a saturation (S) in an HSV (Hue, Saturation and Value) color space where a color defined by (R, G, B) is displayed by each pixel respectively satisfy $$40\leq H\leq 65 \text{ and}$$

$$0.5\leq S\leq 1.0$$

to all pixels exceeds a predetermined value ($\beta'_0$), the hue (H) being given, when R exhibits a maximum value, by $$H=60(G-B)/(\text{Max}-\text{Min})$$

when G exhibits a maximum value, by $$H=60(B-R)/(\text{Max}-\text{Min})+120$$

and when B exhibits a maximum value, $$H=60(R-G)/(\text{Max}-\text{Min})+240$$

the saturation (S) being given by $$S=(\text{Max}-\text{Min})/\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel including a plurality of pixels each configured from a first subpixel for displaying a first primary color, a second subpixel for displaying a second primary color and a third subpixel for displaying a third primary color and arrayed in a first direction and a second direction in a two-dimensional matrix such that a pixel group is configured at least from a first pixel and a second pixel arrayed in the first direction, and a fourth subpixel disposed between the first pixel and the second pixel in each pixel group for displaying a fourth color, and (B) a signal processing section.

The signal processing section is capable of, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal and third subpixel input signal to the first pixel and a fourth subpixel control second signal calculated from the first subpixel input signal, second subpixel input signal and third subpixel input signal to the second pixel and outputting the calculated fourth subpixel output signal to the fourth subpixel.

The driving method includes:

a step of setting the expansion coefficient ($\alpha_0$) to a value equal to or lower than a predetermined value when a ratio of those pixels with regard to which a hue (H) and a saturation (S) in an HSV (Hue, Saturation and Value) color space where a color defined by (R, G, B) is displayed by each pixel respectively satisfy $$40 \leq H \leq 65 \text{ and}$$

$$0.5 \leq S \leq 1.0$$

to all pixels exceeds a predetermined value ($\beta'_0$), the hue (H) being given, when R exhibits a maximum value, by $$H=60(G-B)/(\text{Max}-\text{Min})$$

when G exhibits a maximum value, by $$H=60(B-R)/(\text{Max}-\text{Min})+120$$

and when B exhibits a maximum value, $$H=60(R-G)/(\text{Max}-\text{Min})+240$$

the saturation (S) being given by $$S=(\text{Max}-\text{Min})/\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a third subpixel output signal to a (p,q)th, where p is 1, 2, . . . , P and q is 1, 2, . . . , Q when the pixels are counted along the first direction, first pixel based at least on a third subpixel input signal to the (p,q)th first pixel and a third subpixel input signal to the (p,q)th second pixel and outputting the third subpixel output signal to the third subpixel of the (p,q)th first pixel, and calculating a fourth subpixel output signal to the (p,q)th second signal based on a fourth subpixel control second signal calculated from a first subpixel input signal, a second subpixel input signal and the third subpixel input signal to the (p,q)th second pixel and a fourth subpixel control first signal calculated from a first subpixel input signal, a second subpixel input signal and a third subpixel input signal to an adjacent pixel disposed adjacent the (p,q)th second pixel along the first direction.

The driving method includes:

a step of setting the expansion coefficient ($\alpha_0$) to a value equal to or lower than a predetermined value when a ratio of those pixels with regard to which a hue (H) and a saturation (S) in an HSV (Hue, Saturation and Value) color space where a color defined by (R, G, B) is displayed by each pixel respectively satisfy $$40 \leq H \leq 65 \text{ and}$$

$$0.5 \leq S \leq 1.0$$

to all pixels exceeds a predetermined value ($\beta'_0$), the hue (H) being given, when R exhibits a maximum value, by $$H=60(G-B)/(\text{Max}-\text{Min})$$

when G exhibits a maximum value, by $$H=60(B-R)/(\text{Max}-\text{Min})+120$$

and when B exhibits a maximum value, $$H=60(R-G)/(\text{Max}-\text{Min})+240$$

the saturation (S) being given by $$S=(\text{Max}-\text{Min})/\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, and (B) a signal processing section.

Each of the pixels is configured from a first subpixel for displaying a first primary color, a second subpixel for displaying a second primary color, a third subpixel for displaying a third primary color and a fourth subpixel for displaying a fourth color.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to (p,q)th, where p is 1, 2, . . . , $P_0$ and q is 1, 2, . . . , $Q_0$ when the pixels are counted along the second direction, pixel based on a fourth subpixel control second signal calculated from a first subpixel input signal, a second subpixel input signal and a third subpixel input signal to the (p,q)th pixel and a fourth subpixel control first signal calculated from a first subpixel input signal, a second subpixel input signal and a third subpixel input signal to an adjacent pixel disposed adjacent the (p,q)th pixel along the second direction, and outputting the calculated fourth subpixel output signal to the fourth subpixel of the (p,q)th pixel.

The driving method includes:

a step of setting the expansion coefficient ($\alpha_0$) to a value equal to or lower than a predetermined value when a ratio of those pixels with regard to which a hue (H) and a saturation (S) in an HSV (Hue, Saturation and Value) color space where a color defined by (R, G, B) is displayed by each pixel respectively satisfy $$40 \le H \le 65 \text{ and}$$

$$0.5 \le S \le 1.0$$

to all pixels exceeds a predetermined value ($\beta'_0$), the hue (H) being given, when R exhibits a maximum value, by $$H=60(G-B)/(\text{Max}-\text{Min})$$

when G exhibits a maximum value, by $$H=60(B-R)/(\text{Max}-\text{Min})+120$$

and when B exhibits a maximum value, $$H=60(R-G)/(\text{Max}-\text{Min})+240$$

the saturation (S) being given by $$S=(\text{Max}-\text{Min})/\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a fourth subpixel output signal based on a fourth subpixel control second signal calculated from a first subpixel input signal, a second subpixel input signal and a third subpixel input signal to a (p,q)th, where p is 1, 2, . . . , P and q is 1, 2, . . . , Q when the pixels are counted along the second direction, second pixel and a fourth subpixel control first signal calculated from a first subpixel input signal, a second subpixel input signal and a third subpixel input signal to an adjacent pixel disposed adjacent the (p,q)th second pixel along the second direction and outputting the calculated fourth subpixel output signal to the fourth subpixel of the (p,q)th second pixel, and calculating a third subpixel output signal based at least on a third subpixel input signal to the (p,q)th second pixel and a third subpixel input signal to the (p,q)th first pixel and outputting the third subpixel output signal to the third subpixel of the (p,q)th first pixel.

The driving method includes:

a step of setting the expansion coefficient ($\alpha_0$) to a value equal to or lower than a predetermined value when a ratio of those pixels with regard to which a hue (H) and a saturation (S) in an HSV (Hue, Saturation and Value) color space where a color defined by (R, G, B) is displayed by each pixel respectively satisfy $$40 \le H \le 65 \text{ and}$$

$$0.5 \le S \le 1.0$$

to all pixels exceeds a predetermined value ($\beta'_0$), the hue (H) being given, when R exhibits a maximum value, by $$H=60(G-B)/(\text{Max}-\text{Min})$$

when G exhibits a maximum value, by $$H=60(B-R)/(\text{Max}-\text{Min})+120$$

and when B exhibits a maximum value, $$H=60(R-G)/(\text{Max}-\text{Min})+240$$

the saturation (S) being given by $$S=(\text{Max}-\text{Min})/\text{Max}$$

where Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel.

According to an embodiment of the present invention, there is provided a driving method for an image display apparatus which includes (A) an image display panel including a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and (B) a signal processing section.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal and third subpixel input signal and outputting the calculated fourth subpixel output signal to the fourth subpixel.

The driving method includes:

a step of setting the expansion coefficient ($\alpha_0$) to a value equal to or lower than a predetermined value when a ratio of those pixels with regard to which, where a color defined by (R, G, B) is displayed by each pixel, (R, G, B) satisfy, where R among (R, G, B) exhibits a maximum value and B exhibits a minimum value, $$R\geq 0.78\times(2^n-1)$$

$$G\geq 2R/3+B/3$$

$$B\leq 0.50R$$

but satisfy, where G among (R, G, B) exhibits a maximum value and B exhibits a minimum value, $$R\geq 4B/60+56G/60$$

$$G\geq 0.78\times(2^n-1)$$

$$B\leq 0.50R$$

to all pixels exceeds a predetermined value ($\beta'_0$), n being a display gradation bit number.

According to an embodiment of the present invention, there is provided a driving method for an image display apparatus which includes (A) an image display panel including a plurality of pixels each configured from a first subpixel for displaying a first primary color, a second subpixel for displaying a second primary color and a third subpixel for displaying a third primary color and arrayed in a first direction and a second direction in a two-dimensional matrix such that a pixel group is configured at least from a first pixel and a second pixel arrayed in the first direction, and a fourth subpixel disposed between the first pixel and the second pixel in each pixel group for displaying a fourth color, and (B) a signal processing section.

The signal processing section is capable of, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal and third subpixel input signal to the first pixel and a fourth subpixel control second signal calculated from the first subpixel input signal, second subpixel input signal and third subpixel input signal to the second pixel and outputting the calculated fourth subpixel output signal to the fourth subpixel.

The driving method includes:

a step of setting the expansion coefficient ($\alpha_0$) to a value equal to or lower than a predetermined value when a ratio of those pixels with regard to which, where a color defined by (R, G, B) is displayed by each pixel, (R, G, B) satisfy, where R among (R, G, B) exhibits a maximum value and B exhibits a minimum value, $$R\geq 0.78\times(2^n-1)$$

$$G\geq 2R/3+B/3$$

$$B\leq 0.50R$$

but satisfy, where G among (R, G, B) exhibits a maximum value and B exhibits a minimum value, $$R \geq 4B/60+56G/60$$

$$G \geq 0.78 \times (2^n-1)$$

$$B \leq 0.50R$$

to all pixels exceeds a predetermined value ($\beta'_0$), n being a display gradation bit number.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction;

the first pixel including a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a third subpixel output signal to a (p,q)th, where p is 1, 2, . . . , P and q is 1, 2, . . . , Q when the pixels are counted along the first direction, first pixel based at least on a third subpixel input signal to the (p,q)th first pixel and a third subpixel input signal to the (p,q)th second pixel and outputting the third subpixel output signal to the third subpixel of the (p,q)th first pixel, and calculating a fourth subpixel output signal to the (p,q)th second signal based on a fourth subpixel control second signal calculated from a first subpixel input signal, a second subpixel input signal and the third subpixel input signal to the (p,q)th second pixel and a fourth subpixel control first signal calculated from a first subpixel input signal, a second subpixel input signal and a third subpixel input signal to an adjacent pixel disposed adjacent the (p,q)th second pixel along the first direction.

The driving method includes:

a step of setting the expansion coefficient ($\alpha_0$) to a value equal to or lower than a predetermined value when a ratio of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n-1)$$

$$G \geq 2R/3+B/3$$

$$B \leq 0.50R$$

but satisfy, where G among (R, G, B) exhibits a maximum value and B exhibits a minimum value, $$R \geq 4B/60+56G/60$$

$$G \geq 0.78 \times (2^n-1)$$

$$B \leq 0.50R$$

to all pixels exceeds a predetermined value ($\beta'_0$), n being a display gradation bit number.

According to an embodiment of the present invention, there is provided a driving method for an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, and (B) a signal processing section.

Each of the pixels is configured from a first subpixel for displaying a first primary color, a second subpixel for displaying a second primary color, a third subpixel for displaying a third primary color and a fourth subpixel for displaying a fourth color.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to (p,q)th, where p is 1, 2, . . . , $P_0$ and q is 1, 2, . . . , $Q_0$ when the pixels are counted along the second direction, pixel based on a fourth subpixel control second signal calculated from a first subpixel input signal, a second subpixel input signal and a third subpixel input signal to the (p,q)th pixel and a fourth subpixel control first signal calculated from a first subpixel input signal, a second subpixel input signal and a third subpixel input signal to an adjacent pixel disposed adjacent the (p,q)th pixel along the second direction, and outputting the calculated fourth subpixel output signal to the fourth subpixel of the (p,q)th pixel.

The driving method includes:

a step of setting the expansion coefficient ($\alpha_0$) to a value equal to or lower than a predetermined value when a ratio of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n-1)$$

$$G \geq 2R/3+B/3$$

$$B \leq 0.50R$$

but satisfy, where G among (R, G, B) exhibits a maximum value and B exhibits a minimum value, $$R \geq 4B/60+56G/60$$

$$G \geq 0.78 \times (2^n-1)$$

$$B \leq 0.50R$$

to all pixels exceeds a predetermined value ($\beta'_0$), n being a display gradation bit number.

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color. The second pixel includes a first subpixel for displaying the first primary color, a second subpixel for displaying the second primary color and a fourth subpixel for displaying a fourth color. The signal processing section is capable of calculating a fourth subpixel output signal based on a fourth subpixel control second signal calculated from a first subpixel input signal, a second subpixel input signal and a third subpixel input signal to a (p,q)th, where p is 1, 2, . . . , P and q is 1, 2, . . . , Q when the pixels are counted along the second direction, second pixel and a fourth subpixel control first signal calculated from a first subpixel input signal, a second subpixel input signal and a third subpixel input signal to an adjacent pixel disposed adjacent the (p,q)th second pixel along the second direction and outputting the calculated fourth subpixel output signal to the fourth subpixel of the (p,q)th second pixel, and calculating a third subpixel output signal based at least on a third subpixel input signal to the (p,q)th second pixel and a third subpixel input signal to the (p,q)th first pixel and outputting the third subpixel output signal to the third subpixel of the (p,q)th first pixel.

The driving method includes:

a step of setting the expansion coefficient ($\alpha_0$) to a value equal to or lower than a predetermined value when a ratio of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 \times 56G/60$$

$$G \geq 0.78 + (2^n - 1)$$

$$B \leq 0.50R$$

to all pixels exceeds a predetermined value ($\beta'_0$), n being a display gradation bit number.

According to an embodiment of the present invention, there is provided a driving method for an image display apparatus which includes (A) an image display panel including a plurality of pixels arrayed in a two-dimensional matrix and each configured from a first subpixel for displaying a first primary color, a second subpixel for displaying a second primary color, a third subpixel for displaying a third primary color and a fourth subpixel for displaying a fourth color, and (B) a signal processing section.

The signal processing section is capable of:

calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal and third subpixel input signal and outputting the calculated fourth subpixel output signal to the fourth subpixel.

The driving method includes:

a step of setting the expansion coefficient ($\alpha_0$) to a value equal to or lower than a predetermined value when a ratio of those pixels which display yellow to all pixels exceeds a predetermined value ($\beta'_0$).

According to an embodiment of the present invention, there is provided a driving method for an image display apparatus which includes (A) an image display panel including a plurality of pixels each configured from a first subpixel for displaying a first primary color, a second subpixel for displaying a second primary color and a third subpixel for displaying a third primary color and arrayed in a first direction and a second direction in a two-dimensional matrix such that a pixel group is configured at least from a first pixel and a second pixel arrayed in the first direction, and a fourth subpixel disposed between the first pixel and the second pixel in each pixel group for displaying a fourth color, and (B) a signal processing section.

The signal processing section is capable of, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal and third subpixel input signal to the first pixel and a fourth subpixel control second signal calculated from the first subpixel input signal, second subpixel input signal and third subpixel input signal to the second pixel and outputting the calculated fourth subpixel output signal to the fourth subpixel.

The driving method includes:

a step of setting the expansion coefficient ($\alpha_0$) to a value equal to or lower than a predetermined value when a ratio of those pixels which display yellow to all pixels exceeds a predetermined value ($\beta'_0$).

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a third subpixel output signal to a (p,q)th, where p is 1, 2, . . . , P and q is 1, 2, . . . , Q when the pixels are counted along the first direction, first pixel based at least on a third subpixel input signal to the (p,q)th first pixel and a third subpixel input signal to the (p,q)th second pixel and outputting the third subpixel output signal to the third subpixel of the (p,q)th first pixel, and calculating a fourth subpixel output signal to the (p,q)th second signal based on a fourth subpixel control second signal calculated from a first subpixel input signal, a second subpixel input signal and the third subpixel input signal to the (p,q)th second pixel and a fourth subpixel control first signal calculated from a first subpixel input signal, a second subpixel input signal and a third subpixel input signal to an adjacent pixel disposed adjacent the (p,q)th second pixel along the first direction.

The driving method includes:

a step of setting the expansion coefficient ($\alpha_0$) to a value equal to or lower than a predetermined value when a ratio of those pixels which display yellow to all pixels exceeds a predetermined value ($\beta'_0$).

According to an embodiment of the present invention, there is provided a driving method for an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, and (B) a signal processing section.

Each of the pixels is configured from a first subpixel for displaying a first primary color, a second subpixel for displaying a second primary color, a third subpixel for displaying a third primary color and a fourth subpixel for displaying a fourth color.

The signal processing section is capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to (p,q)th, where p is 1, 2, . . . , $P_0$ and q is 1, 2, . . . , $Q_0$ when the pixels are counted along the second direction, pixel based on a fourth subpixel control second signal calculated from a first subpixel input signal, a second subpixel input signal and a third subpixel input signal to the (p,q)th pixel and a fourth subpixel control first signal calculated from a first subpixel input signal, a second subpixel input signal and a third subpixel input signal to an adjacent pixel disposed adjacent the (p,q)th pixel along the second direction, and outputting the calculated fourth subpixel output signal to the fourth subpixel of the (p,q)th pixel.

The driving method includes:

a step of setting the expansion coefficient ($\alpha_0$) to a value equal to or lower than a predetermined value when a ratio of those pixels which display yellow to all pixels exceeds a predetermined value ($\beta'_0$).

According to an embodiment of the present invention, there is provided a driving method for an image display apparatus which includes (A) an image display panel wherein totaling P×Q pixel groups arrayed in a two-dimensional matrix including P pixel groups arrayed in a first direction and Q pixel groups arrayed in a second direction, and (B) a signal processing section.

Each of the pixel groups is configured from a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of calculating a fourth subpixel output signal based on a fourth subpixel control second signal calculated from a first subpixel input signal, a second subpixel input signal and a third subpixel input signal to a (p,q)th, where p is 1, 2, . . . , P and q is 1, 2, . . . , Q when the pixels are counted along the second direction, second pixel and a fourth subpixel control first signal calculated from a first subpixel input signal, a second subpixel input signal and a third subpixel input signal to an adjacent pixel disposed adjacent the (p,q)th second pixel along the second direction and outputting the calculated fourth subpixel output signal to the fourth subpixel of the (p,q)th second pixel, and calculating a third subpixel output signal based at least on a third subpixel input signal to the (p,q)th second pixel and a third subpixel input signal to the (p,q)th first pixel and outputting the third subpixel output signal to the third subpixel of the (p,q)th first pixel.

The driving method includes:

a step of setting the expansion coefficient ($\alpha_0$) to a value equal to or lower than a predetermined value when a ratio of those pixels which display yellow to all pixels exceeds a predetermined value ($\beta'_0$).

In the driving methods for an image display apparatus according to the first to fifth embodiments of the present invention, the predetermined value $\beta_0$ may range from 0.003 to 0.05. In other words, the expansion coefficient $\alpha_0$ is determined so that the ratio of those pixels with regard to which the value of the expanded brightness calculated from the product of the brightness V(S) and the expansion coefficient $\alpha_0$ exceeds the maximum value $V_{max}(S)$ may be equal to or higher than 0.3% but equal to or lower than 5% with respect to all pixels.

In the driving methods for an image display apparatus according to the first to 25th embodiments of the present invention, the color space, that is, the HSV (Hue, Saturation and Value) color space, is expanded by addition of the fourth color, and a subpixel output signal is calculated based at least on a subpixel input signal and the expansion coefficient $\alpha_0$. Thus, since the output signal value is expanded based on the expansion coefficient $\alpha_0$, although the luminance of the white display subpixel increases as in the existing art, such a situation that the luminance of the red display subpixel, green display subpixel and blue display subpixel does not increase does not occur. In other words, not only the luminance of the white display subpixel increases, but also the luminance of the red display subpixel, green display subpixel and blue display subpixel increases. Therefore, occurrence of such a problem that darkening in color occurs can be prevented with certainty.

Besides, in the driving methods for an image display apparatus according to the first to fifth embodiments of the present invention, a maximum value $V_{max}(S)$ where the saturation S is a variable is calculated, and a saturation S and a brightness value V(S) of a plurality of pixels are calculated based on subpixel input signal values to the plural pixels. Then, the expansion coefficient $\alpha_0$ is determined so that the ratio of those pixels with regard to which the value of the expanded brightness calculated from the product of the brightness V(S) and the expansion coefficient $\alpha_0$ exceeds the maximum value $V_{max}(S)$ with respect to all pixels may be equal to or lower than the predetermined value $\beta_0$. Accordingly, optimization of output signals to the subpixels can be achieved, and occurrence of such a phenomenon that an unnatural image with which "disorder in gradation" stands out is displayed can be prevented. Meanwhile, increase of the luminance can be achieved with certainty, and consequently, reduction of the power consumption of an entire image display apparatus assembly in which the image display apparatus is incorporated can be anticipated.

Further, in the driving methods for an image display apparatus according to the sixth to tenth embodiments, since the expansion coefficient $\alpha_0$ is set to $$\alpha_0 = BN_4/BN_{1\text{-}3}+1$$

occurrence of such a phenomenon that an unnatural image with which "disorder in gradation" stands out is displayed can be prevented. Meanwhile, increase of the luminance can be achieved with certainty, and consequently, reduction of the power consumption of an entire image display apparatus assembly in which the image display apparatus is incorporated can be anticipated.

From various tests, it was found out that, where an image includes much yellow, if the expansion coefficient $\alpha_0$ exceeds a predetermined value $\alpha'_0$, for example, $\alpha'_0=1.3$, then the image exhibits unnatural color. In the driving methods for an image display apparatus according to the 11th to 15th embodiments, if the ratio of those pixels with regard to which the hue H and the saturation S in the HSV color space remains within a predetermined range to all pixels exceeds a predetermined value $\beta'_0$, for example, particularly 2%, or in other words, if much yellow is mixed in the color of the pixel, then the expansion coefficient $\alpha_0$ is made equal to or lower than the predetermined value $\alpha'_0$, particularly equal to or lower than 1.3. Consequently, even in the case where the image includes much yellow, optimization of output signals to the subpixels can be achieved, and the image can be prevented from becoming an unnatural image. Meanwhile, increase of the luminance can be achieved with certainty, and reduction of the power consumption of an entire image display apparatus assembly in which the image display apparatus is incorporated can be anticipated.

Further, in the driving methods for an image display apparatus according to the 16th to 20th embodiments of the present invention, when the aratio of those pixels which have particular values of (R, G, B) to all pixels exceeds a predetermined value $\beta'_0$, for example, particularly 2%, or in other words, when yellow is included much in the image, the expansion coefficient $\alpha_0$ is made equal to or lower than the predetermined value $\alpha'_0$, particularly equal to or lower than 1.3. Also by this, even in the case where the image includes much yellow, optimization of output signals to the subpixels can be achieved, and the image can be prevented from becoming an unnatural image. Meanwhile, increase of the luminance can be achieved with certainty, and reduction of the power consumption of an entire image display apparatus assembly in which the image display apparatus is incorporated can be anticipated. Besides, it can be discriminated through a small amount of calculation whether or not the image includes much yellow, and consequently, the circuit scale of the signal processing section can be reduced and reduction of the calculation time can be anticipated.

Further, in the driving methods for an image display apparatus according to the 21st to 25th embodiments of the present invention, when the ratio of those pixels which display yellow to all pixels exceeds a predetermined value $\beta'_0$, for example, particularly 2%, the expansion coefficient $\alpha_0$ is made equal to or lower than a predetermined value, for example, particularly equal to or lower than 1.3. Also by this, optimization of output signals to the subpixels can be achieved, and the image can be prevented from becoming an unnatural image. Meanwhile, increase of the luminance can be achieved with certainty, and reduction of the power consumption of an entire image display apparatus assembly in which the image display apparatus is incorporated can be anticipated.

Further, in the driving methods for an image display apparatus according to the first, sixth, 11th, 16th and 21st embodiments of the present invention, increase of the luminance of the display image can be anticipated, and they are very suitable for image display of a still picture, an image of an advertisement medium, and a standby screen image of a portable telephone set. Meanwhile, if the driving methods for an image display apparatus according to the first, sixth, 11th, 16th and 21st embodiments of the present invention are applied to the driving method for the image display apparatus assembly, then since the luminance of the planar light source apparatus can be reduced based on the expansion coefficient $\alpha_0$, reduction of the power consumption of the planar light source apparatus can be anticipated.

Meanwhile, in the driving methods for an image display apparatus according to the second, third, seventh, eighth, 12th, 13th, 17th, 18th, 22nd and 23rd embodiments of the present invention, the signal processing section calculates a fourth subpixel output signal from a first subpixel input signal, a second subpixel input signal and a third subpixel input signal to the first and second pixels of each pixel group and outputs the calculated fourth subpixel output signal. In other words, since the fourth subpixel input signal is calculated based on the input signals to the first and second pixels positioned adjacent each other, optimization of the output signal to the fourth subpixel is achieved. Besides, in the driving methods for an image display apparatus according to the second, third, seventh, eighth, 12th, 13th, 17th, 18th, 22nd and 23rd embodiments of the present invention, since one fourth subpixel is disposed for a pixel group configured at least from first and second pixels, reduction of the area of the aperture region of the subpixel can be suppressed. As a result, increase of the luminance can be anticipated and the display quality can be anticipated. Further, the power consumption of the backlight can be reduced.

Further, in the driving methods for an image display apparatus according to the fourth, ninth, 14th, 19th and 24th embodiments of the present invention, a fourth subpixel output signal to the (p,q)th pixel is calculated based on a subpixel input signal to the (p,q)th pixel and a subpixel input signal to an adjacent pixel positioned adjacent the (p,q)th pixel along the second direction. In particular, the fourth subpixel output signal to a certain pixel is calculated based on the input signals to the certain pixel and the adjacent pixel adjacent the certain pixel. Therefore, optimization of the output signal to the fourth subpixel is achieved. Further, since the fourth subpixel is provided, increase of the luminance can be anticipated with certainty and improvement of the display quality can be anticipated.

Further, in the driving methods for an image display apparatus according to the fifth, tenth, 15th, 20th and 25th embodiments of the present invention, a fourth subpixel output signal to the (p,q)th second pixel is calculated based on a subpixel input signal to the (p,q)th second pixel and a subpixel input signal to an adjacent pixel positioned adjacent the (p,q)th second pixel along the second direction. In other words, the fourth subpixel output signal to a second pixel which configures a certain pixel group is calculated based not only on input signals to the second pixel which configures the certain pixel group but also on input signals to the adjacent pixel positioned adjacent the second pixel. Therefore, optimization of the output signal to the fourth subpixel is achieved. Besides, since one fourth subpixel is disposed for a pixel group configured from first and second pixels, reduction of the area of the aperture region of the subpixel can be suppressed. As a result, increase of the luminance can be anticipated and the display quality can be anticipated.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENTS

Figure 1:
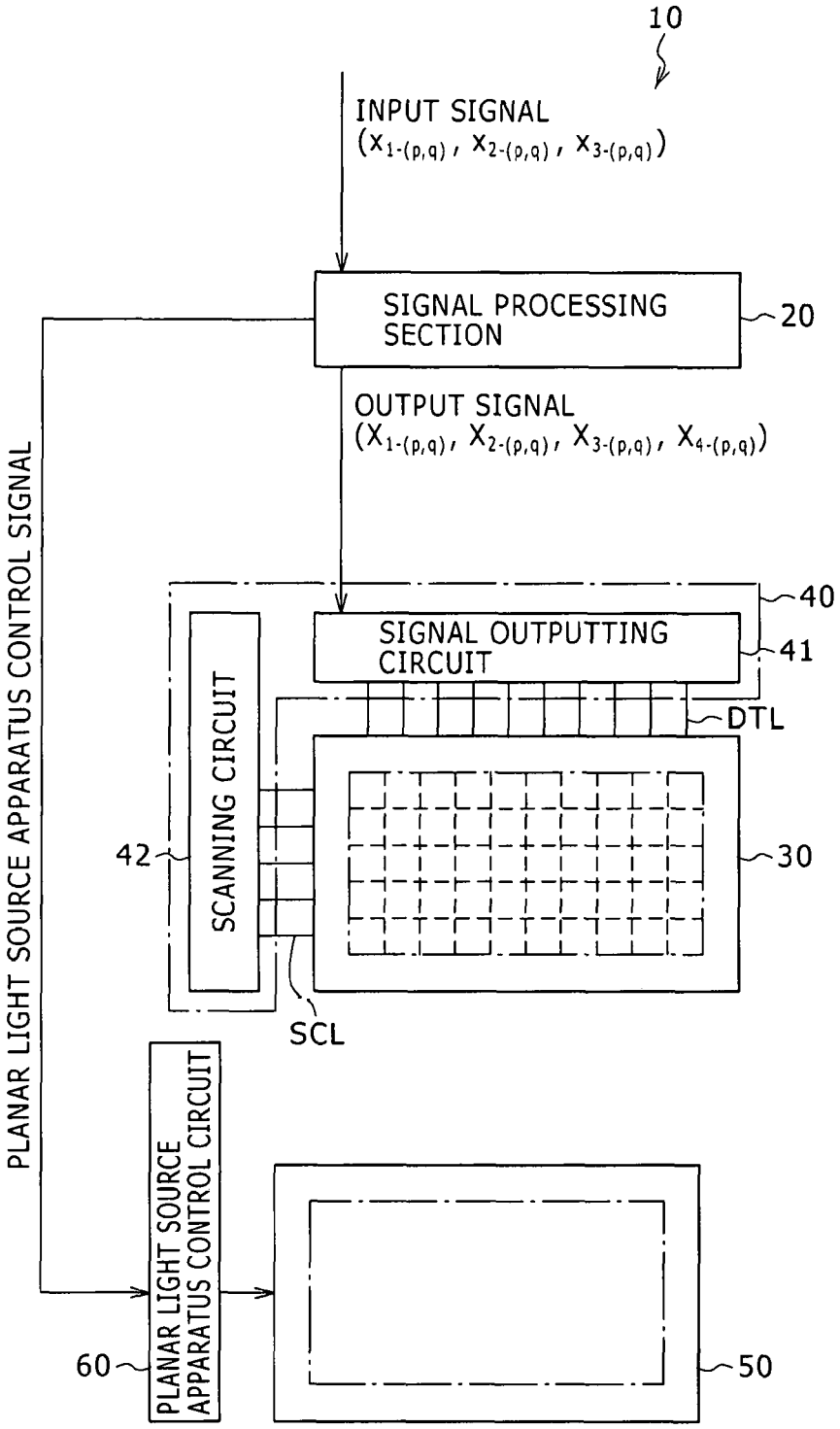
FIG. 1 is a block diagram of an image display apparatus of a working example 1.

In the following, the present invention is described in connection with preferred embodiments thereof. However, the present invention is not limited to the embodiments, and various numerical values, materials and so forth described in the description of the embodiments are merely illustrative. It is to be noted that the description is given in the following order.

1. General description of a driving method for an image display apparatus according to first to 25th embodiments of the present invention
2. Working example 1 (driving method for the image display apparatus according to the first, sixth, 11th, 16th and 21st embodiments of the present invention)
3. Working example 2 (modification to the working example 1)
4. Working example 3 (another modification to the working example 1)
5. Working example 4 (driving method for the image display apparatus according to the second, seventh, 12th, 17th and 22nd embodiments of the present invention)
6. Working example 5 (modification to the working example 4)
7. Working example 6 (another modification to the working example 4)
8. Working example 7 (driving method for the image display apparatus according to the third, eighth, 13th, 18th and 23rd embodiments of the present invention)
9. Working example 8 (modification to the working example 7)
10. Working example 9 (driving method for the image display apparatus according to the fourth, ninth, 14th, 19th and 24th embodiments of the present invention)
11. Working example 10 (driving method for the image display apparatus according to the fifth, tenth, 15th, 20th and 25th embodiments of the present invention), others General Description of a Driving Method for an Image Display Apparatus According to the First to 25th Embodiments of the Present Invention Image display apparatus assemblies for use with driving methods for an image display apparatus assembly according to first to 25th embodiments in the following description are the image display apparatus of the first to 25th embodiments of the present invention described above and image display apparatus assemblies which include a planar light source apparatus for illuminating the image display apparatus from the rear side. Further, to the driving methods for an image display apparatus assembly according to the first to 25th embodiments, the driving methods for an image display apparatus according to the first to 25th embodiments of the present invention can be applied.

Here, the driving method for the image display apparatus according to the first embodiment and the driving method for the image display apparatus assembly according to the first embodiment of the present invention including the preferred mode described above, the driving method for the image display apparatus according to the sixth embodiment and the driving method for the image display apparatus assembly according to the sixth embodiment of the present invention including the preferred mode described above, the driving method for the image display apparatus according to the 11th embodiment and the driving method for the image display apparatus assembly according to the 11th embodiment of the present invention including the preferred mode described above, the driving method for the image display apparatus according to the 16th embodiment and the driving method for the image display apparatus assembly according to the 16th embodiment of the present invention including the preferred mode described above, and the driving method for the image display apparatus according to the 21st embodiment and the driving method for the image display apparatus assembly according to the 21st embodiment of the present invention including the preferred mode described above are collectively referred to simply as "a driving method according to the first embodiment or the like." Further, the driving method for the image display apparatus according to the second embodiment and the driving method for the image display apparatus assembly according to the second embodiment of the present invention including the preferred mode described above, the driving method for the image display apparatus according to the seventh embodiment and the driving method for the image display apparatus assembly according to the seventh embodiment of the present invention including the preferred mode described above, the driving method for the image display apparatus according to the 12th embodiment and the driving method for the image display apparatus assembly according to the 12th embodiment of the present invention including the preferred mode described above, the driving method for the image display apparatus according to the 17th embodiment and the driving method for the image display apparatus assembly according to the 17th embodiment of the present invention including the preferred mode described above, and the driving method for the image display apparatus according to the 22nd embodiment and the driving method for the image display apparatus assembly according to the 22nd embodiment of the present invention including the preferred mode described above are collectively referred to simply as "a driving method according to the second embodiment or the like." Further, the driving method for the image display apparatus according to the third embodiment and the driving method for the image display apparatus assembly according to the third embodiment of the present invention including the preferred mode described above, the driving method for the image display apparatus according to the eighth embodiment and the driving method for the image display apparatus assembly according to the eighth embodiment of the present invention including the preferred mode described above, the driving method for the image display apparatus according to the 13th embodiment and the driving method for the image display apparatus assembly according to the 13th embodiment of the present invention including the preferred mode described above, the driving method for the image display apparatus according to the 18th embodiment and the driving method for the image display apparatus assembly according to the 18th embodiment of the present invention including the preferred mode described above, and the driving method for the image display apparatus according to the 23rd embodiment and the driving method for the image display apparatus assembly according to the 23rd embodiment of the present invention including the preferred mode described above are collectively referred to simply as "a driving method according to the third embodiment or the like." Further, the driving method for the image display apparatus according to the fourth embodiment and the driving method for the image display apparatus assembly according to the fourth embodiment of the present invention including the preferred mode described above, the driving method for the image display apparatus according to the ninth embodiment and the driving method for the image display apparatus assembly according to the ninth embodiment of the present invention including the preferred mode described above, the driving method for the image display apparatus according to the 14th embodiment and the driving method for the image display apparatus assembly according to the 14th embodiment of the present invention including the preferred mode described above, the driving method for the image display apparatus according to the 19th embodiment and the driving method for the image display apparatus assembly according to the 19th embodiment of the present invention including the preferred mode described above, and the driving method for the image display apparatus according to the 24th embodiment and the driving method for the image display apparatus assembly according to the 24th embodiment of the present invention including the preferred mode described above are collectively referred to simply as "a driving method according to the fourth embodiment or the like." Further, the driving method for the image display apparatus according to the fifth embodiment and the driving method for the image display apparatus assembly according to the fifth embodiment of the present invention including the preferred mode described above, the driving method for the image display apparatus according to the tenth embodiment and the driving method for the image display apparatus assembly according to the tenth embodiment of the present invention including the preferred mode described above, the driving method for the image display apparatus according to the 15th embodiment and the driving method for the image display apparatus assembly according to the 15th embodiment of the present invention including the preferred mode described above, the driving method for the image display apparatus according to the 20th embodiment and the driving method for the image display apparatus assembly according to the 20th embodiment of the present invention including the preferred mode described above, and the driving method for the image display apparatus according to the 25th embodiment and the driving method for the image display apparatus assembly according to the 25th embodiment of the present invention including the preferred mode described above are collectively referred to simply as "a driving method according to the fifth embodiment or the like."

A driving method according to a first embodiment or the like or a fourth embodiment or the like of the present invention including preferred mode described above can be configured in the following manner.

In particular, regarding a (p,q)th pixel (where $1 \le p \le P_0$, $1 \le q \le Q_0$)

a first subpixel input signal having a signal value of $x_{1-(p,q)}$, a second subpixel input signal having a signal value of $x_{2-(p,q)}$ and a third subpixel input signal having a signal value of $x_{3-(p,q)}$ are inputted to a signal processing section. Further, the signal processing section outputs, regarding the (p,q)th pixel, a first subpixel output signal having a signal value of $x_{1-(p,q)}$ for determining a display gradation of a first subpixel, a second subpixel output signal having a signal value of $x_{2-(p,q)}$ for determining a display gradation of a second subpixel, a third subpixel output signal having a signal value of $x_{3-(p,q)}$ for determining a display gradation of a third subpixel, and a fourth subpixel output signal having a signal value of $x_{4-(p,q)}$ for determining a display gradation of a fourth subpixel.

Meanwhile, a driving method according to a second embodiment or the like, a third embodiment or the like, or a fifth embodiment or the like of the present invention including preferred mode described above can be configured in the following manner.

In particular, regarding first pixel which configures a (p,q)th pixel group (where $1 \le p \le P$, $1 \le q \le Q$), a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, are inputted to a signal processing section, and regarding a second pixel which configures the (p,q)th pixel group, a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, are inputted to the signal processing section.

Further, regarding the first pixel which configures the (p,q)th pixel group, the signal processing section outputs a first subpixel output signal having a signal value of $x_{1-(p,q)-1}$ for determining a display gradation of the first subpixel, a second subpixel output signal having a signal value of $x_{2-(p,q)-1}$ for determining a display gradation of the second subpixel, and a third subpixel output signal having a signal value of $x_{3-(p,q)-1}$ for determining a display gradation of the third subpixel.

Further, regarding the second pixel which configures the (p,q)th pixel group, the signal processing section outputs a first subpixel output signal having a signal value of $x_{1-(p,q)-2}$ for determining a display gradation of the first subpixel, a second subpixel output signal having a signal value of $x_{2-(p,q)-2}$ for determining a display gradation of the second subpixel, and a third subpixel output signal having a signal value of $x_{3-(p,q)-2}$ for determining a display gradation of the third subpixel (a driving method according to the second embodiment or the like of the present invention), and regarding to the forth subpixel, a fourth subpixel output signal having a signal value of $x_{4-(p,q)-2}$ for determining a display gradation of the fourth subpixel (a driving method according to the second embodiment or the like, the third embodiment or the like, or the fifth embodiment or the like of the present invention).

Further, in the driving method according to the third embodiment or the like of the present invention, the signal processing section can be configured such that, regarding an adjacent pixel positioned adjacent the (p,q)th pixel, a first subpixel input signal having a signal value of $x_{1-(p',q)}$, a second subpixel input signal having a signal value of $x_{2-(p',q)}$, and a third subpixel input signal having a signal value of $x_{3-(p',q)}$ are inputted.

Further, in the driving method according to the fourth embodiment or the like and the fifth embodiment or the like of the present invention, the signal processing section can be configured such that, regarding an adjacent pixel positioned adjacent the (p,q)th pixel, a first subpixel input signal having a signal value of $x_{1-(p,q')}$, a second subpixel input signal having a signal value of $x_{2-(p,q')}$, and a third subpixel input signal having a signal value of $x_{3-(p,q')}$ are inputted.

Further, $Max_{(p,q)}$, $Min_{(p,q)}$, $Max_{(p,q)-1}$, $Min_{(p,q)-1}$, $Max_{(p,q)-2}$, $Min_{(p,q-2)}$, $Max_{(p',q)-1}$, $Min_{(p',q)-1}$, $Max_{(p,q')}$, and $Min_{(p,q')}$ are defined in the following manner.

$Max_{(p,q)}$: a maximum value among three subpixel input signal values including a first subpixel input signal value $x_{1-(p,q)}$, a second subpixel input signal value $x_{2-(p,q)}$ and a third subpixel input signal value $x_{3-(p,q)}$ to the (p,q)th pixel $Min_{(p,q)}$: a minimum value among the three subpixel input signal values including the first subpixel input signal value $x_{1-(p,q)}$, second subpixel input signal value $x_{2-(p,q)}$ and third subpixel input signal value $x_{3-(p,q)}$ to the (p,q)th pixel $Max_{(p,q)-1}$: a maximum value among three subpixel input signal values including a first subpixel input signal value $x_{1-(p,q)-1}$, a second subpixel input signal value $x_{2-(p,q)-1}$ and a third subpixel input signal value $x_{3-(p,q)-1}$ to the (p,q)th first pixel $Min_{(p,q)-1}$: a minimum value among the three subpixel input signal values including the first subpixel input signal value $x_{1-(p,q)-1}$, second subpixel input signal value $x_{2-(p,q)-1}$ and third subpixel input signal value $x_{3-(p,q)-1}$ to the (p,q)th first pixel $Max_{(p,q)-2}$: a maximum value among three subpixel input signal values including a first subpixel input signal value $x_{1-(p,q)-2}$, a second subpixel input signal value $x_{2-(p,q)-2}$ and a third subpixel input signal value $x_{3-(p,q)-2}$ to the (p,q)th second pixel $Min_{(p,q)-2}$: a minimum value among the three subpixel input signal values including the first subpixel input signal value $x_{1-(p,q)-2}$, second subpixel input signal value $x_{2-(p,q)-2}$ and third subpixel input signal value $x_{3-(p,q)-2}$ to the (p,q)th first pixel $Max_{(p',q)-1}$: a maximum value among three subpixel input signal values including a first subpixel input signal value a second subpixel input signal value $x_{2-(p',q)}$ and a third subpixel input signal value $x_{3-(p',q)}$ to the adjacent pixel positioned adjacent the (p,q)th second pixel in the first direction $Min_{(p',q)-1}$: a minimum value among the three subpixel input signal values including the first subpixel input signal value second subpixel input signal value $x_{2-(p',q)}$ and third subpixel input signal value $x_{3-(p',q)}$ to the adjacent pixel positioned adjacent the (p,q)th second pixel in the first direction $Max_{(p,q')}$: a maximum value among three subpixel input signal values including a first subpixel input signal value $x_{1-(p,q')}$, a second subpixel input signal value $x_{2-(p,q')}$ and a third subpixel input signal value $x_{3-(p,q')}$ to an adjacent pixel positioned adjacent the (p,q)th second pixel in the second direction $Min_{(p,q')}$: a minimum value among the three subpixel input signal values including the first subpixel input signal value $x_{1-(p,q')}$, second subpixel input signal value $x_{2-(p,q')}$ and third subpixel input signal value $x_{3-(p,q')}$ to the adjacent pixel positioned adjacent the (p,q)th second pixel in the second direction The driving method according to the first embodiment or the like of the present invention may be configured such that the value of the fourth subpixel output signal is calculated based at least on the value of Min and the expansion coefficient $\alpha_0$. More particularly, the fourth subpixel output signal value $x_{4-(p,q)}$ can be calculated from, for example, expressions given below. It is to be noted that $c_{11}$, $c_{12}$, $c_{13}$, $c_{14}$, $c_{15}$ and $c_{16}$ in the expressions are constants. What value or what expression should be applied for the value of $x_{4-(p,q)}$ may be calculated suitably by making a prototype of the image display apparatus or the image display apparatus assembly and carrying out evaluation of images, for example, by an image observer.

$$X_{4-(p,q)}=c_{11}(Min_{(p,q)}\cdot\alpha_0 \quad (1\text{-}1),$$

or $$X_{4-(p,q)}=c_{12}(Min_{(p,q)}{}^2\cdot\alpha_0 \quad (1\text{-}2),$$

or $$X_{4-(p,q)}=c_{13}(Min_{(p,q)}{}^{1/2}\cdot\alpha_0 \quad (1\text{-}3),$$

or else $$x_{4-(p,q)}=c_{14}\{\text{product of } (Min_{(p,q)}/Max_{(p,q)}) \text{ or } (2^n-1) \text{ and } \alpha_0\} \quad (1\text{-}4)$$

or else $$x_{4-(p,q)}=c_{15}[\text{product of } \{(2^n-1)\times Min_{(p,q)}/(Max_{(p,q)}-Min_{(p,q)}\} \text{ or } (2^n-1) \text{ and } \alpha_0] \quad (1\text{-}5)$$

or else $$x_{4-(p,q)}=c_{16}\{\text{product of lower one of values of } (Max_{(p,q)})^{1/2} \text{ and } Min_{(p,q)} \text{ and } \alpha_0\} \quad (1\text{-}6)$$

The driving method according to the first embodiment or the like or the fourth embodiment or the like of the present invention can be configured to calculate the first subpixel output signal based at least on the first subpixel input signal and the expansion coefficient $\alpha_0$;

calculate the second subpixel output signal based at least on the second subpixel input signal and the expansion coefficient $\alpha_0$; and calculate the third subpixel output signal based at least on the third subpixel input signal and the expansion coefficient $\alpha_0$.

More particularly, in the driving methods according to the first embodiment or the like or the fourth embodiment or the like of the present invention, when $\chi$ is defined as a constant which relies upon the image display apparatus, the signal processing section can calculate the first subpixel output signal value $x_{1-(p,q)}$, second subpixel output signal value $x_{2-(p,q)}$ and third subpixel output signal value $x_{3-(p,q)}$ to the (p,q)th pixel or the set of first, second and third subpixels from expressions given below. It is to be noted that the fourth subpixel control second signal value $SG_{2-(p,q)}$, the fourth subpixel control first signal value $SG_{1-(p,q)}$ and a control signal value or third subpixel control signal value $SG_{3-(p,q)}$ are hereinafter described.

First Embodiment or the Like of the Present Invention $$X_{1-(p,q)}=\alpha_0 \cdot x_{1-(p,q)}-\chi \cdot X_{4-(p,q)} \quad (1\text{-A})$$

$$X_{2-(p,q)}=\alpha_0 \cdot x_{2-(p,q)}-\chi \cdot X_{4-(p,q)} \quad (1\text{-B})$$

$$X_{3-(p,q)}=\alpha_0 \cdot x_{3-(p,q)}-\chi \cdot X_{4-(p,q)} \quad (1\text{-C})$$

Fourth Embodiment or the Like of the Present Invention $$X_{1-(p,q)}=\alpha_0 \cdot x_{1-(p,q)}-\chi \cdot SG_{2-(p,q)} \quad (1\text{-D})$$

$$X_{2-(p,q)}=\alpha_0 \cdot x_{2-(p,q)}-\chi \cdot SG_{2-(p,q)} \quad (1\text{-E})$$

$$X_{3-(p,q)}=\alpha_0 \cdot x_{3-(p,q)}-\chi \cdot SG_{2-(p,q)} \quad (1\text{-F})$$

Here, where the luminance of a set of first, second and third subpixels which configure a pixel (the first embodiment or the like and the fourth embodiment or the like of the present invention) or a pixel group (the second embodiment or the like, the third embodiment or the like and the fifth embodiment or the like of the present invention) when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel is represented by $BN_{1-3}$ and the luminance of the fourth subpixel when a signal having a value corresponding to a maximum signal value of the fourth subpixel output signal is inputted to the fourth subpixel which configures the pixel (the first embodiment or the like and the fourth embodiment or the like of the present invention) or the pixel group (the second embodiment or the like, the third embodiment or the like and the fifth embodiment or the like of the present invention) is represented by $BN_4$, the constant $\chi$ can be represented as $$\chi=BN_4/BN_{1-3}$$

Accordingly, the expression $$\alpha_0=BN_4/BN_{1-3}+1$$

in the driving methods for an image display apparatus according to the sixth to tenth embodiments of the present invention described hereinabove can be rewritten as $$\alpha_0=\chi+1$$

It is to be noted that the constant $\chi$ is a value unique to the image display apparatus or image display apparatus assembly and is determined uniquely by image display apparatus or image display apparatus assembly. In regard to the constant $\chi$, this similarly applies also in the following description.

In the driving methods according to the second embodiment or the like of the present invention, the signal processing section can be configured such that, regarding the first pixel, it calculates, while it calculates the first subpixel output signal based at least on the first subpixel input signal and the expansion coefficient $\alpha_0$, the first subpixel output signal having the signal value $X_{1-(p,q)-1}$ based at least on the first subpixel input signal having the signal value $x_{1-(p,q)-1}$ and the expansion coefficient $\alpha_0$ as well as the fourth subpixel control first signal having the signal value $SG_{1-(p,q)}$;

calculates, while it calculates the second subpixel output signal based at least on the second subpixel input signal and the expansion coefficient $\alpha_0$, the second subpixel output signal having the signal value $x_{2-(p,q)-1}$ based at least on the second subpixel input signal value $x_{2-(p,q)-1}$ and the expansion coefficient $\alpha_0$ as well as the fourth subpixel control first signal having the signal value $SG_{1-(p,q)}$; and calculates, while it calculates the third subpixel output signal based at least on the third subpixel input signal and the expansion coefficient $\alpha_0$, the third subpixel output signal having the signal value $x_{3-(p,q)-1}$ based at least on the third subpixel input signal value $x_{3-(p,q)-1}$ and the expansion coefficient $\alpha_0$ as well as the fourth subpixel control first signal having the signal value $SG_{1-(p,q)}$; and regarding the second pixel, it calculates, while it calculates the first subpixel output signal based at least on the first subpixel input signal and the expansion coefficient $\alpha_0$, the first subpixel output signal having the signal value $x_{1-(p,q)-2}$ based at least on the first subpixel input signal value $x_{1-(p,q)-2}$ and the expansion coefficient $\alpha_0$ as well as the fourth subpixel control second signal having the signal value $SG_{2-(p,q)}$;

calculates, while it calculates the second subpixel output signal based at least on the second subpixel input signal and the expansion coefficient $\alpha_0$, the second subpixel output signal having the signal value $x_{2-(p,q)-2}$ based at least on the second subpixel input signal value $x_{2-(p,q)-2}$ and the expansion coefficient $\alpha_0$ as well as the fourth subpixel control second signal having the signal value $SG_{2-(p,q)}$; and calculates, while it calculates the third subpixel output signal based at least on the third subpixel input signal and the expansion coefficient $\alpha_0$, the third subpixel output signal having the signal value $x_{3-(p,q)-2}$ based at least on the third subpixel input signal value $x_{3-(p,q)-2}$ and the expansion coefficient $\alpha_0$ as well as the fourth subpixel control second signal having the signal value $SG_{2-(p,q)}$.

In the driving method according to the second embodiment or the like of the present invention, the first subpixel output signal value $x_{1-(p,q)-1}$ is calculated based at least on the first subpixel input signal value $x_{1-(p,q)-1}$ and the expansion coefficient $\alpha_0$ as well as the fourth subpixel control first signal value $SG_{1-(p,q)}$ as described hereinabove. However, also it is possible to calculate the first subpixel output signal value $x_{1-(p,q)-1}$ by $$[x_{1-(p,q)-1}, \alpha_0, SG_{1-(p,q)}]$$

or by $$[x_{1-(p,q)-1}, x_{1-(p,q)-2}, \alpha_0, SG_{1-(p,q)}]$$

Similarly, although the second subpixel output signal value $x_{2-(p,q)-1}$ is calculated based at least on the second subpixel input signal value $x_{2-(p,q)-1}$ and the expansion coefficient $\alpha_0$ as well as the fourth subpixel control first signal value $SG_{1-(p,q)}$. However, also it is possible to calculate the second subpixel output signal value $x_{2-(p,q)-1}$ by $$[X_{2-(p,q)-1}, \alpha_0, SG_{1-(p,q)}]$$

or by $$[x_{2-(p,q)-1}, x_{2-(p,q)-2}, \alpha_0, SG_{1-(p,q)}]$$

Similarly, although third subpixel output signal value $x_{3-(p,q)-1}$ is calculated based at least on the third subpixel input signal value $x_{3-(p,q)-1}$ and the expansion coefficient $\alpha_0$ as well as the fourth subpixel control first signal value $SG_{1-(p,q)}$. However, also it is possible to calculate the third subpixel output signal value $x_{3-(p,q)-1}$ by $$[x_{3-(p,q)-1}, \alpha_0, SG_{1-(p,q)}]$$

or by $$[x_{3-(p,q)-1}, x_{3-(p,q)-2}, \alpha_0, SG_{1-(p,q)}]$$

Also the output signal values $x_{1-(p,q)-2}$, $x_{2-(p,q)-2}$ and $x_{3-(p,q)-2}$ can be calculated in a similar manner.

More particularly, in the driving method according to the second embodiment or the like of the present invention, the signal processing section can calculate the output signal values $X_{1-(p,q)-1}$, $x_{2-(p,q)-1}$, $x_{3-(p,q)-1}$, $x_{1-(p,q)-2}$, $x_{2-(p,q)-2}$ and $x_{3-(p,q)-2}$ from the following expressions.

$$X_{1-(p,q)-1}=\alpha_0 \cdot x_{1-(p,q)-1}-\chi \cdot SG_{1-(p,q)} \quad (2\text{-A})$$

$$X_{2-(p,q)-1}=\alpha_0 \cdot x_{2-(p,q)-1}-\chi \cdot SG_{1-(p,q)} \quad (2\text{-B})$$

$$X_{3-(p,q)-1}=\alpha_0 \cdot x_{3-(p,q)-1}-\chi \cdot SG_{1-(p,q)} \quad (2\text{-C})$$

$$X_{1-(p,q)-2}=\alpha_0 \cdot x_{1-(p,q)-2}-\chi \cdot SG_{2-(p,q)} \quad (2\text{-D})$$

$$X_{2-(p,q)-2}=\alpha_0 \cdot x_{2-(p,q)-2}-\chi \cdot SG_{2-(p,q)} \quad (2\text{-E})$$

$$X_{3-(p,q)-2}=\alpha_0 \cdot x_{3-(p,q)-2}-\chi \cdot SG_{2-(p,q)} \quad (2\text{-F})$$

In the driving methods according to the third embodiment or the like or the fifth embodiment or the like of the present invention, the signal processing section can be configured such that, regarding the second pixel, it calculates, while it calculates the first subpixel output signal based at least on the first subpixel input signal and the expansion coefficient $\alpha_0$, the first subpixel output signal having the signal value $x_{1-(p,q)-2}$ based at least on the first subpixel input signal value $x_{1-(p,q)-2}$ and the expansion coefficient $\alpha_0$ as well as the fourth subpixel control second signal having the signal value $SG_{2-(p,q)}$;

calculates, while it calculates the second subpixel output signal based at least on the second subpixel input signal and the expansion coefficient $\alpha_0$, the second subpixel output signal having the signal value $x_{2-(p,q)-2}$ based at least on the second subpixel input signal value $x_{2-(p,q)-2}$ and the expansion coefficient $\alpha_0$ as well as the fourth subpixel control second signal having the signal value $SG_{2-(p,q)}$; and further regarding the first pixel, it calculates, while it calculates the first subpixel output signal based at least on the first subpixel input signal and the expansion coefficient $\alpha_0$, the first subpixel output signal having the signal value $x_{1-(p,q)-1}$ based at least on the first subpixel input signal value $x_{1-(p,q)-1}$ and the expansion coefficient $\alpha_0$ as well as the third subpixel control signal having the signal value $SG_{3-(p,q)}$ or the fourth subpixel control first signal having the signal value $SG_{1-(p,q)}$;

calculates, while it calculates the second subpixel output signal based at least on the second subpixel input signal and the expansion coefficient $\alpha_0$, the second subpixel output signal having the signal value $x_{2-(p,q)-1}$ based at least on the second subpixel input signal value $x_{2-(p,q)-1}$ and the expansion coefficient $\alpha_0$ as well as the third subpixel control signal having the signal value $SG_{3-(p,q)}$ or the fourth subpixel control first signal having the signal value $SG_{1-(p,q)}$; and calculates, while it calculates the third subpixel output signal based at least on the third subpixel input signal and the expansion coefficient $\alpha_0$, the third subpixel output signal having the signal value $x_{3-(p,q)-1}$ based at least on the third subpixel input signal values $x_{3-(p,q)-1}$ and $x_{3-(p,q)-2}$ and the expansion coefficient $\alpha_0$ as well as the third subpixel control signal having the signal value $SG_{3-(p,q)}$ and the fourth subpixel control second signal having the signal value $SG_{2-(p,q)}$ or else, based at least on the third subpixel input signal values $x_{3-(p,q)-1}$ and $x_{3-(p,q)-2}$ and the expansion coefficient $\alpha_0$ as well as the fourth subpixel control first signal having the signal value $SG_{1-(p,q)}$ and the fourth subpixel control second signal having the signal value $SG_{2-(p,q)}$.

More particularly, in the driving method according to the third embodiment or the like or the fifth embodiment or the like of the present invention, the signal processing section can calculate the output signal values $x_{1-(p,q)-2}$, $x_{2-(p,q)-2}$, $x_{1-(p,q)-1}$, $x_{2-(p,q)-1}$, and $x_{3-(p,q)-1}$ from the following expressions.

$$X_{1-(p,q)-2}=\alpha_0 \cdot x_{1-(p,q)-2}-\chi \cdot SG_{2-(p,q)} \quad (3\text{-A})$$

$$X_{2-(p,q)-2}=\alpha_0 \cdot x_{2-(p,q)-2}-\chi \cdot SG_{2-(p,q)} \quad (3\text{-B})$$

$$X_{1-(p,q)-1}=\alpha_0 \cdot x_{1-(p,q)-1}-\chi \cdot SG_{1-(p,q)} \quad (3\text{-C})$$

$$X_{2-(p,q)-1}=\alpha_0 \cdot x_{2-(p,q)-1}-\chi \cdot SG_{1-(p,q)} \quad (3\text{-D})$$

or $$X_{1-(p,q)-1}=\alpha_0 \cdot x_{1-(p,q)-1}-\chi \cdot SG_{3-(p,q)} \quad (3\text{-E})$$

$$X_{2-(p,q)-1}=\alpha_0 \cdot x_{2-(p,q)-1}-\chi \cdot SG_{3-(p,q)} \quad (3\text{-F})$$

Further, where $C_{31}$ and $C_{32}$ are constants, the third subpixel output signal value (the third subpixel output signal value $x_{3-(p,q)-1}$) of the first pixel can be calculated by the expressions given below, for example.

$$X_{3-(p,q)-1}=(C_{31} \cdot X'_{3-(p,q)-1}+C_{32} \cdot X'_{3-(p,q)-2}/(C_{21}+C_{22}) \quad (3\text{-a})$$

or $$X_{3-(p,q)-1}=C_{31} \cdot X'_{3-(p,q)-1}+C_{32} \cdot X'_{3-(p,q)-2} \quad (3\text{-b})$$

or $$X_{3-(p,q)-1}=C_{21} \cdot (X'_{3-(p,q)-1}-X'_{3-(p,q)-2})+C_{22} \cdot X'_{3-(p,q)-2} \quad (3\text{-c})$$

where $$X'_{3-(p,q)-1}=\alpha_0 \cdot x_{3-(p,q)-1}-\chi \cdot SG_{1-(p,q)} \quad (3\text{-d})$$

$$X'_{3-(p,q)-2}=\alpha_0 \cdot x_{3-(p,q)-2}-\chi \cdot SG_{2-(p,q)} \quad (3\text{-e})$$

or $$X'_{3-(p,q)-1}=\alpha_0 \cdot x_{3-(p,q)-1}-\chi \cdot SG_{3-(p,q)} \quad (3\text{-f})$$

$$X'_{3-(p,q)-2}=\alpha_0 \cdot x_{3-(p,q)-2}-\chi \cdot SG_{2-(p,q)} \quad (3\text{-g})$$

In the driving methods according to the second embodiment or the like to the fifth embodiment or the like of the present invention, the fourth subpixel control first signal having the signal value $SG_{1-(p,q)}$ and the fourth subpixel control second signal having the signal value $SG_{2-(p,q)}$ can be calculated specifically, for example, from the following expressions. It is to be noted that $C_{21}$, $C_{22}$, $C_{23}$, $C_{24}$, $C_{25}$ and $C_{26}$ are constants. What value or what expression should be applied for the value of $X_{4-(p,q)}$ and $X_{4-(p,q)-2}$ may be determined suitably by making a prototype of the image display apparatus or the image display apparatus assembly and carrying out evaluation of images, for example, by an image observer.

$$SG_{1-(p,q)}=c_{21}(\mathrm{Min}_{(p,q)-1})\cdot\alpha_0 \quad (2\text{-}1\text{-}1),$$

$$SG_{2-(p,q)}=c_{21}(\mathrm{Min}_{(p,q)-2})\cdot\alpha_0 \quad (2\text{-}1\text{-}2),$$

or $$SG_{1-(p,q)}=c_{22}(\mathrm{Min}_{(p,q)-1})^2\cdot\alpha_0 \quad (2\text{-}2\text{-}1),$$

$$SG_{2-(p,q)}=c_{22}(\mathrm{Min}_{(p,q)-2})^2\cdot\alpha_0 \quad (2\text{-}2\text{-}2),$$

or else $$SG_{1-(p,q)}=c_{23}(\mathrm{Max}_{(p,q)-1})^{1/2}\cdot\alpha_0 \quad (2\text{-}3\text{-}1),$$

$$SG_{2-(p,q)}=c_{23}(\mathrm{Max}_{(p,q)-2})^{1/2}\cdot\alpha_0 \quad (2\text{-}3\text{-}2),$$

or else $$SG_{1-(p,q)}=c_{24}\{\text{product of } (\mathrm{Min}_{(p,q)-1}/\mathrm{Max}_{(p,q)-1}) \text{ or } (2^n-1) \text{ and } \alpha_0\} \quad (2\text{-}4\text{-}1)$$

$$SG_{2-(p,q)}=c_{24}\{\text{product of } (\mathrm{Min}_{(p,q)-2}/\mathrm{Max}_{(p,q)-2}) \text{ or } (2^n-1) \text{ and } \alpha_0\} \quad (2\text{-}4\text{-}2)$$

or else $$SG_{1-(p,q)}=c_{25}[\text{product of } \{(2^n-1)\cdot\mathrm{Min}_{(p,q)-1}/(\mathrm{Max}_{(p,q)-1}-\mathrm{Min}_{(p,q)-1})\} \text{ or } (2^n-1) \text{ and } \alpha_0] \quad (2\text{-}5\text{-}1)$$

$$SG_{2-(p,q)}=c_{25}[\text{product of } \{(2^n-1)\cdot\mathrm{Min}_{(p,q)-2}/(\mathrm{Max}_{(p,q)-1}-\mathrm{Min}_{(p,q)-1})\} \text{ or } (2^n-1) \text{ and } \alpha_0] \quad (2\text{-}5\text{-}2)$$

or else $$SG_{1-(p,q)}=c_{26}\{\text{product of lower one of values of } (\mathrm{Max}_{(p,q)-1})^{1/2} \text{ and } \mathrm{Min}_{(p,q)-1} \text{ and } \alpha_0\} \quad (2\text{-}6\text{-}1)$$

$$SG_{2-(p,q)}=c_{26}\{\text{product of lower one of values of } (\mathrm{Max}_{(p,q)-2})^{1/2} \text{ and } \mathrm{Min}_{(p,q)-2} \text{ and } \alpha_0\} \quad (2\text{-}6\text{-}2)$$

However, in the driving method according to the third embodiment or the like of the present invention, $\mathrm{Max}_{(p,q)-1}$ and $\mathrm{Min}_{(p,q)-1}$ of the expressions given hereinabove may be replaced with $\mathrm{Max}_{(p',q)-1}$ and $\mathrm{Min}_{(p',q)-1}$ respectively. Also, in the driving method according to the fourth and fifth embodiments or the like of the present invention, $\mathrm{Max}_{(p,q)-1}$ and $\mathrm{Min}_{(p,q)-1}$ of the expressions given hereinabove may be replaced with $\mathrm{Max}_{(p,q')}$ and $\mathrm{Min}_{(p,q')}$, respectively. Further, the control signal value, that is, the third subpixel control signal value $SG_{3-(p,q)}$ can be obtained by replacing "$SG_{1-(p,q)}$" on the left-hand side in the expressions (2-1-1), (2-2-1), (2-3-1), (2-4-1), (2-5-1) and (2-6-1) with "$SG_{3-(p,q)}$."

Further, in the driving method according to the second embodiment or the like to the fifth embodiment or the like of the present invention, where $C_{21}$, $C_{22}$ $C_{23}$, $C_{24}$ $C_{25}$ and $C_{26}$ are constants, the signal value $x_{4-(p,q)}$ is calculated by $$X_{4-(p,q)}=(C_{21}\cdot SG_{1-(p,q)}+C_{22}\cdot SG_{2-(p,q)})/(C_{21}+C_{22}) \quad (2\text{-}11)$$

or by $$X_{4-(p,q)}=C_{23}\cdot SG_{1-(p,q)}+C_{24}\cdot SG_{2-(p,q)} \quad (2\text{-}12)$$

or else by $$X_{4-(p,q)}=C_{25}(SG_{1-(p,q)}-SG_{2-(p,q)})+C_{26}\cdot SG_{2-(p,q)} \quad (2\text{-}13)$$

or can be calculated by root mean square, that is, $$X_{4-(p,q)}=[(SG_{1-(p,q)}^2+SG_{2-(p,q)}^2)/2]^{1/2} \quad (2\text{-}14)$$

However, in the driving method according to the third embodiment or the like of the present invention or the fifth embodiment or the like of the present invention, "$X_{4-(p,q)}$" of the expressions (2-11) to (2-14) given hereinabove may be replaced with "$X_{4-(p,q)-2}$."

One of the expressions described above may be selected depending upon the value of $SG_{1-(p,q)}$ or one of the expressions described above may be selected depending upon the value of $SG_{2-(p,q)}$. Or else, one of the expressions described above may be selected depending upon the values of $SG_{1-(p,q)}$ and $SG_{2-(p,q)}$. In other words, for each subpixel group, one of the expressions described above may be used fixedly to determine $X_{4-(p,q)}$ and $X_{4-(p,q)-2}$, or for each subpixel group, one of the expressions described above may be selectively used to determine $X_{4-(p,q)}$ and $X_{4-(p,q)-2}$.

In the driving method according to the second embodiment or the like of the present invention or in the driving method according to the third embodiment or the like of the present invention, when the number of pixels which configure each pixel group is represented by $p_0$, $p_0=2$. However, the pixel number is not limited to $p_0=2$ but may be $p_0\geq 3$.

Although, in the driving method for an image display apparatus according to the third embodiment or the like of the present invention, the adjacent pixel is disposed adjacent the (p,q)th second pixel along the first direction, also it is possible to adopt another configuration wherein the adjacent pixel is the (p,q)th first pixel or else the adjacent pixel is the (p+1,q)th first pixel.

In the driving method for an image display apparatus according to the third embodiment or the like of the present invention, also it is possible to adopt a different configuration wherein a first pixel and another first pixel are disposed adjacent each other along the second direction a second pixel and another second pixel are disposed adjacent each other or otherwise a first pixel and a second pixel are disposed adjacent each other along the second direction. Further, it is preferable that the first pixel includes a first subpixel for displaying a first primary color, a second subpixel for displaying a second primary color and a third subpixel for displaying a third primary color, successively arrayed in the first direction, and the second pixel includes a first subpixel for displaying the first primary color, a second subpixel for displaying the second primary color and a fourth subpixel for displaying a fourth color, successively arrayed in the first direction. In other words, it is preferable to dispose the fourth subpixel at a downstream end portion of the pixel group along the first direction. However, the arrangement is not limited to this. One of totaling 6×6=36 different combinations may be selected such as a configuration that the first pixel includes a first subpixel for displaying a first primary color, a third subpixel for displaying a third primary color and a second subpixel for displaying a second primary color, arrayed in the first direction, and the second pixel includes a first subpixel for displaying the first primary color, a fourth subpixel for displaying a fourth color and a second subpixel for displaying the second primary color, arrayed in the first direction. In particular, six combinations are available for an array in the first pixel, that is, for an array of the first subpixel, second subpixel and third subpixel, and six combinations are available for an array in the second pixel, that is, for an array of the first subpixel, second subpixel and fourth subpixel. Although the shape of each subpixel usually is a rectangular shape, preferably each subpixel is disposed such that the major side thereof extends in parallel to the second direction and the minor side thereof extends in parallel to the first direction.

In the driving method according to the forth embodiment or the like or the fifth embodiment or the like of the present invention, it is to be noted that the adjacent pixel positioned adjacent the (p,q)th pixel or the adjacent pixel positioned adjacent the (p,q)th second pixel may be the (p,q−1)th pixel, or may be a (p,q+1)th pixel or both of the (p,q−1)th pixel and the (p,q+1)th pixel.

In the driving methods according to the first embodiment or the like to the fifth embodiment or the like of the present invention, the expansion coefficient $\alpha_0$ may be determined for each one image display frame. Further, in the driving methods according to the first embodiment or the like to the fifth embodiment or the like of the present invention, in some cases, the luminance of the light source for illuminating the image display apparatus (planar light source apparatus for example) may be decreased based on the expansion coefficient $\alpha_0$.

Although the shape of each subpixel usually is a rectangular shape, preferably each subpixel is disposed such that the major side thereof extends in parallel to the second direction and the minor side thereof extends in parallel to the first direction. However, the shape of each subpixel is not limited to this.

A mode may be adopted wherein the plural pixels or pixel groups with regard to which the saturation S and the brightness V(S) are to be calculated may be all of the pixels or pixel groups. Or another mode may be adopted wherein the plural pixels or pixel groups with regard to which the saturation S and the brightness V(S) are to be calculated may be (1/N) of all of the pixels or pixel groups. It is to be noted that "N" is a natural number not smaller than 2. The particular value of N may be powers of 2 such as 2, 4, 8, 16, . . . . If the former mode is adopted, then the picture quality can be maintained good to the upmost without picture quality variation. On the other hand, if the latter mode is adopted, then improvement of the processing speed and simplification of the circuitry of the signal processing section can be anticipated.

Further, in the present invention including the preferred configurations and modes described above, the fourth color may be white. However, the fourth color is not limited to this. The fourth color may be some other color such as, for example, yellow, cyan or magenta. In those cases, where the image display apparatus is configured from a color liquid crystal display apparatus, it may further include a first color filter disposed between the first subpixels and an image observer for transmitting the first primary color therethrough, a second color filter disposed between the second subpixels and the image observer for transmitting the second primary color therethrough, and a third color filter disposed between the third subpixels and the image observer for transmitting the third primary color therethrough.

As a light source for configuring a planar light source apparatus, a light emitting element, particularly a light emitting diode (LED), can be used. A light emitting element formed from a light emitting diode has a comparatively small occupying volume, and it is suitable to dispose a plurality of light emitting elements. As the light emitting diode as a light emitting element, a white light emitting diode, for example, a light emitting diode configured from a combination of a purple or blue light emitting diode and light emitting particles so that white light is emitted.

Here, as the light emitting particles, red light emitting phosphor particles, green light emitting phosphor particles and blue light emitting phosphor particles can be used. As a material for configuring the red light emitting phosphor particles, $Y_2O_3$:Eu, $YVO_4$:Eu, Y(P, V)$O_4$:Eu, 3.5MgO.0.5$MgF_2$.$Ge_2$:Mn, $CaSiO_3$:Pb, Mn, $Mg_6AsO_{11}$:Mn, (Sr, Mg)$_3$($PO_4$)$_3$:Sn, $La_2O_2S$:Eu, $Y_2O_2S$:Eu, (ME:Eu)S (where "ME" signifies at least one kind of atom selected from a group including Ca, Sr and Ba, and this similarly applies also to the following description), $(M:Sm)_x(Si, Al)_{12}(O, N)_{16}$ (where "M" signifies at least one kind of atom selected from a group including Li, Mg and Ca, and this similarly applies also to the following description), $Me_2Si_5N_8$:Eu, (Ca:Eu)$SiN_2$, and (Ca:Eu)$AlSiN_3$ can be applied. Meanwhile, as a material for configuring the green light emitting phosphor particles, $LaPO_4$:Ce, Tb, $BaMgAl_{10}O_{17}$:Eu, Mn, $Zn_2SiO_4$:Mn, $MgAl_{11}O_{19}$:Ce, Tb, $Y_2SiO_5$:Ce, Tb, $MgAl_{11}O_{19}$:CE, Tb and Mn can be used. Further, (ME:Eu)$Ga_2S_4$, $(M:RE)_x(Si, Al)_{12}(O, N)_{16}$ (where "RE" signifies Tb and Yb), $(M:Tb)_x(Si, Al)_{12}(O, N)_{16}$, and $(M:Yb)_x(Si, Al)_{12}(O, N)_{16}$ can be used. Furthermore, as a material for configuring the blue light emitting phosphor particles, $BaMgAl_{10}O_{17}$:Eu, $BaMg_2Al_{16}O_{27}$:Eu $Sr_2P_2O_7$:Eu, $Sr_5(PO_4)_3$Cl:Eu, (Sr, Ca, Ba, Mg)$_5$($PO_4$)$_3$Cl:Eu, $CaWO_4$ and $CaWO_4$:Pb can be used. However, the light emitting particles are not limited to phosphor particles, and, for example, for a silicon type material of the indirect transition type, light emitting particles can be applied to which a quantum well structure such as a two-dimensional quantum well structure, a one-dimensional quantum well structure (quantum thin line) or zero-dimensional quantum well structure (quantum dot) which uses a quantum effect by localizing a wave function of carriers is applied in order to convert the carries into light efficiently like a material of the direct transition type. Or, it is known that rare earth atoms added to a semiconductor material emit light sharply by transition in a shell, and also light emitting particles which apply such a technique as just described can be used.

Or else, a light source for configuring a planar light source apparatus may be configured from a combination of a red light emitting element such as, for example, a light emitting diode for emitting light of red of a dominant emitted light wavelength of, for example, 640 nm, a green light emitting element such as, for example, a GaN-based light emitting diode for emitting light of green of a dominant emitted light wavelength of, for example, 530 nm, and a blue light emitting element such as, for example, a GaN-based light emitting diode for emitting light of blue of a dominant emitted light wavelength of, for example, 450 nm. The planer light source apparatus may include a light emitting element emits light of a fourth color or a fifth color other than red, green and blue.

The light emitting diode may have a face-up structure or a flip chip structure. In particular, the light emitting diode is configured from a substrate and a light emitting layer formed on the substrate and may be configured such that light is emitted to the outside from the light emitting layer or light from the light emitting layer is emitted to the outside through the substrate. More particularly, the light emitting diode (LED) has a laminate structure, for example, of a first compound semiconductor layer formed on a substrate and having a first conduction type such as, for example, the n type, an active layer formed on the first compound semiconductor layer, and a second compound semiconductor layer formed on the active layer and having a second conduction type such as, for example, the p type. The light emitting diode includes a first electrode electrically connected to the first compound semiconductor layer, and a second electrode electrically connected to the second compound semiconductor layer. The layers which configure the light emitting diode may be made of known compound semiconductor materials relying upon the emitted light wavelength.

The planar light source apparatus may be formed as any of two different types of planar light apparatus or backlights including a direct planar light source disclosed, for example, in Japanese Utility Model Laid-Open No. Sho 63-187120 or Japanese Patent Laid-Open No. 2002-277870 and an edge light type or side light type planar light source apparatus disclosed, for example, in Japanese Patent Laid-Open No. 2002-131552.

The direct planar light source apparatus can be configured such that a plurality of light emitting elements each serving as a light source are disposed and arrayed in a housing. However, the direct planar light source apparatus is not limited to this. Here, in the case where a plurality of red light emitting elements, a plurality of green light emitting elements and a plurality of blue light emitting elements are disposed and arrayed in a housing, the following array state of the light emitting elements is available. In particular, a plurality of light emitting element groups each including a red light emitting element, a green light emitting element and a blue light emitting element are disposed continuously in a horizontal direction of a screen of an image display panel such as, for example, a liquid crystal display apparatus to form a light emitting element group array. Further, a plurality of such light emitting element group arrays are juxtaposed continuously in a vertical direction of the screen of the image display panel. It is to be noted that the light emitting element group can be formed in several combinations including a combination of one red light emitting element, one green light emitting element and one blue light emitting element, another combination of one red light emitting element, two green light emitting elements and one blue light emitting element, a further combination of two red light emitting elements, two green light emitting elements and one blue light emitting element, and so forth. It is to be noted that, to each light emitting element, such a light extraction lens as disclosed, for example, in *Nikkei Electronics*, No. 889, Dec. 20, 2004, p. 128 may be attached.

Further, where the direct planar light source apparatus is configured from a plurality of planar light source units, one planer light source unit may be configured from one light emitting element group or from two or more light emitting element groups. Or else, one planar light source unit may be configured from a single white light emitting diode or from two or more white light emitting diodes.

In the case where a direct planar light source apparatus is configured from a plurality of planar light source units, a partition wall may be disposed between the planar light source units. As the material for configuring the partition wall, an impenetrable material by light emitted from a light emitting element provided in the planar light source unit particularly such as an acrylic-based resin, a polycarbonate resin or an ABS resin is applicable. Or, as a material penetrable by light emitted from a light emitting element provided in the planar light source unit, a polymethyl methacrylate resin (PMMA), a polycarbonate resin (PC), a polyarylate resin (PAR), a polyethylene terephthalate resin (PET) or glass can be used. A light diffusing reflecting function may be applied to the surface of the partition wall, or a mirror surface reflecting function may be applied. In order to apply the light diffusing reflecting function to the surface of the partition wall, concaves and convexes may be formed on the partition wall surface by sand blasting or a film having concaves and convexes, that is, a light diffusing film, may be adhered to the partition wall surface. In order to apply the mirror surface reflecting function to the partition wall surface, a light reflecting film may be adhered to the partition wall surface or a light reflecting layer may be formed on the partition wall surface, for example, by plating.

The direct planar light source apparatus can be configured including a light diffusing plate, an optical function sheet group including a light diffusing sheet, a prism sheet or a light polarization conversion sheet, and a light reflecting sheet. For the light diffusing plate, light diffusing sheet, prism sheet, light polarization conversion sheet and light reflecting sheet, known materials can be used widely. The optical function sheet group may be formed from various sheets disposed in a spaced relationship from each other or laminated in an integrated relationship with each other. For example, a light diffusing sheet, a prism sheet, a light polarization conversion sheet and so forth may be laminated in an integrated relationship with each other. The light diffusing plate and the optical function sheet group are disposed between the planar light source apparatus and the image display panel.

Meanwhile, in the edge light type planar light source apparatus, a light guide plate is disposed in an opposing relationship to an image display panel, particularly, for example, a liquid crystal display apparatus, and light emitting elements are disposed on a side face, a first side face hereinafter described, of the light guide plate. The light guide plate has a first face or bottom face, a second face or top face opposing to the first face, a first side face, a second side face, a third side face opposing to the first side face, and a fourth side face opposing to the second side face. As a more particular shape of the light guide plate, a generally wedge-shaped truncated quadrangular pyramid shape may be applied. In this instance, two opposing side faces of the truncated quadrangular pyramid correspond to the first and second faces, and the bottom face of the truncated quadrangular pyramid corresponds to the first side face. Preferably, convex portions and/or concave portions are provided on a surface portion of the first face or bottom face. Light is introduced into the light guide plate through the first side face and is emitted from the second face or top face toward the image display panel. The second face of the light guide plate may be in a smoothened state, or as a mirror surface, or may be provided with blast embosses which exhibit a light diffusing effect, that is, as a finely roughened face.

Preferably, convex portions and/or concave portions are provided on the first face or bottom face. In particular, it is preferable to provide the first face of the light guide plate with convex portions or concave portions or else with concave-convex portions. Where the concave-convex portions are provided, the concave portions and convex portions may be formed continuously or not continuously. The convex portions and/or the concave portions provided on the first face of the light guide plate may be configured as successive convex portions or concave portions extending in a direction inclined by a predetermined angle with respect to the incidence direction of light to the light guide plate. With the configuration just described, as a cross sectional shape of the successive convexes or concaves when the light guide plate is cut along a virtual plane extending in the incidence direction of light to the light guide plate and perpendicular to the first face, a triangular shape, an arbitrary quadrangular shape including a square shape, a rectangular shape and a trapezoidal shape, an arbitrary polygon, or an arbitrary smooth curve including a circular shape, an elliptic shape, a parabola, a hyperbola, a catenary and so forth can be applied. It is to be noted that the direction inclined by a predetermined angle with respect to the incidence direction of light to the light guide plate signifies a direction within a range from 60 to 120 degrees in the case where the incidence direction of light to the light guide plate is 0 degrees. This similarly applies also in the following description. Or the convex portions and/or the concave portions provided on the first face of the light guide plate may be configured as non-continuous convex portions and/or concave portions extending along a direction inclined by a predetermined angle with respect to the incidence direction of light to the light guide plate. In such a configuration as just described, as a shape of the non-continuous convexes or concaves, such various curved faces as a pyramid, a cone, a circular cylinder, a polygonal prism including a triangular prism and a quadrangular prism, part of a sphere, part of a spheroid, part of a paraboloid and part of a hyperboloid can be applied. It is to be noted that, as occasion demands, convex portions or concave portions may not be formed at peripheral edge portions of the first face of the light guide plate. Further, while light emitted from the light source and introduced into the light guide plate collides with and is diffused by the convex portions or the concave portions formed on the first face, the height or depth, pitch and shape of the convex portions or concave positions formed on the first face of the light guide plate may be fixed or may be varied as the distance from the light source increases. In the latter case, for example, the pitch of the convex portions or the concave portions may be made finer as the distance from the light source increases. Here, the pitch of the convex portions or the pitch of the concave portions signifies the pitch of the convex portions or the pitch of the concave potions along the incidence direction of light to the light guide plate.

In a planar light source apparatus which includes a light guide plate, preferably a light reflecting member is disposed in an opposing relationship to the first face of the light guide plate. An image display panel, particularly, for example, a liquid crystal display apparatus, is disposed in a opposing relationship to the second face of the light guide plate. Light emitted from the light source enters the light guide plate through the first side face which corresponds, for example, to the bottom face of the truncated quadrangular pyramid. Thereupon, the light collides with and is scattered by the convex portions or the concave portions of the first face and then goes out from the first face of the light guide plate, whereafter it is reflected by the light reflecting member and enters the light guide plate through the first face. Thereafter, the light emerges from the second face of the light guide plate and irradiates the image display panel. For example, a light diffusing sheet or a prism sheet may be disposed between the image display panel and the second face of the light guide plate. Or, light emitted from the light source may be introduced directly to the light guide plate or may be introduced indirectly to the light guide plate. In the latter case, for example, an optical fiber may be used.

Preferably, the light guide plate is produced from a material which does not absorb light emitted from the light source very much. In particular, as a material for configuring the light guide plate, for example, glass, a plastic material such as, for example, PMMA, a polycarbonate resin, an acrylic-based resin, an amorphous polypropylene-based resin and a styrene-based resin including an AS resin can be used.

In the present invention, the driving method and the driving conditions of a planar light source apparatus are not limited particularly, and the light sources may be controlled collectively. In particular, for example, a plurality of light emitting elements may be driven at the same time. Or, a plurality of light emitting elements may be driven partially or divisionally. In particular, where a planar light source apparatus is configured from a plurality of planar light source units, the planar light source apparatus may be configured from S×T planar light source units corresponding to S×T display region units when it is assumed that the display region of the image display panel is virtually divided into the S×T display region units. In this instance, the light emitting state of the S×T planar light source units may be controlled individually.

A driving circuit for a planar light source apparatus and an image display panel includes, for example, a planar light source apparatus control circuit configured form a light emitting diode (LED) driving circuit, a calculation circuit, a storage device or memory and so forth, and an image display panel driving circuit configured from a known circuit. It is to be noted that a temperature control circuit can be included in the planar light source apparatus control circuit. Control of the luminance of the display region, that is, the display luminance, and the luminance of the planar light source unit, that is, the light source luminance, is carried out for every one image display frame. It is to be noted that the number of image information to be sent for one second as an electric signal to the drive circuit, that is, the number of images per second, is a frame frequency or frame rate, and the reciprocal number of the frame frequency is frame time whose unit is second.

A liquid crystal display apparatus of the transmission type includes, for example, a front panel including a transparent first electrode, a rear panel including a transparent second electrode, and a liquid crystal material disposed between the front panel and the rear panel.

The front panel is configured more particularly from a first substrate formed, for example, from a glass substrate or a silicon substrate, a transparent first electrode also called common electrode provided on an inner face of the first substrate and made of, for example, ITO (indium tin oxide), and a polarizing film provided on an outer face of the first substrate. Further, the color liquid crystal display apparatus of the transmission type includes a color filter provided on the inner face of the first substrate and coated with an overcoat layer made of an acrylic resin or an epoxy resin. The front panel is further configured such that the transparent first electrode is formed on the overcoat layer. It is to be noted that an orientation film is formed on the transparent first electrode. Meanwhile, the rear panel is configured more particularly from a second substrate formed, for example, from a glass substrate or a silicon substrate, a switching element formed on an inner face of the second substrate, a transparent second electrode also called pixel electrode made of, for example, ITO and controlled between conduction and non-conduction by the switching element, and a polarizing film provided on an outer face of the second substrate. An orientation film is formed over an overall area including the transparent second electrode. Such various members and liquid crystal material which configure liquid crystal display apparatus including a color liquid crystal display apparatus of the transmission type may be configured using known members and materials. As the switching element, for example, such three-terminal elements as a MOS type (metal oxide semiconductor) FET or a thin film transistor (TFT) and two-terminal elements such as a MIM (metal-insulator-metal) element, a varistor element and a diode formed on a single crystal silicon semiconductor substrate can be used. As a disposition pattern of the color filters, for example, an array analogous to a delta array, an array analogous to a stripe array, an array analogous to a diagonal array or an array analogous to a rectangle array can be used.

In the case where the number of pixels arrayed in a two-dimensional matrix, $P_0 \times Q_0$, is represented as $(P_0, Q_0)$, as the value of $(P_0, Q_0)$, several resolutions for image display can be used. Particularly, VGA (640, 480), S-VGA (800, 600), XGA (1,024, 768), APRC (1,152, 900), S-XGA (1,280, 1,024), U-XGA (1,600, 1,200), HD-TV (1,920, 1,080) and Q-XGA (2,048, 1,536) as well as (1,920, 1,035), (720, 480) and (1,280, 960) are available. However, the number of pixels is not limited to those numbers. Further, as the relationship between the value of $(P_0, Q_0)$ and the value of (S, T), such relationships as listed in Table 1 below are available although the relationship is not limited to them. As the number of pixels for configuring one display region unit, 20×20 to 320×240, preferably 50×50 to 200×200, can be used. The numbers of pixels in different display region units may be equal to each other or may be different from each other.

TABLE 1

| | Value of S | Value of T |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

As an array state of the subpixels, for example, an array analogous to a delta array or triangle array, an array analogous to a stripe array, an array analogous to a diagonal array or mosaic array or an array analogous to a rectangle array can be used. Generally, an array analogous to a stripe array is suitable for display of data or a character string on a personal computer or the like. On the other hand, an array analogous to a mosaic array is suitable for display of a natural picture on a video camera recorder, a digital still camera or the like.

In the image display apparatus and driving method for the image display apparatus of the present invention, a color image display apparatus of the direct type or the projection type and a color image display apparatus of the field sequential type which may be the direct type or the projection type can be used as the image display apparatus. It is to be noted that the number of light emitting elements which configure the image display apparatus may be determined based on specifications required for the image display apparatus. Further, the image display apparatus may be configured including a light valve based on specifications required for the image display apparatus.

The image display apparatus is not limited to a color liquid crystal display apparatus but may be formed as an organic electroluminescence display apparatus, that is, an organic EL display apparatus, an inorganic electroluminescence display apparatus, that is, an inorganic EL display apparatus, a cold cathode field electron emission display apparatus (FED), a surface conduction type electron emission display apparatus (SED), a plasma display apparatus (PDP), a diffraction grating-light modulation apparatus including a diffraction grating-light modulation element (GLV), a digital micromirror device (DMD), a CRT or the like. Also the color liquid crystal display apparatus is not limited to a liquid crystal display apparatus of the transmission type but may be a liquid crystal display apparatus of the reflection type or a semi-transmission type liquid crystal display apparatus.

Working Example 1

The working example 1 relates to the driving method for an image display apparatus according to the first, sixth, 11th, 16th and 21st embodiments of the present invention and the driving method for an image display apparatus assembly according to the first, sixth, 11th, 16th and 21st embodiments of the present invention.

Referring to FIG. 1, the image display apparatus 10 of the working example 1 includes an image display panel 30 and a signal processing section 20. Further, the image display apparatus assembly of the working example 1 includes the image display apparatus 10, and a planar light source apparatus 50 for illuminating the image display apparatus 10, particularly the image display panel 30, from the rear face side. As shown in the conceptual diagrams of FIGS. 2A and 2B, the image display panel 30 includes $P_0 \times Q_0$ pixels arrayed in a two-dimensional matrix including $P_0$ pixels arrayed in the horizontal direction and $Q_0$ pixels arrayed in the vertical direction. Each pixel is composed of a first subpixel denoted by R for displaying a first primary color such as, for example, red, this similarly applies also to the various working examples hereinafter described, a second subpixel denoted by G for displaying a second primary color such as, for example, green, this similarly applies also to the various working examples hereinafter described, a third subpixel denoted by B for displaying a third primary color such as, for example, blue, this similarly applies also to the various working examples hereinafter described, and a fourth subpixel denoted by W for displaying a fourth color, specifically white, this similarly applies also to the various working examples hereinafter described.

The image display apparatus of the working example 1 is formed more particularly from a color liquid crystal display apparatus of the transmission type, and the image display panel 30 is formed from a color liquid crystal display panel. The image display panel 30 includes a first color filter disposed between the first subpixels R and an image observer for transmitting the first primary color therethrough, a second color filter disposed between the second subpixels G and the image observer for transmitting the second primary color therethrough, and a third color filter disposed between the third subpixels B and the image observer for transmitting the third primary color therethrough. It is to be noted that no color filter is provided for the fourth subpixels W. Here, the fourth subpixel W may be provided with a transparent resin layer in place of color filter. Consequently, it can be prevented that provision of no color filter gives rise to formation of a large offset on the fourth subpixels W. This similarly applies also to the various working examples hereinafter described.

Figure 2A:
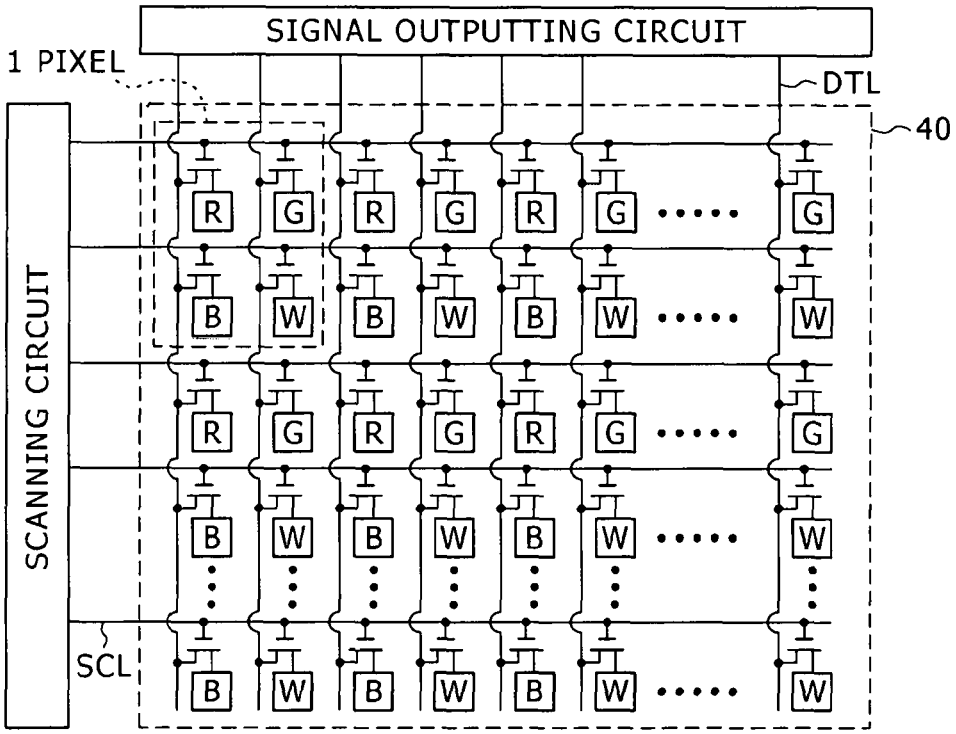
FIGS. 2A and 2B are circuit diagrams of the image display panel and an image display panel driving circuit of the image display apparatus of the working example 1.
Figure 2B:
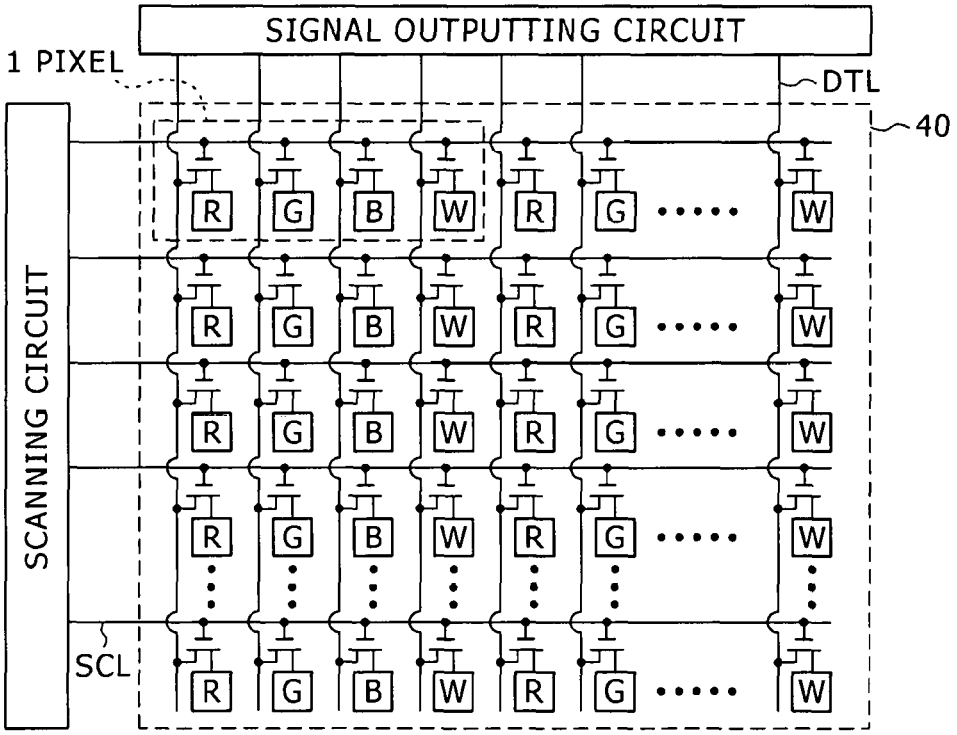

Further, in the working example 1, in the example shown in FIG. 2A, the first subpixels R, second subpixels G, third subpixels B and fourth subpixels W are arrayed in an array analogous to a diagonal array or mosaic array. On the other hand, in the example shown in FIG. 2B, the first subpixels R, second subpixels G, third subpixels B and fourth subpixels W are arrayed in another array which is analogous to a stripe array.

Referring back to FIGS. 2A and 2B, in the working example 1, the signal processing section 20 includes an image display panel driving circuit 40 for driving an image display panel, more particularly a color liquid crystal display panel, and a planar light source apparatus control circuit 60 for driving the planar light source apparatus 50. The image display panel driving circuit 40 includes a signal outputting circuit 41 and a scanning circuit 42. It is to be noted that a switching element such as, for example, a TFT (thin film transistor) for controlling operation, that is, the light transmission factor, of each subpixel of the image display panel 30 is controlled between on and off by the scanning circuit 42. Meanwhile, image signals are retained in the signal outputting circuit 41 and successively outputted to the image display panel 30. The signal outputting circuit 41 and the image display panel 30 are electrically connected to each other by wiring lines DTL, and the scanning circuit 42 and the image display panel 30 are electrically connected to each other by wiring lines SCL. This similarly applies also to the various working examples hereinafter described.

Here, to the signal processing section 20 in the working example 1, regarding a (p,q)th pixel (where $1 \le p \le P_0$, $1 \le q \le Q_0$), a first subpixel input signal having a signal value of $x_{1-(p,q)}$, a second subpixel input signal having a signal value of $x_{2-(p,q)}$ and a third subpixel input signal having a signal value of $x_{3-(p,q)}$ are inputted. The signal processing section 20 outputs, a first subpixel output signal having a signal value $X_{1-(p,q)}$ for determining a display gradation of a first subpixel R, a second subpixel output signal having a signal value $X_{2-(p,q)}$ for determining a display gradation of a second subpixel G, a third subpixel output signal having a signal value $X_{3-(p,q)}$ for determining a display gradation of a third subpixel B, and a fourth subpixel output signal having a signal value $X_{4-(p,q)}$ for determining a display gradation of a fourth subpixel W.

Then, in the working example 1 or the various working examples hereinafter described, the maximum value $V_{max}$ (S) of the brightness which includes, as a variable, the saturation S in the HSV color space expanded by addition of a fourth color such as white is stored into the signal processing section 20. In other words, as a result of the addition of the fourth color such as white, the dynamic range of the brightness in the HSV color space is expanded.

Further, the signal processing section 20 in the working example 1 calculates a first subpixel output signal, that is, a signal value $X_{1-(p,q)}$ based at least on a first subpixel input signal, that is, a signal value $x_{1-(p,q)}$ and the expansion coefficient $\alpha_0$, and outputs the calculated first subpixel output signal to the first subpixel R. Further, the signal processing section 20 calculates a second subpixel output signal, that is, a signal value $X_{2-(p,q)}$, based at least on a second subpixel input signal, that is, a signal value $x_{2-(p,q)}$ and the expansion coefficient $\alpha_0$, and outputs the calculated second subpixel output signal to the second subpixel G. The signal processing section 20 calculates a third subpixel output signal, that is, a signal value $X_{3-(p,q)}$, based at least on a third subpixel input signal, that is, a signal value $x_{3-(p,q)}$ and the expansion coefficient $\alpha_0$, and outputs the calculated third subpixel output signal to the third subpixel B. The signal processing section 20 calculates a fourth subpixel output signal, that is, a signal value $X_{4-(p,q)}$, based on a first subpixel input signal, that is, a signal value $x_{1-(p,q)}$, a second subpixel input signal, that is, a signal value $x_{2-(p,q)}$, and a third subpixel input signal, that is, a signal value $x_{3-(p,q)}$, and outputs the calculated fourth subpixel output signal to the fourth subpixel W.

Specifically, in the working example 1, the signal processing section 20 calculates a first subpixel output signal based at least on a first subpixel input signal and the expansion coefficient $\alpha_0$ as well as the fourth subpixel output signal, calculates a second subpixel output signal based at least on a second subpixel input signal and the expansion coefficient $\alpha_0$ as well as the fourth subpixel output signal, and calculates a third subpixel output signal based at least on a third subpixel input signal and the expansion coefficient $\alpha_0$ as well as the fourth subpixel output signal.

In other words, when $\chi$ is defined as a constant which relies upon the image display apparatus, the signal processing section 20 can calculate the first subpixel output signal value $X_{1-(p,q)}$, second subpixel output signal value $X_{2-(p,q)}$ and third subpixel output signal value $X_{3-(p,q)}$ to the (p,q)th pixel or the set of first, second and third subpixels from expressions given below.

$$X_{1-(p,q)}=\alpha_0 \cdot x_{1-(p,q)}-\chi \cdot X_{4-(p,q)} \tag{1-A}$$

$$X_{2-(p,q)}=\alpha_0 \cdot x_{2-(p,q)}-\chi \cdot X_{4-(p,q)} \tag{1-B}$$

$$X_{3-(p,q)}=\alpha_0 \cdot x_{3-(p,q)}-\chi \cdot X_{4-(p,q)} \tag{1-C}$$

In the working example 1, the signal processing section 20 further:

(a) carried out by the signal processing section, calculates a maximum value $V_{max}$(S) of brightness where a saturation S in an HSV (Hue, Saturation and Value) color space expanded by addition of the fourth color is used as a variable;

(b) carried out by the signal processing section, calculates a saturation S and brightness V(S) of a plurality of pixels based on the subpixel input signal values to the plural pixels; and (c) determines the expansion coefficient $\alpha_0$ so that the ratio of those pixels with regard to which the value of the expanded brightness calculated from the product of the brightness V(S) and the expansion coefficient $\alpha_0$ exceeds the maximum value $V_{max}$(S) to all pixels is equal to or lower than a predetermined value ($\beta_0$).

Here, the saturation S is represented by $$S=(\text{Max}-\text{Min})/\text{Max}$$

and the brightness V(S) is represented by $$V(S)=\text{Max}$$

It is to be noted that the saturation S can assume a value ranging from 0 to 1 and the brightness V(S) can assume a value from 0 to $2^n-1$ where n is a display gradation bit number. Further, Max is a maximum value among the three subpixel input signal values of the first subpixel input signal value, second subpixel input signal value and third subpixel input signal value to the pixel, and Min is a minimum value among the three subpixel input signal values of the first subpixel input signal value, second subpixel input signal value and third subpixel input signal value to the pixel. This similarly applies also in the following description.

In the working example 1, the signal value $x_{4-(p,q)}$ can be calculated based on the product of $\text{Min}_{(p,q)}$ and the expansion coefficient $\alpha_0$. In particular, the signal value $x_{4-(p,q)}$ can be calculated from the expression (1-1) given hereinabove, or more particularly from the expression $$X_{4-(p,q)}=\mathrm{Min}_{(p,q)}\cdot\alpha_0/\chi \quad (11)$$

It is to be noted that, while, in the expression (11), the product of $\mathrm{Min}_{(p,q)}$ and the expansion coefficient $\alpha_0$ is divided by $\chi$, the expression is not limited to this. Further, the expansion coefficient $\alpha_0$ is determined for every one image display frame.

The following description is given in this regard.

Figure 3A:
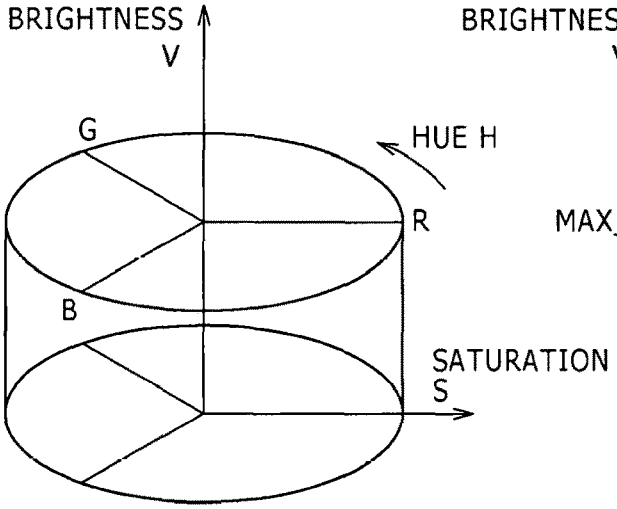
FIGS. 3A and 3B are diagrammatic views of a popular HSV (Hue, Saturation and Value) color space of a circular cylinder schematically illustrating a relationship between the saturation S and the brightness V(S)
Figure 3B:
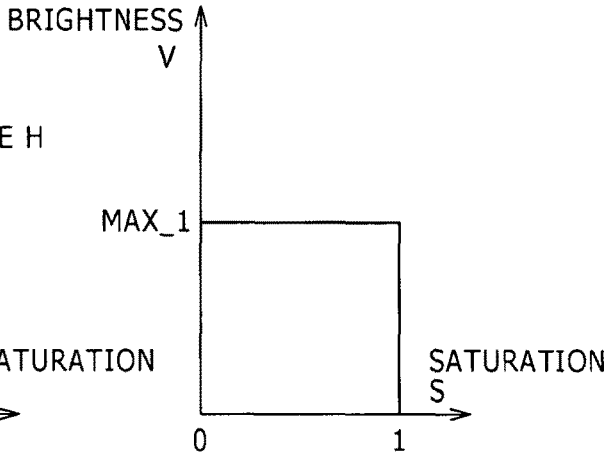

Generally, in the (p,q)th pixel, the saturation $S_{(p,q)}$ and the brightness $V(S)_{(p,q)}$ in the HSV color space of a circular cylinder can be calculated from the following expressions (12-1) and (12-2) based on the first subpixel input signal, that is, signal value $x_{1-(p,q)}$, second subpixel input signal, that is, signal value $x_{2-(p,q)}$ and third subpixel input signal, that is, signal value $x_{3-(p,q)}$. It is to be noted that the HSV color space of a circular cylinder is schematically illustrated in FIG. 3A, and a relationship between the saturation S and the brightness V(S) is schematically illustrated in FIG. 3B. It is to be noted that, in FIG. 3B and FIG. 3D and FIGS. 4A and 4B which will be described later, the value of the brightness $2^n-1$ is represented by "MAX_1," and the value of the brightness $(2^n-1)\times(\chi+1)$ is represented by "MAX_2."

$$S_{(p,q)}=\mathrm{Max}_{(p,q)}-\mathrm{Min}_{(p,q)})/\mathrm{Max}_{(p,q)} \quad (12\text{-}1)$$

$$V(S)_{(p,q)}=\mathrm{Max}_{(p,q)} \quad (12\text{-}2)$$

Here, $\mathrm{Max}_{(p,q)}$ is the highest value among the three subpixel input signal values of ($x_{1-(p,q)}$, $x_{2-(p,q)}$ and $x_{3-(p,q)}$), and $\mathrm{Min}_{(p,q)}$ is a minimum value of the three subpixel input signal values of ($x_{1-(p,q)}$, $x_{2-(p,q)}$ and $x_{3-(p,q)}$). In the working example 1, n is set to n=8. In other words, the display control bit number is 8 bits, and the value of the display gradation particularly ranges from 0 to 255. This similarly applies also to the working examples hereinafter described.

Figure 3C:
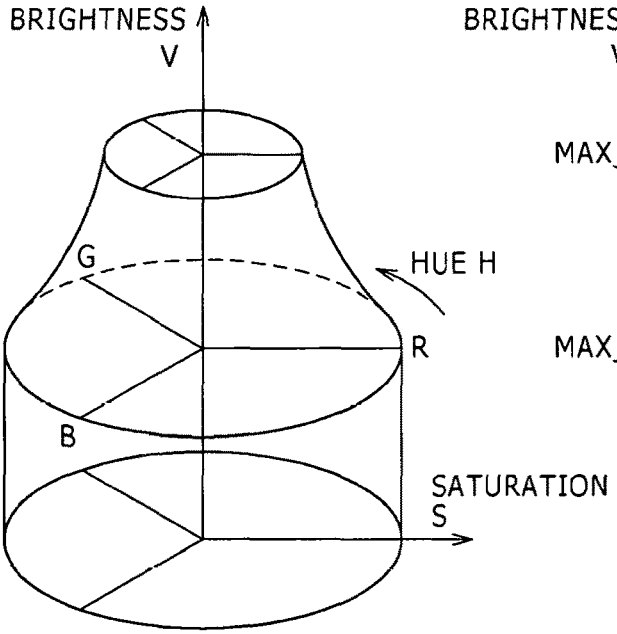
FIGS. 3C and 3D are diagrammatic views of an expanded HSV color space of a circular cylinder in the working example 1 of the present invention schematically illustrating a relationship between the saturation S and the brightness V(S)
Figure 3D:
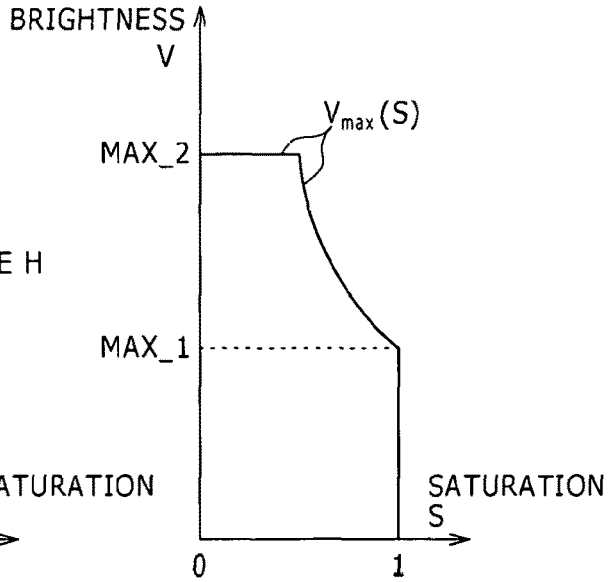

FIG. 3C illustrates the HSV color space of a circular cylinder expanded by addition of the fourth color or white in the working example 1, and FIG. 3D schematically illustrates a relationship between the saturation S and the brightness V(S). For the fourth subpixel W which displays white, no color filter is disposed. Here, it is assumed where the luminance of a set of the first subpixel R, second subpixel G and third subpixel B which configures a pixel (working examples 1 to 3 and 9) or a pixel group (working examples 4 to 8 and 10) when a signal having a value corresponding to a maximum signal value of the first subpixel output signal is inputted to the first subpixel R and a signal having a value corresponding to a maximum signal value of the second subpixel output signal is inputted to the second subpixel G and besides a signal having a value corresponding to a maximum signal value of the third subpixel output signal is inputted to the third subpixel B is represented by $BN_{1-3}$ and the luminance of the fourth subpixel W when a signal having a value corresponding to a maximum signal value of the fourth subpixel output signal is inputted to the fourth subpixel W which configures the pixel (working examples 1 to 3 and 9) or the pixel group (working examples 4 to 8 and 10) is represented by $BN_4$. In particular, white of a maximum luminance is displayed by the set of the first subpixel R, second subpixel G and third subpixel B, and this luminance of white is represented by $BN_{1-3}$. Therefore, where x is a constant which relies upon the image display apparatus, the constant $\chi$ is represented by $$\chi=BN_4/BN_{1-3}$$

In particular, the luminance $BN_4$ when it is assumed that an input signal having the value 255 of the display gradation is inputted to the fourth subpixel W is, for example, as high as 1.5 times the luminance $BN_{1-3}$ of white when input signals having values of the display gradation given as $$x_{1-(p,q)}=255$$

$$x_{2-(p,q)}=255$$

$$x_{3-(p,q)}=255$$

are inputted to the set of the first, second and third subpixels R, G and B. In particular, in the working example 1, $$\chi=1.5$$

Incidentally, $V_{max}(S)$ can be represented by the following expression when the signal value $X_{4-(p,q)}$ is given by the expression (11) described above.

In the case where $S\leq S_0$, $$V_{max}(S)=(\chi+1)*(2^n-1) \quad (13\text{-}1)$$

while, in the case where $S_0<S\leq 1$, $$V_{max}(S)=(2^n-1)\cdot(1/S) \quad (13\text{-}2)$$

where $$S_0=1/(\chi+1)$$

The maximum value $V_{max}(S)$ of the brightness obtained in this manner and using the saturation S in the HSV color space expanded by adding the fourth color as a variable is stored as a kind of lookup table into the signal processing section 20 or is calculated every time by the signal processing section 20.

In the following, a method of calculating (expansion process) the output signal values $X_{1-(p,q)}$, $X_{2-(p,q)}$, $X_{3-(p,q)}$ and $X_{4-(p,q)}$ of the (p,q)th pixel is described. It is to be noted that the following process is carried out so as to keep, the ratio among the luminance of the first primary color displayed by the (first subpixel R+fourth subpixel W), the luminance of the second primary color displayed by the (second subpixel G+fourth subpixel W) and the luminance of the third primary color displayed by the (third subpixel B+fourth subpixel W). Besides, the process is carried out so as to keep or maintain the color tone as far as possible. Furthermore, the process is carried out so as to keep or maintain the gradation-luminance characteristic, that is, the gamma characteristic or $\gamma$ characteristic).

Further, in the case where all of the input signal values in some pixel or pixel group are equal to "0" or very low, such pixels or pixel groups may be excluded to calculate the expansion coefficient $\alpha_0$. This similarly applies also to the working examples hereinafter described.

Step 100

First, the signal processing section 20 calculates the saturation S and the brightness V(S) of a plurality of pixels based on subpixel input signal values to the pixels. In particular, the signal processing section 20 calculates the saturations $S_{(p,q)}$ and $V(S)_{(p,q)}$ from the expressions (12-1) and (12-2), based on the input signal value $x_{1-(p,q)}$ of the first subpixel, input signal value $x_{2-(p,q)}$ of the second subpixel and input signal value $x_{3-(p,q)}$ of the third subpixel to the (p,q)th pixel. This process is carried out for all pixels.

Step 110

Then, the signal processing section 20 calculates the expansion coefficient $\alpha(S)$ based on $V_{max}(S)/V(S)$ calculated with regard to the pixels.

$$\alpha(S)=V_{max}(S)/V(S) \quad (14)$$

Then, the values of the expansion coefficient $\alpha(S)$ calculated with regard to the plural pixels, in the working example 1, with regard to all of the $P_0 \times Q_0$ pixels, are arranged in the ascending order, and the expansion coefficient $\alpha(S)$ corresponding to the position at the distance of $\beta_0 \times P_0 \times Q_0$ from the minimum value among the $P_0 \times Q_0$ values of the expansion coefficient $\alpha(S)$ is determined as the expansion coefficient $\alpha_0$. In this manner, the expansion coefficient $\alpha_0$ can be determined so that the ratio of those pixels with regard to which the value of the expanded brightness calculated from the product of the brightness V(S) and the expansion coefficient $\alpha_0$ exceeds the maximum value $V_{max}(S)$ to all pixels may be equal to or lower than a predetermined value, that is, $\beta_0$.

In the working example 1, $\beta_0$ may be set, for example, within a range from 0.003 to 0.05, that is, from 0.3 to 5%, and particularly, it is set to $\beta_0$=0.01. This value of $\beta_0$ was determined through various tests conducted actually.

In the case where the minimum value of $V_{max}(S)/V(S)$ is calculated as the expansion coefficient $\alpha_0$, the output signal value with respect to the input signal value does not exceed $2^8-1$. However, if the expansion coefficient $\alpha_0$ is determined not from the minimum value of $V_{max}(S)/V(S)$ but in such a manner as described above, then the brightness of the pixel whose expansion coefficient $\alpha(S)$ is lower than the expansion coefficient $\alpha_0$ is multiplied by the expansion coefficient $\alpha_0$, and the expanded value of the brightness exceeds the maximum value $V_{max}(S)$. As a result, disorder in gradation occurs. However, by setting the value of $\beta_0$, for example, within the range from 0.003 to 0.005, occurrence of such a phenomenon that an unnatural image with which "disorder in gradation" stood out was displayed was prevented successfully. On the other hand, it was confirmed that, when the value of $\beta_0$ exceeded 0.05, according to circumstances, an unnatural image with which disorder in gradation stood out was displayed. It is to be noted that, if the output signal value comes to exceed the upper limit value of $2^n-1$ as a result of the expansion process, then it should be set to the upper limit value of $2^n-1$.

Incidentally, many values of the expansion coefficient $\alpha(S)$ usually exceed 1.0 and gather around 1.0. Accordingly, if the minimum value of $V_{max}(S)/V(S)$ is calculated as the expansion coefficient $\alpha_0$, then the expansion degree of the output signal values is low and it often is difficult to achieve low power dissipation of an image display apparatus assembly. However, for example, by setting the value of $\beta_0$ within the range from 0.003 to 0.05, the value of the expansion coefficient $\alpha_0$ can be made high. Further, since this can be achieved by setting the luminance of the planar light source apparatus 50 to $1/\alpha_0$ time, reduction of the power consumption of the image display apparatus assembly can be anticipated.

Figure 4A:
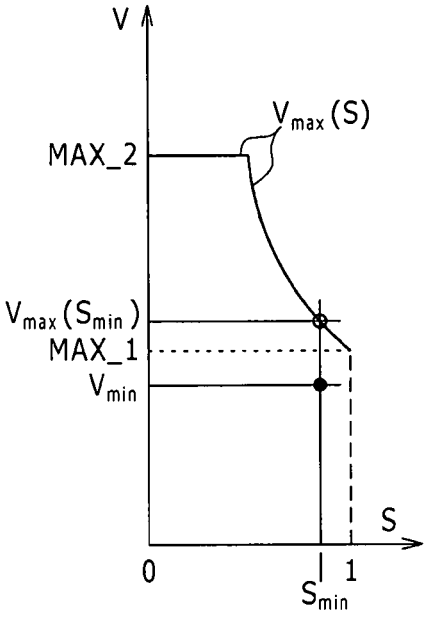
FIGS. 4A and 4B are diagrammatic views schematically illustrating a relationship of the saturation (S) and the brightness V(S) in an HSV color space of a circular cylinder expanded by adding a fourth color, which is white, in the working example 1.
Figure 4B:
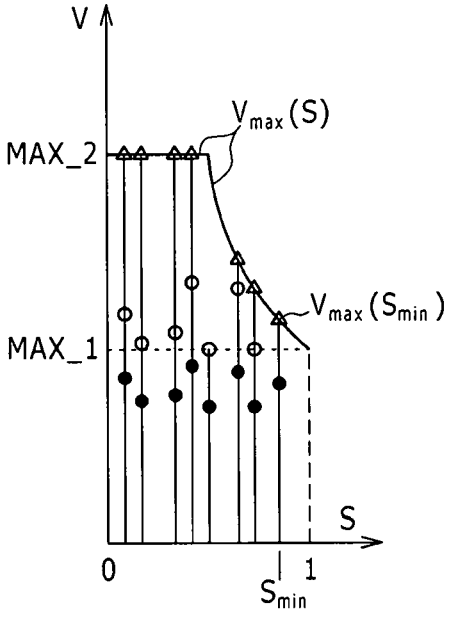

In FIGS. 4A and 4B which schematically illustrate a relationship between the saturation S and the brightness V(S) in the HSV color space of a circular cylinder expanded by the addition of the fourth color or white in the working example 1, the value of the saturation S at which $\alpha_0$ is provided is indicated by "S'," and the brightness V(S) at the saturation S' is indicated by "V(S')" while $V_{max}(S)$ is indicated by "$V_{max}(S')$." Further, in FIG. 4B, V(S) is indicated by a solid round mark and $V(S) \times \alpha_0$ is indicated by a blank round mark, and $V_{max}(S)$ of the saturation S is indicated by a blank triangular mark.

Step 120

Then, the signal processing section 20 calculates the signal value $X_{4-(p,q)}$ for the (p,q)th pixel based at least on the signal values $x_{1-(p,q)}$, $x_{2-(p,q)}$ and $x_{3-(p,q)}$. In particular, in the working example 1, the signal value $X_{4-(p,q)}$ is determined based on $Min_{(p,q)}$, the expansion coefficient $\alpha_0$ and the constant $\chi$. More particularly, in the working example 1, the signal value $X_{4-(p,q)}$ is calculated from $$X_{4-(p,q)} = Min_{(p,q)} \cdot \alpha_0 / \chi \tag{11}$$

as described hereinabove. It is to be noted that $X_{4-(p,q)}$ is calculated with regard to all of the $P_0 \times Q_0$ pixels.

Step 130

Thereafter, the signal processing section 20 calculates the signal value $X_{1-(p,q)}$ of the (p,q)th pixel based on the signal value $x_{1-(p,q)}$, expansion coefficient $\alpha_0$ and signal value $X_{4-(p,q)}$. Further, the signal processing section 20 calculates the signal value $X_{2-(p,q)}$ of the (p,q)th pixel based on the signal value $x_{2-(p,q)}$, expansion coefficient $\alpha_0$ and signal value $X_{4-(p,q)}$, and calculates the signal value $X_{3-(p,q)}$ of the (p,q)th pixel based on the signal value $x_{3-(p,q)}$, expansion coefficient $\alpha_0$ and signal value $X_{4-(p,q)}$. In particular, the signal processing section 20 calculates the signal values $X_{1-(p,q)}$, $X_{2-(p,q)}$ and $X_{3-(p,q)}$ of the (p,q)th pixel based on the following expressions as described above.

$$X_{1-(p,q)} = \alpha_0 \cdot x_{1-(p,q)} - \chi \cdot X_{4-(p,q)} \tag{1-A}$$

$$X_{2-(p,q)} = \alpha_0 \cdot x_{2-(p,q)} - \chi \cdot X_{4-(p,q)} \tag{1-B}$$

$$X_{3-(p,q)} = \alpha_0 \cdot x_{3-(p,q)} - \chi \cdot X_{4-(p,q)} \tag{1-C}$$

Figure 5:
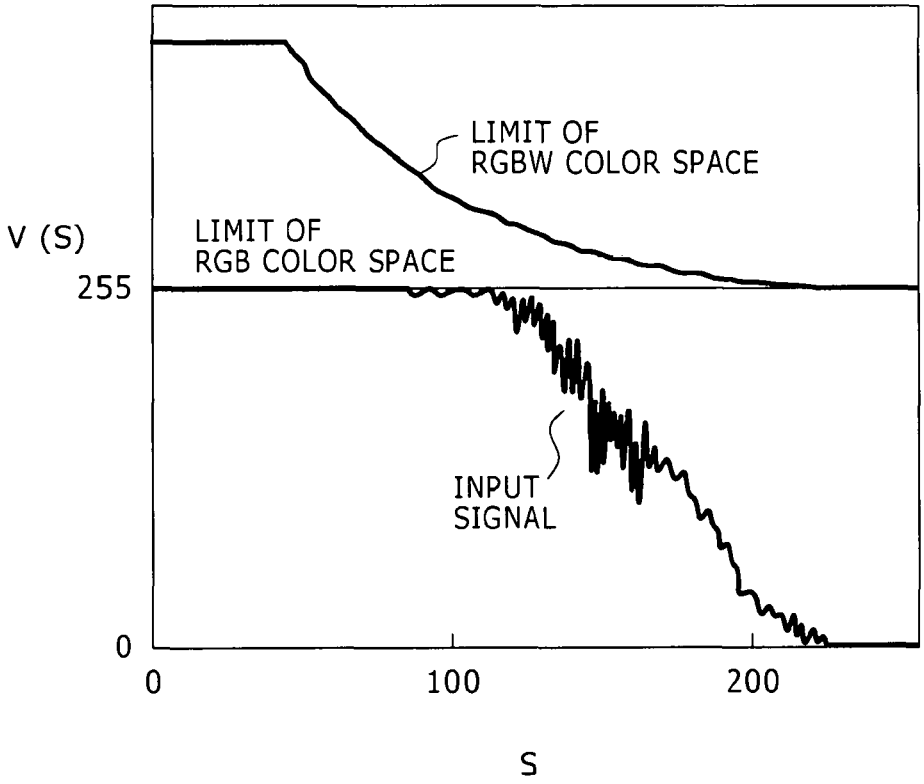
FIG. 5 is a view illustrating a HSV color space before the fourth color of white is added in the working example 1 in the past, an HSV color space expanded by addition of the fourth color of white and a relationship between the saturation (S) and the brightness (V) of an input signal.
Figure 6:
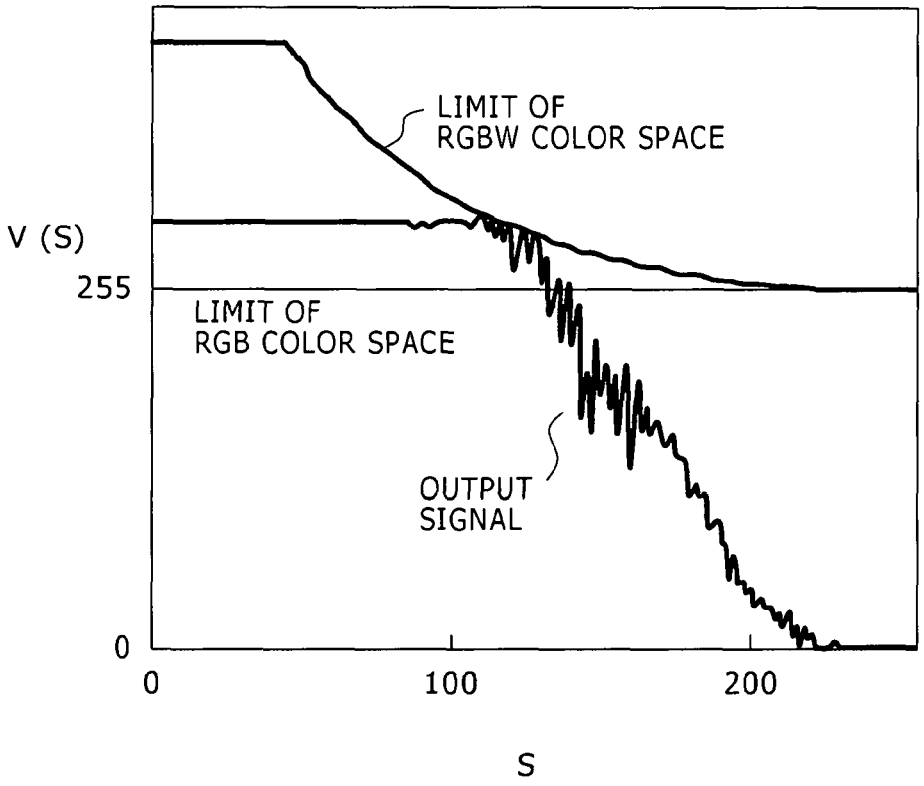
FIG. 6 is a view illustrating a HSV color space before the fourth color of white is added in the working example 1 in the past, an HSV color space expanded by addition of the fourth color of white and a relationship between the saturation S and the brightness V(S) of an output signal which is in an expansion process.

FIG. 5 illustrates an example of an HSV color space of related arts before the fourth color or white is added in the working example 1, an HSV color space expanded by addition of the fourth color or white and a relationship of the saturation S and the brightness V(S) of an input signal. Further, FIG. 6 illustrates an example of the HSV color space of related arts before the fourth color or white is added in the working example 1, the HSV color space expanded by addition of the fourth color or white and a relationship of the saturation S and the brightness V(S) of an output signal in a state in which an expansion process is applied. It is to be noted that, although the value of the saturation S on the axis of abscissa in FIGS. 5 and 6 originally remains within the range from 0 to 1, in FIGS. 5 and 6, they are indicated in a form multiplied by 255.

What is significant here resides in that the value of $Min_{(p,q)}$ is expanded by $\alpha_0$ as indicated by the expression (11). Since the value of $Min_{(p,q)}$ is expanded by $\alpha_0$ in this manner, not only the luminance of the white display subpixel, that is, the fourth subpixel W, increases, but also the luminance of the red display subpixel, green display subpixel and blue display subpixel, that is, of the first, second and third subpixels R,G and B, increases as shown in the expressions (1-A), (1-B) and (1-C). Therefore, occurrence of such a problem that darkening in color occurs can be prevented with certainty. In particular, by expanding the value of $Min_{(p,q)}$ by $\alpha_0$, the luminance of an entire image increases to $\alpha_0$ times in comparison with the alternative case in which the value of $Min_{(p,q)}$ is not expanded. Accordingly, for example, image display of a still picture or the like can be carried out with a high luminance favorably.

In the case where $\chi$=1.5 and $2^n-1$=255, when values indicated in Table 2 given below are inputted as input signal values for $x_{1-(p,q)}$, $x_{2-(p,q)}$ and $x_{3-(p,q)}$, output signal values ($X_{1-(p,q)}$, $X_{2-(p,q)}$, $X_{3-(p,q)}$ and $X_{4-(p,q)}$ are shown in Table 2. It is to be noted that $\alpha_0$ is set to $\alpha_0$=1.467.

TABLE 2

| No | $x_1$ | $x_2$ | $x_3$ | Max | Min | S | V | $V_{max}$ | $\alpha = V_{max}/V$ |
|---|---|---|---|---|---|---|---|---|---|
| 1 | 240 | 255 | 160 | 255 | 160 | 0.373 | 255 | 638 | 2.502 |
| 2 | 240 | 160 | 160 | 240 | 160 | 0.333 | 240 | 638 | 2.658 |
| 3 | 240 | 80 | 160 | 240 | 80 | 0.667 | 240 | 382 | 1.592 |
| 4 | 240 | 100 | 200 | 240 | 100 | 0.583 | 240 | 437 | 1.821 |
| 5 | 255 | 81 | 160 | 255 | 81 | 0.682 | 255 | 374 | 1.487 |

| No | $X_4$ | $X_1$ | $X_2$ | $X_3$ |
|---|---|---|---|---|
| 1 | 156 | 118 | 140 | 0 |
| 2 | 156 | 118 | 0 | 0 |
| 3 | 78 | 235 | 0 | 118 |
| 4 | 98 | 205 | 0 | 146 |
| 5 | 79 | 255 | 0 | 116 |

For example, according to the input signal values of No. 1 indicated in Table 2, in the case where the expansion coefficient $\alpha_0$ is taken into consideration, the values of the luminance to be displayed based on the input signal values $(x_{1-(p,q)}, x_{2-(p,q)}, x_{3-(p,q)})$=(240, 255, 160) become, in compliance with 8-bit display, luminance value of first subpixel $R$=
$\alpha_0 \cdot x_{1-(p,q)}$=1.467×240=352 luminance value of second subpixel $G$=
$\alpha_0 \cdot x_{2-(p,q)}$=1.467×255=374 luminance value of third subpixel $B$=
$\alpha_0 \cdot x_{3-(p,q)}$=1.467×160=234

On the other hand, the calculated value of the output signal value $X_{4-(p,q)}$ of the fourth subpixel W is 156 from the expression (11). Accordingly, luminance value of fourth subpixel $W$=
$\chi \cdot X_{4-(p,q)}$=1.5×156=234

Accordingly, the first subpixel output signal value $X_{1-(p,q)}$, second subpixel output signal value $X_{2-(p,q)}$ and third subpixel output signal value $X_{3-(p,q)}$ become such as given below.

$$X_{1-(p,q)}=352-234=118$$

$$X_{2-(p,q)}=374-234=140$$

$$X_{3-(p,q)}=234-234=0$$

In this manner, in the pixel to which the input signal values indicated in No. 1 in Table 2 are inputted, the output signal value to the subpixel having the lowest input signal value, in this instance, the third subpixel B, becomes 0, and the display of the third subpixel B is substituted by the fourth subpixel W. Further, the output signal values $x_{1-(p,q)}$, $X_{2-(p,q)}$ and $X_{3-(p,q)}$ of the first, second and third subpixels R, G and B become lower than the values required originally.

In the image display apparatus assembly or the driving method for an image display apparatus assembly of the working example 1, the signal values $X_{1-(p,q)}$, $X_{2-(p,q)}$, $X_{3-(p,q)}$ and $X_{4-(p,q)}$ of the (p,q)th pixel are expanded to $\alpha_0$ times. Therefore, in order to obtain a luminance of an image equal to the luminance of an image in a non-expanded state, the luminance of the planar light source apparatus 50 should be reduced based on the expansion coefficient $\alpha_0$. In particular, the luminance of the planar light source apparatus 50 should be set to $1/\alpha_0$ time. By this, reduction of the power consumption of the planar light source apparatus can be anticipated.

Figure 7A:
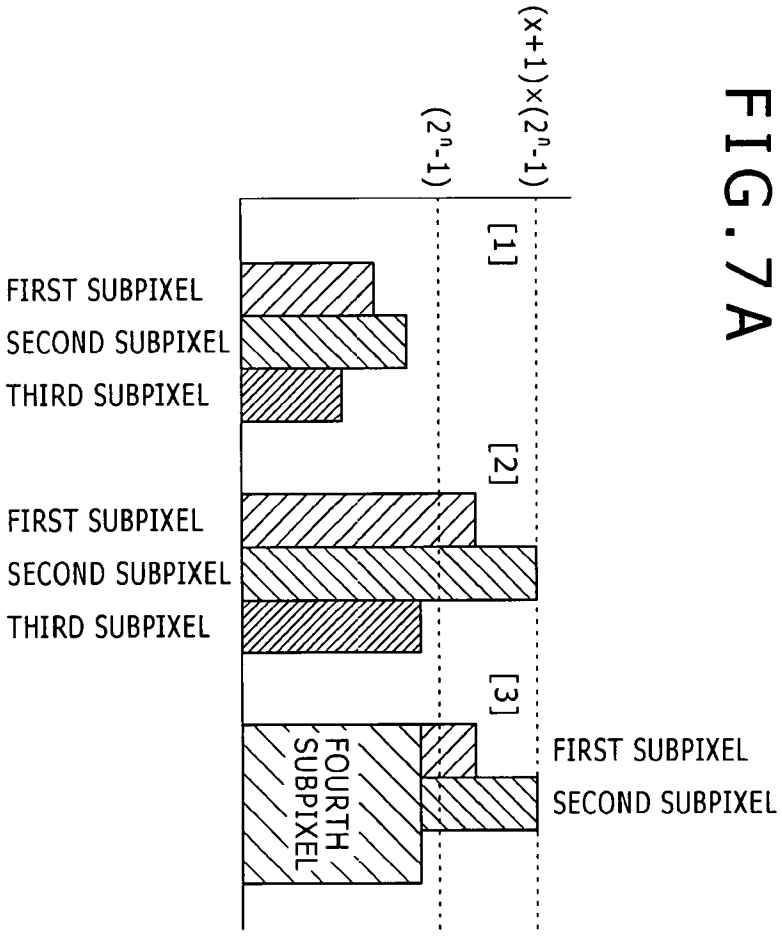
FIGS. 7A and 7B diagrammatically illustrate input signal values and output signal values for explaining differences between the expansion process in the driving method for an image display apparatus and the driving method for an image display apparatus assembly of the working example 1 and the processing method disclosed in Patent Document 2 described hereinabove, respectively.
Figure 7B:
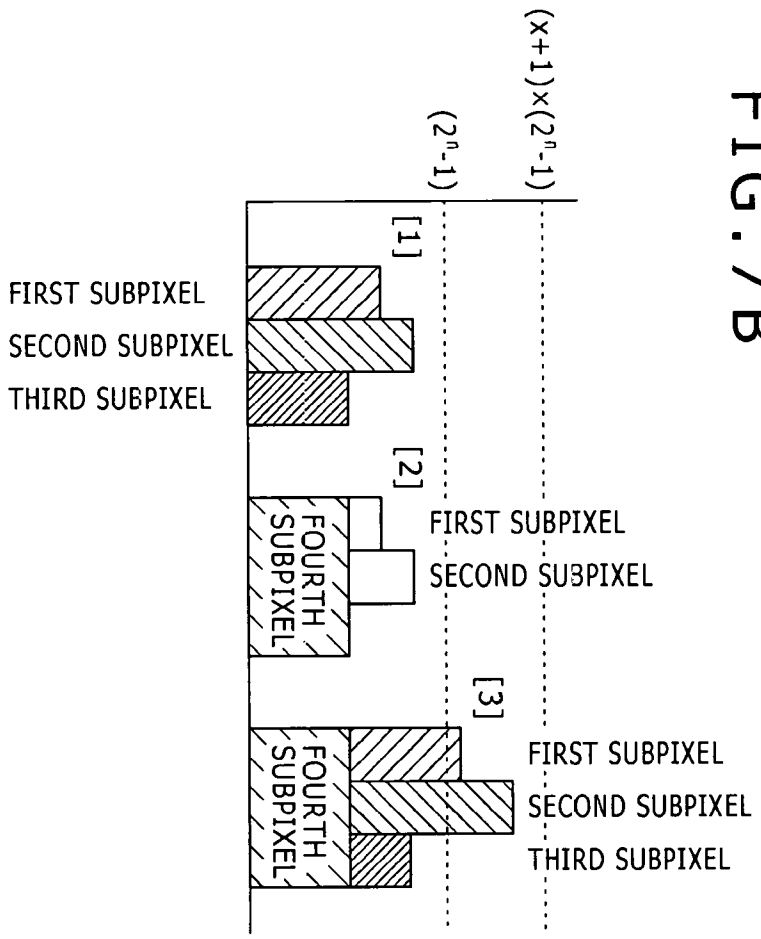

Here, differences between the expansion process in the driving method for an image display apparatus and the driving method for an image display apparatus assembly of the working example 1 and the processing method disclosed in Patent Document 2 described hereinabove are described with reference to FIGS. 7A and 7B. FIGS. 7A and 7B diagrammatically illustrate input signal values and output signal values in the driving method for an image display apparatus and the driving method for an image display apparatus assembly of the working example 1 and the processing method disclosed in Patent Document 2, respectively. In the example illustrated in FIG. 7A, the input signal values to a set of a first subpixel R, a second subpixel G and a third subpixel B are illustrated in [1]. Meanwhile, the input signal values for which an expansion process, that is, an operation for calculating the products of the input signal values and the expansion coefficient $\alpha_0$, is being carried out are illustrated in [2]. Further, the input signal values after the expansion process is carried out, that is, resulting output signal values $X_{1-(p,q)}$, $X_{2-(p,q)}$, $X_{3-(p,q)}$, and $X_{4-(p,q)}$ are illustrated in [3]. Meanwhile, input signal values to a set of a first subpixel R, a second subpixel G and a third subpixel B in the processing method disclosed in Patent Document 2 are illustrated in [4] of FIG. 7B. It is to be noted that the input signal values illustrated are same as those illustrated in [1] of FIG. 7A. Meanwhile, digital values Ri, Gi and Bi of the red inputting subpixel, green inputting subpixel and blue inputting subpixel and a digital value W for driving the luminance subpixel are illustrated in [5] of FIG. 7B. Furthermore, a result when values of Ro, Go and Bo as well as W are calculated is illustrated in [6]. From FIGS. 7A and 7B, in the driving method for an image display apparatus and the driving method for an image display apparatus assembly of the working example 1, a maximum luminance which can be implemented is obtained with the second subpixel G. On the other hand, in the processing method disclosed in Patent Document 2, it can be recognized that a maximum luminance which can be implemented is not reached with the second subpixel G. In this manner, image display of a high luminance can be implemented by the driving method for an image display apparatus and the driving method for an image display apparatus assembly of the working example 1 in comparison with the processing method disclosed in Patent Document 2.

It is to be noted that it was found that, even if the value of $\beta_0$ exceeded 0.05, in the case where the value of the expansion coefficient $\alpha_0$ was low, an image with which disorder in gradation did not stand out and which was not unnatural was sometimes displayed. In particular, it was found that, even if such a value as given by $$\alpha_0 = BN_4/BN_{1-3} + 1 \quad (15\text{-}1)$$

$$= \chi + 1 \quad (15\text{-}2)$$

was adopted alternatively as the value of $\alpha_0$, there were instances in which disorder in gradation did not stand out and an unnatural image was not obtained, and besides, reduction in power consumption of the image display apparatus assembly was achieved successfully.

However, in the case where $$\alpha_0=\chi+1 \quad (15\text{-}2)$$

if the ratio β" of those pixels with regard to which the value of the expanded brightness calculated from the product of the brightness V(S) and the expansion coefficient $\alpha_0$ exceeds the maximum value $V_{max}(S)$ to all pixels is considerably higher than the predetermined value $\beta_0$, for example, if $\beta''=0.07$, then it is desirable to adopt a configuration for retuning the expansion coefficient to $\alpha_0$ determined at step 110.

Further, through various tests, it was found that, in the case where much yellow was included in an image, if the expansion coefficient $\alpha_0$ exceeded 1.3, then an unnatural image was obtained because yellow is darkened. Therefore, when various tests were conducted, a result was obtained that, when it was assumed that a color defined by (R, G, B) was displayed by a pixel, if the expansion coefficient $\alpha_0$ was set to a value equal to or lower than a predetermined value $\alpha'_0$, particularly to a value equal to or lower than 1.3 when the ratio of those pixels with regard to which the hue H and the saturation S in the HSV color space fell in ranges defined respectively by the following expressions $$40 \leq H \leq 65 \quad (16\text{-}1)$$

$$0.5 \leq S < 1.0 \quad (16\text{-}2)$$

to all pixels exceeded the predetermined value $\beta'_0$, for example, particularly 2%, that is, when much yellow was included in the image, then darkening in yellow disappeared and no unnatural color image was obtained. Further, reduction of the power consumption of the entire image display apparatus assembly in which the image display apparatus was incorporated was achieved successfully.

Here, when the value of R in (R, G, B) is in the maximum, $$H=60(G-B)/(\text{Max}-\text{Min}) \quad (16\text{-}3)$$

but when the value of G is in the maximum, $$H=60(B-R)/(\text{Max}-\text{Min})+120 \quad (16\text{-}4)$$

whereas, when the value of B is in the maximum, $$H=60(R-G)/(\text{Max}-\text{Min})+240 \quad (16\text{-}5)$$

It is to be noted that the decision of whether or not much yellow is mixed in the color in image may not be based on $$40 \leq H \leq 65 \quad (16\text{-}1)$$

$$0.5 \leq S \leq 1.0 \quad (16\text{-}2)$$

Instead, the following decision may be used. In particular, it is assumed that a color defined by (R, G, B) is displayed by a pixel, and when the ratio of those pixels with regard to which (R, G, B) satisfy the following expressions (17-1) to (17-6) to all pixels exceeds a predetermined value $\beta'_0$, for example, particularly 2%, the expansion coefficient $\alpha_0$ is set to a value equal to or lower than a predetermined value $\alpha'_0$, for example, particularly to a value equal to or lower than 1.3.

Here, in the case where the value of R among (R, G, B) exhibits a maximum value and the value of B exhibits a minimum value, $$R \geq 0.78 \times (2^n-1) \quad (17\text{-}1)$$

$$G \geq (2R/3)+(B/3) \quad (17\text{-}2)$$

$$B \leq 0.50R \quad (17\text{-}3)$$

are satisfied, but in the case where the value of G among (R, G, B) exhibits a maximum value and the value of B exhibits a minimum value, $$R \geq (4B/60)+(56G/60) \quad (17\text{-}4)$$

$$G \geq 0.78 \times (2^n-1) \quad (17\text{-}5)$$

$$B \leq 0.50R \quad (17\text{-}6)$$

are satisfied. In the expressions, n is a display gradation bit number.

By using the expressions (17-1) to (17-6) in this manner, whether or not an image includes much yellow mixed in the color thereof can be discriminated through a comparatively small amount of calculation, and the circuit scale of the signal processing section 20 can be reduced and reduction in calculation time can be anticipated. However, coefficients and values in the expressions (17-1) to (17-6) are not limited to these numbers. Further, in the case where the data bit number of (R, G, B) is great, the decision can be made through a comparatively small amount of calculation by using only high-order bits, and further reduction of the circuit scale of the signal processing section 20 can be anticipated. In particular, in the case where, for example, R=52621 in 16-bit data, if the eight high-order bits are used, then R=205.

Or, if another representation is used, then when the ratio of those pixels which display yellow to all pixels exceeds a predetermined value $\beta'_0$, for example, particularly 2%, the expansion coefficient $\alpha_0$ is set to a value equal to or lower than a predetermined value, for example, to a value equal to or lower than 1.3.

It is to be noted that the range of the value of $\beta_0$ in the driving method for an image display apparatus according to the first embodiment of the present invention described hereinabove in connection with the working example 1, the requirements in the expressions (15-1) and (15-2) in the driving method for an image display apparatus according to the sixth embodiment of the present invention, in the expressions (16-1) or (16-5) in the driving method for an image display apparatus according to the 11th embodiment of the present invention, in the expressions (17-1) or (17-6) in the driving method for an image display apparatus according to the 16th embodiment of the present invention or in the driving method for an image display apparatus according to the 21st embodiment of the present invention can be applied also to the working examples described below. Accordingly, in the working examples described below, description of them is omitted to avoid redundancy, but description only of subpixels which configure pixels, a relationship between input signals and output signals to subpixels and so forth is given below.

Working Example 2

Figure 10:
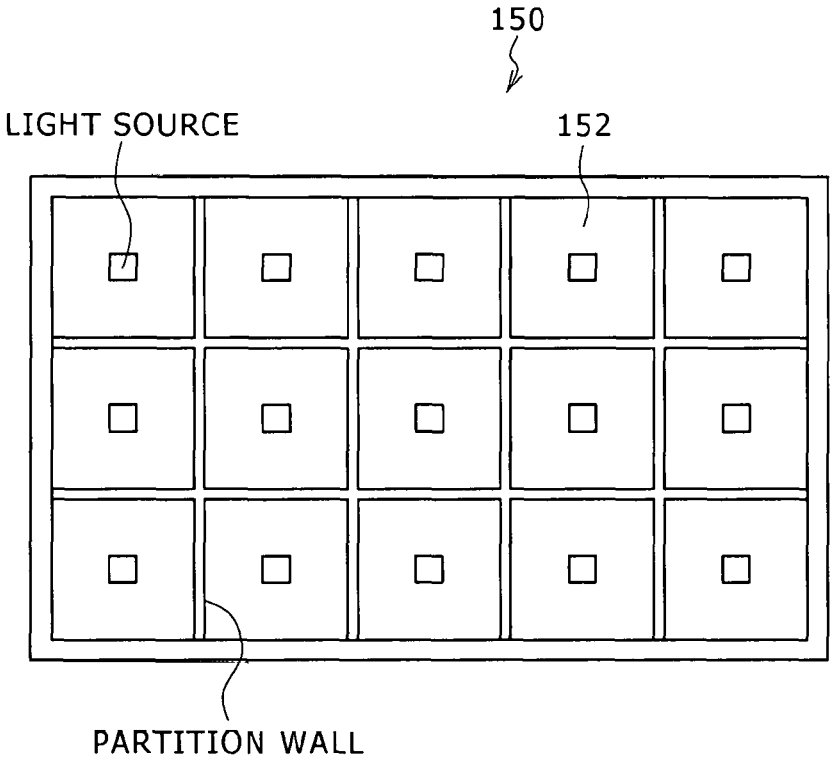
FIG. 10 is a view schematically illustrating an arrangement and array state of planar light source units and so forth of the planar light source apparatus of the image display apparatus assembly of the working example 2.

The working example 2 is a modification to the working example 1. For the planar light source apparatus, although a planar light source apparatus of the direct type in related arts may be adopted, in the working example 2, a planar light source apparatus 150 of the divisional driving type, that is, of the partial driving type, described hereinbelow is adopted as shown in FIG. 10. It is to be noted that the expansion process itself may be similar to that described hereinabove in connection with the working example 2.

Figure 8:
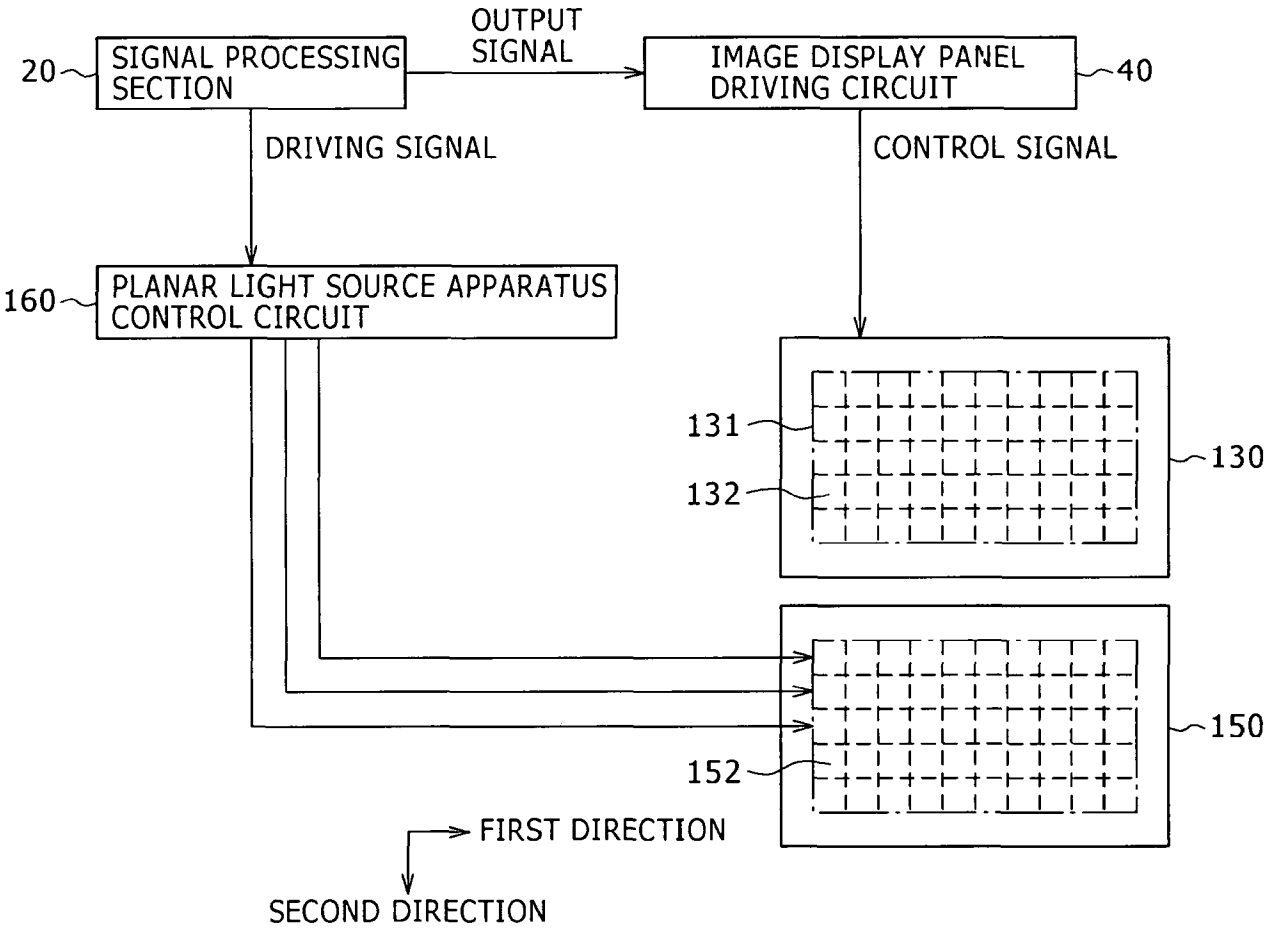
FIG. 8 is a block diagram of an image display panel and a planar light source apparatus which configure an image display apparatus assembly according to a working example 2 of the present invention.
Figure 9:
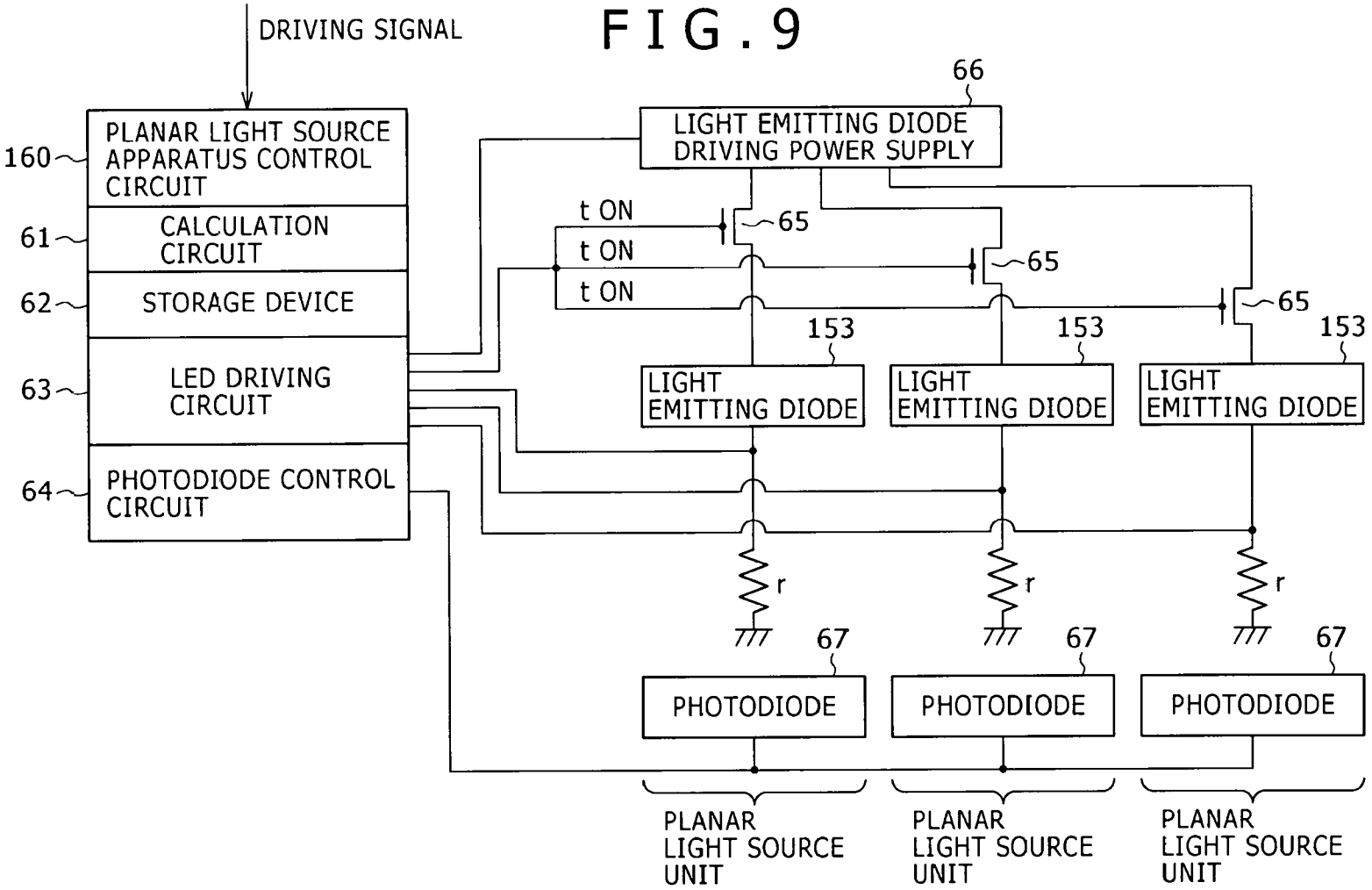
FIG. 9 is a block circuit diagram of a planar light source apparatus control circuit of the planar light source apparatus of the image display apparatus assembly of the working example 2.

A block diagram of an image display panel and a planar light source apparatus which configure an image display apparatus assembly according to a working example 2 is shown in FIG. 8, a block circuit diagram of a planar light source apparatus control circuit of the planar light source apparatus of the image display apparatus assembly of the working example 2 is shown in FIG. 9, and a view schematically illustrating an arrangement and array state of planar light source units and so forth of the planar light source apparatus of the image display apparatus assembly is shown in FIG. 10.

The planar light source apparatus 150 of the divisional driving type is formed from S×T planar light source units 152 which correspond, in the case where it is assumed that a display region 131 of an image display panel 130 which configures a color liquid crystal display apparatus is divided into S×T virtual display region units 132, to the S×T display region units 132. The light emission state of the S×T planar light source units 152 is controlled individually.

Referring to FIG. 8, the image display panel 130 which is a color liquid crystal display panel includes the display region 131 in which totaling P×Q pixels are arrayed in a two-dimensional matrix including P pixels disposed along the first direction and Q pixels disposed along the second direction. Here, it is assumed that the display region 131 is divided into S×T virtual display region units 132. Each of the display region units 132 includes a plurality of pixels. In particular, if the image displaying resolution satisfies the HD-TV standard and the number of pixels P×Q arrayed in a two-dimensional matrix is represented by (P, Q), then the number of pixels is (1920, 1080). Further, the display region 131 configured from pixels arrayed in a two-dimensional matrix and indicated by an alternate long and short dash line in FIG. 8 is divided into S×T virtual display region units 132 boundaries between which are indicated by broken lines. The value of (S, T) is, for example, (19, 12). However, for simplified illustration, the number of display region units 132, and also of planar light source units 152 hereinafter described, in FIG. 8 is different from this value. Each of the display region units 132 includes a plurality of pixels, and the number of pixels which configure one display region unit 132 is, for example, approximately 10,000. Usually, the image display panel 130 is line-sequentially driven. More particularly, the image display panel 130 has scanning electrodes extending along the first direction and data electrodes extending along the second direction such that they cross with each other like a matrix. A scanning signal is inputted from a scanning circuit to the scanning electrodes to select and scan the scanning electrodes while data signals or output signals are inputted to the data electrodes from a signal outputting circuit so that the image display panel 130 displays an image based on the data signal to form a screen image.

The planar light source apparatus or backlight 150 of the direct type includes S×T planar light source units 152 corresponding to the S×T virtual display region unit 132, and the planar light source units 152 illuminate the display region units 132 corresponding thereto from the rear side. Light sources provided in the planar light source units 152 are controlled individually. It is to be noted that, while the planar light source apparatus 150 is positioned below the image display panel 130, in FIG. 8, the image display panel 130 and the planar light source apparatus 150 are shown separately from each other.

While the display region 131 configured from pixels arrayed in a two-dimensional matrix is divided in to the S×T display region units 132, this state can be regarded such that, if it is represented with "row" and "column," then it is considered that the display region 131 is divided into the display region units 132 disposed in T rows×S columns. Further, although the display region unit 132 is configured from a plurality of ($M_0$×$N_0$) pixels, if this state is represented with "row" and "column," then it is considered that the display region unit 132 is configured from the pixels disposed in $N_0$ rows×$M_0$ columns.

A disposition array state of the planar light source units 152 and so forth of the planar light source apparatus 150 is illustrated in FIG. 10. Each light source is formed from a light emitting diode 153 which is driven based on a pulse width modulation (PWM) controlling method. Increase or decrease of the luminance of the planar light source unit 152 is carried out by increasing or decreasing control of the duty ratio in pulse width modulation control of the light emitting diode 153 which constitutes the planar light source unit 152. Illuminating light emitted from the light emitting diode 153 goes out from the planar light source unit 152 through a light diffusion plate and successively passes through an optical functioning sheet group including a light diffusion sheet, a prism sheet and a polarized light conversion sheet (all not shown) until it illuminates the image display panel 130 from the rear side. One light sensor which is a photodiode 67 is disposed in each planar light source unit 152. The photodiode 67 measures the luminance and the chromaticity of the light emitting diode 153.

Referring to FIGS. 8 and 9, a planar light source apparatus control circuit 160 for driving the planar light source units 152 based on a planar light source apparatus control signal or driving signal from the signal processing section 20 carries out on/off control of the light emitting diode 153 which configures each planar light source unit 152. The planar light source apparatus control circuit 160 includes a calculation circuit 61, a storage device or memory 62, an LED driving circuit 63, a photodiode control circuit 64, a switching element 65 formed from an FET, and a light emitting diode driving power supply 66 which is a constant current source. The circuit elements which configure the planar light source apparatus control circuit 160 may be known circuit elements.

The light emission state of each light emitting diode 153 in a certain image displaying frame is measured by the corresponding photodiode 67, and an output of the photodiode 67 is inputted to the photodiode control circuit 64 and is converted into data or a signal representative of, for example, a luminance and a chromaticity of the light emitting diode 153 by the photodiode control circuit 64 and the calculation circuit 61. The data is sent to the LED driving circuit 63, by which the light emission state of the light emitting diode 153 in a next image displaying frame is controlled with the data. In this manner, a feedback mechanism is formed.

A resistor r for current detection is inserted in series to the light emitting diode 153 on the downstream of the light emitting diode 153, and current flowing through the resistor r is converted into a voltage. Then, operation of the light emitting diode driving power supply 66 is controlled under the control of the LED driving circuit 63 so that the voltage drop across the resistor r may exhibit a predetermined value. While FIG. 9 shows that one light emitting diode driving power supply 66 serving as a constant current source is shown provided, actually such light emitting diode driving power supplies 66 are disposed for driving individual ones of the light emitting diodes 153. It is to be noted that three planar light source units 152 are shown in FIG. 9. While FIG. 9 shows the configuration wherein one light emitting diode 153 is provided in one planar light source unit 152, the number of light emitting diodes 153 which configure one planar light source unit 152 is not limited to one.

Each pixel group is configured from four kinds of subpixels, as a set, including first subpixel R, second subpixel G, third subpixel B and fourth subpixel W as described above. Here, control of the luminance, that is, gradation control, of each subpixel is carried out by 8-bit control so that the luminance is controlled among $2^8$ stages of 0 to 255. Also, values PS of a pulse width modulation output signal for controlling the light emission time period of each light emitting diodes 153 constituting each planer light source unit 152 are among $2^8$ stages of 0 to 255. However, the number of stages of the luminance is not limited to this, and the luminance control may be carried out, for example, by 10-bit control such that the luminance is controlled among $2^{10}$ of 0 to 1,023. In this instance, the representation of a numerical value of 8 bits may be, for example, multiplied by four.

Following definitions are applied to the light transmission factor (also called numerical aperture) $L_t$ of a subpixel, the luminance y, that is, display luminance, of a portion of the display region which corresponds to the subpixel and the luminance Y of the planar light source unit 152, that is, the light source luminance.

$Y_1$: for example, a maximum luminance of the light source luminance, and this luminance is hereinafter referred to sometimes as light source luminance first prescribed value.

$Lt_1$: for example, a maximum value of the light transmission factor or numerical aperture of a subpixel of the display region unit 132, and this value is hereinafter referred to sometimes as light transmission factor first prescribed value.

$Lt_2$: a transmission factor or numerical aperture of a subpixel when it is assumed that a control signal corresponding to the display region unit signal maximum value $X_{max-(s,t)}$ which is a maximum value among values of an output signal of the signal processing section 20 inputted to the image display panel driving circuit 40 in order to drive all subpixels of the display region unit 132 is supplied to the subpixel, and the transmission factor or numerical aperture is hereinafter referred to sometimes as light transmission factor second prescribed value. It is to be noted that the transmission factor second prescribed value $Lt_2$ satisfies $0 \leq Lt_2 \leq Lt_1$.

$y_2$: a display luminance obtained when it is assumed that the light source luminance is the light source luminance first prescribed value $Y_1$ and the light transmission factor or numerical aperture of a subpixel is the light transmission factor second prescribed value $Lt_2$, and the display luminance is hereinafter referred to sometimes as display luminance second prescribed value.

$Y_2$: a light source luminance of the planar light source unit 152 for making the luminance of a subpixel equal to the display luminance second prescribed value $y_2$ when it is assumed that a control signal corresponding to the display region unit signal maximum value $X_{max-(s,t)}$ is supplied to the subpixel and besides it is assumed that the light transmission factor or numerical aperture of the subpixel at this time is corrected to the light transmission factor first prescribed value $Lt_1$. However, the light source luminance $Y_2$ may be corrected taking an influence of the light source luminance of each planar light source unit 152 upon the light source luminance of any other planar light source unit 152 into consideration.

Figure 11A:
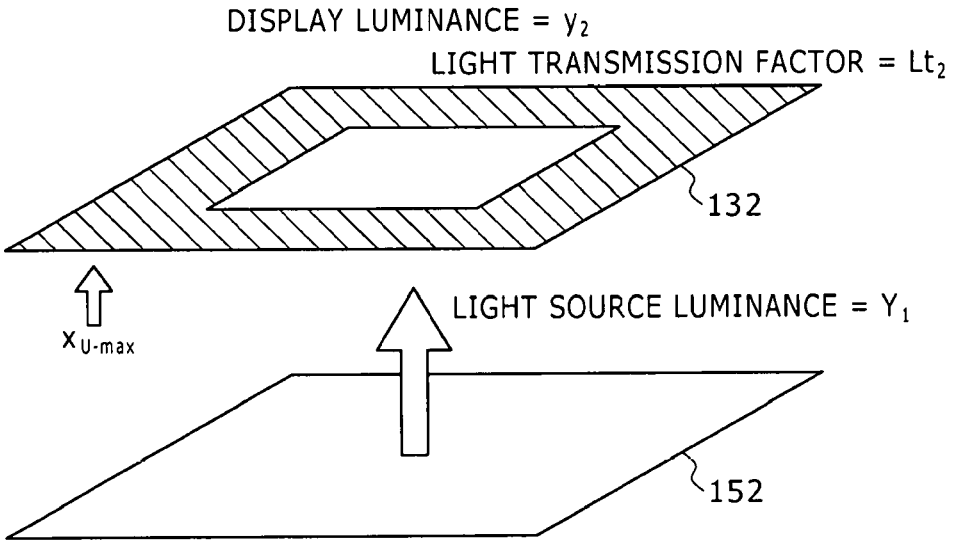
FIGS. 11A and 11B are schematic views illustrating states of increasing or decreasing, under the control of a planar light source apparatus control circuit, the light source luminance of the planar light source unit so that a display luminance second prescribed value when it is assumed that a control signal corresponding to a display region unit signal maximum value is supplied to a subpixel may be obtained by the planar light source unit.
Figure 11B:
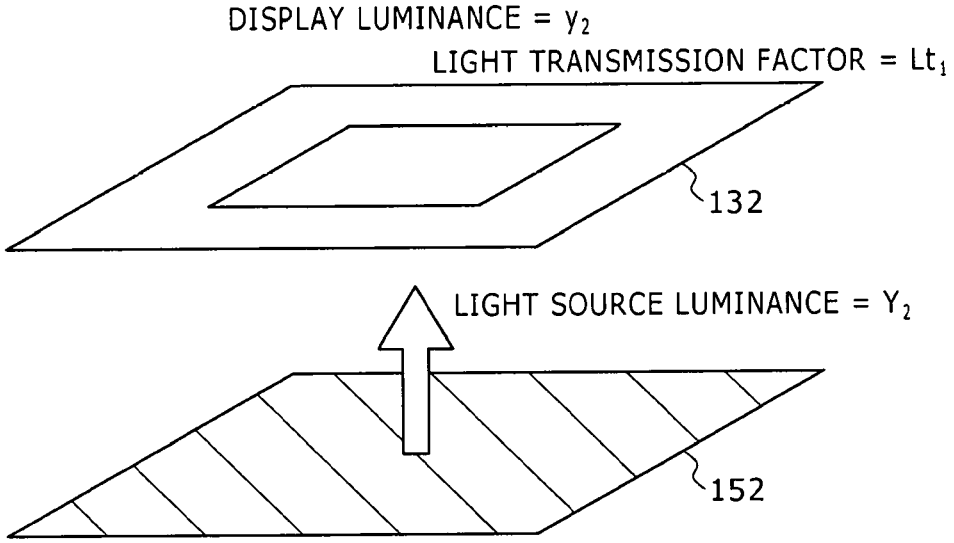

Upon partial driving or divisional driving of the planar light source apparatus, the luminance of a light emitting element which configures a planar light source unit 152 corresponding to a display region unit 132 is controlled by the planar light source apparatus control circuit 160 so that the luminance of a subpixel when it is assumed that a control signal corresponding to the display region unit signal maximum value $X_{max-(s,t)}$ is supplied to the subpixel, that is, the display luminance second prescribed value $y_2$ at the light transmission factor first prescribed value $Lt_1$, may be obtained. In particular, for example, the light source luminance $Y_2$ may be controlled, for example, reduced, so that the display luminance $y_2$ may be obtained when the light transmission factor or numerical aperture of the subpixel is set, for example, to the light transmission factor first prescribed value $Lt_1$. In particular, the light source luminance $Y_2$ of the planar light source unit 152 may be controlled for each image display frame so that, for example, the following expression (A) may be satisfied. It is to be noted that the light source luminance $Y_2$ and the light source luminance first prescribed value $Y_1$ have a relationship of $Y_2 \leq Y_1$. Such control is schematically illustrated in FIGS. 11A and 11B.

$$Y_2 \cdot Lt_1 = Y_1 \cdot Lt_2 \tag{A}$$

In order to individually control the subpixels, the output signal values $X_{1-(p,q)}$, $X_{2-(p,q)}$, $X_{3-(p,q)}$ and $X_{4-(p,q)}$ for controlling the light transmission factor Lt of the individual subpixels are signaled from the signal processing section 20 to the image display panel driving circuit 40. In the image display panel driving circuit 40, control signals are produced from the output signals and supplied or outputted to the subpixels. Then, a switching element which configures each subpixel is driven based on a pertaining one of the control signals and a desired voltage is applied to a transparent first electrode and a transparent second electrode not shown which configure a liquid crystal cell to control the light transmission factor Lt or numerical aperture of the subpixel. Here, as the magnitude of the control signal increases, the light transmission factor Lt or numerical aperture of the subpixel increases and the luminance, that is, the display luminance y, of a portion of the display region corresponding to the subpixel increases. In particular, an image configured from light passing through the subpixel and normally a kind of a point is bright.

Control of the display luminance y and the light source luminance $Y_2$ is carried out for each one image display frame, for each display region unit and for each planar light source unit in image control of the image display panel 130. Further, operation of the image display panel 130 and operation of the planar light source apparatus 150 within one image display frame are synchronized with each other. It is to be noted that the number of image information sent as an electric signal to the driving circuit for one second, that is, the number of images per one second, is a frame frequency or frame rate, and the reciprocal number to the frame frequency is frame time whose unit is second.

In the working example 1, an expansion process of expanding an input signal to obtain an output signal is carried out for all pixels based on one expansion coefficient $\alpha_0$. On the other hand, in the working example 3, an expansion coefficient $\alpha_0$ is calculated for each of the S×T display region units 132, and an expansion process based on the calculated expansion coefficient $\alpha_0$ is carried out for each display region unit 132.

Then, in the (s,t)th planar light source unit 152 which corresponds to the (s,t)th display region unit 132 whose calculated expansion coefficient is $\alpha_{0-(s,t)}$, the luminance of the light source is set to $1/\alpha_{0-(s,t)}$.

Or, the luminance of a light source which configures the planar light source unit 152 corresponding to each display region unit 132 is controlled by the planar light source apparatus control circuit 160 so that a luminance of a subpixel when it is assumed that a control signal corresponding to the display region unit signal maximum value $X_{max-(s,t)}$ which is a maximum value among output signal values $X_{1-(s,t)}$, $X_{2-(s,t)}$, $X_{3-(s,t)}$, and $X_{4-(s,t)}$ of the signal processing section 20 inputted to drive all subpixels which configure each display region unit 132 is supplied to the subpixel, that is, the display luminance second prescribed value $y_2$ at the light transmission factor first prescribed value $Lt_1$, may be obtained. In particular, the light source luminance $Y_2$ may be controlled, for example, reduced, so that the display luminance $y_2$ may be obtained when the light transmission factor or numerical aperture of the subpixel is set to the light transmission factor first prescribed value $Lt_1$. In other words, particularly the light source luminance $Y_2$ of the planar light source unit 152 may be controlled for each image display frame so that the expression (A) given hereinabove may be satisfied.

Incidentally, in the planar light source apparatus 150, in the case where luminance control of the planar light source unit 152 of, for example, (s,t)=(1,1) is assumed, there are cases where it is necessary to take an influence from the other S×T planar light source units 152 into consideration. Since the influence upon the planar light source unit 152 from the other planar light source units 152 is known in advance from a light emission profile of each of the planar light source unit 152, the difference can be calculated by backward calculation, and as a result, correction of the influence is possible. A basic form of the calculation is described below.

The luminance, that is, the light source luminance $Y_2$, required for the S×T planar light source units 152 based on the requirement of the expression (A) is represented by a matrix $[L_{P\times Q}]$. Further, the luminance of a certain planar light source unit which is obtained when only the certain planar light source unit is driven while the other planar light source units are not driven is calculated with regard to the S×T planar light source units 152 in advance. The luminance in this instance is represented by a matrix $[L'_{P\times Q}]$. Further, correction coefficients are represented by a matrix $[\alpha_{P\times Q}]$. Consequently, a relationship among the matrices can be represented by the following expression (B-1). The matrix $[\alpha_{P\times Q}]$ of the correction coefficients can be calculated in advance.

$$[L_{P\times Q}]=[L'_{P\times Q}]\cdot[\alpha_{P\times Q}] \quad \text{(B-1)}$$

Therefore, the matrix $[L'_{P\times Q}]$ may be calculated from the expression (B-1). The matrix $[L'_{P\times Q}]$ can be calculated by calculation of an inverse matrix. In particular, $$[L'_{P\times Q}]=[L_{P\times Q}]\cdot[\alpha_{P\times Q}]^{-1} \quad \text{(B-2)}$$

may be calculated. Then, the light source, that is, the light emitting diode 153, provided in each planar light source unit 152 may be controlled so that the luminance represented by the matrix $[L'_{P\times Q}]$ may be obtained. In particular, such operation or processing may be carried out using information or a data table stored in the storage device or memory 62 provided in the planar light source apparatus control circuit 160. It is to be noted that, in the control of the light emitting diodes 153, since the value of the matrix $[L'_{P\times Q}]$ cannot assume a negative value, it is a matter of course that it is necessary for a result of the calculation to remain within a positive region. Accordingly, the solution of the expression (B-2) sometimes becomes an approximate solution but not an exact solution.

In this manner, a matrix $[L'_{P\times Q}]$ when it is assumed that each planar light source unit is driven solely is calculated as described above based on a matrix $[L_{P\times Q}]$ obtained based on values of the expression (A) obtained by the planar light source apparatus control circuit 160 and a matrix $[\alpha_{P\times Q}]$ of correction coefficients, and the matrix $[L'_{P\times Q}]$ is converted into corresponding integers, that is, values of a pulse width modulation output signal, within the range of 0 to 255 based on the conversion table stored in the storage device 62. In this manner, the calculation circuit 61 which configures the planar light source apparatus control circuit 160 can obtain a value of a pulse width modulation output signal for controlling the light emission time period of the light emitting diode 153 of the planar light source unit 152. Then, based on the value of the pulse width modulation output signal, the on time $t_{ON}$ and the off time $t_{OFF}$ of the light emitting diode 153 which configures the planar light source unit 152 may be determined by the planar light source apparatus control circuit 160. It is to be noted that:

$$t_{ON}+t_{OFF}=\text{fixed value } t_{Const}$$

Further, the duty ratio in driving based on pulse width modulation of the light emitting diode can be represented as $$t_{ON}/(t_{ON}+t_{OFF})=t_{ON}/t_{Const}$$

Then, a signal corresponding to the on time $t_{ON}$ of the light emitting diode 153 which configures the planar light source unit 152 is sent to the LED driving circuit 63, and the switching element 65 is controlled to an on state only within the on time $t_{ON}$ based on the value of the signal corresponding to the on time $t_{ON}$ from the LED driving circuit 63. Consequently, LED driving current from the light emitting diode driving power supply 66 is supplied to the light emitting diode 153. As a result, each light emitting diode 153 emits light only for the on time $t_{ON}$ within one image display frame. In this manner, each display region unit 132 is illuminated with a predetermined illuminance.

It is to be noted that the planar light source apparatus 150 of the divisional driving type or partial driving type described hereinabove in connection with the working example 2 may be applied also to the other working examples.

Working Example 3

Also the working example 3 is a modification to the working example 1. In the working example 3, an image display apparatus described below is used. In particular, the image display apparatus of the working example 3 includes an image display panel wherein a plurality of light emitting element units UN for displaying a color image, which are each configured from a first light emitting element which corresponds to a first subpixel B for emitting blue light, a second light emitting element which corresponds to a second subpixel G for emitting green light, a third light emitting element which corresponds to a third subpixel R for emitting red light and a fourth light emitting element which corresponds to a fourth subpixel W for emitting white light are arrayed in a two-dimensional matrix. Here, the image display panel which configures the image display apparatus of the working example 3 may be, for example, an image display panel having a configuration and structure described below. It is to be noted that the number of light emitting element units UN may be determined based on specifications required for the image display apparatus.

In particular, the image display panel which configures the image display apparatus of the working example 3 is a direct-vision color image display panel of the passive matrix type or the active matrix type wherein the light emitting/no-light emitting states of the first, second, third and fourth light emitting elements are controlled so that the light emission states of the light emitting elements may be directly visually observed to display an image. Or, the image display panel is a color image display panel of the passive matrix projection type or the active matrix projection type wherein the light emitting/no-light emitting states of the first, second, third and fourth light emitting elements are controlled such that light is projected on a screen to display an image.

Figure 12:
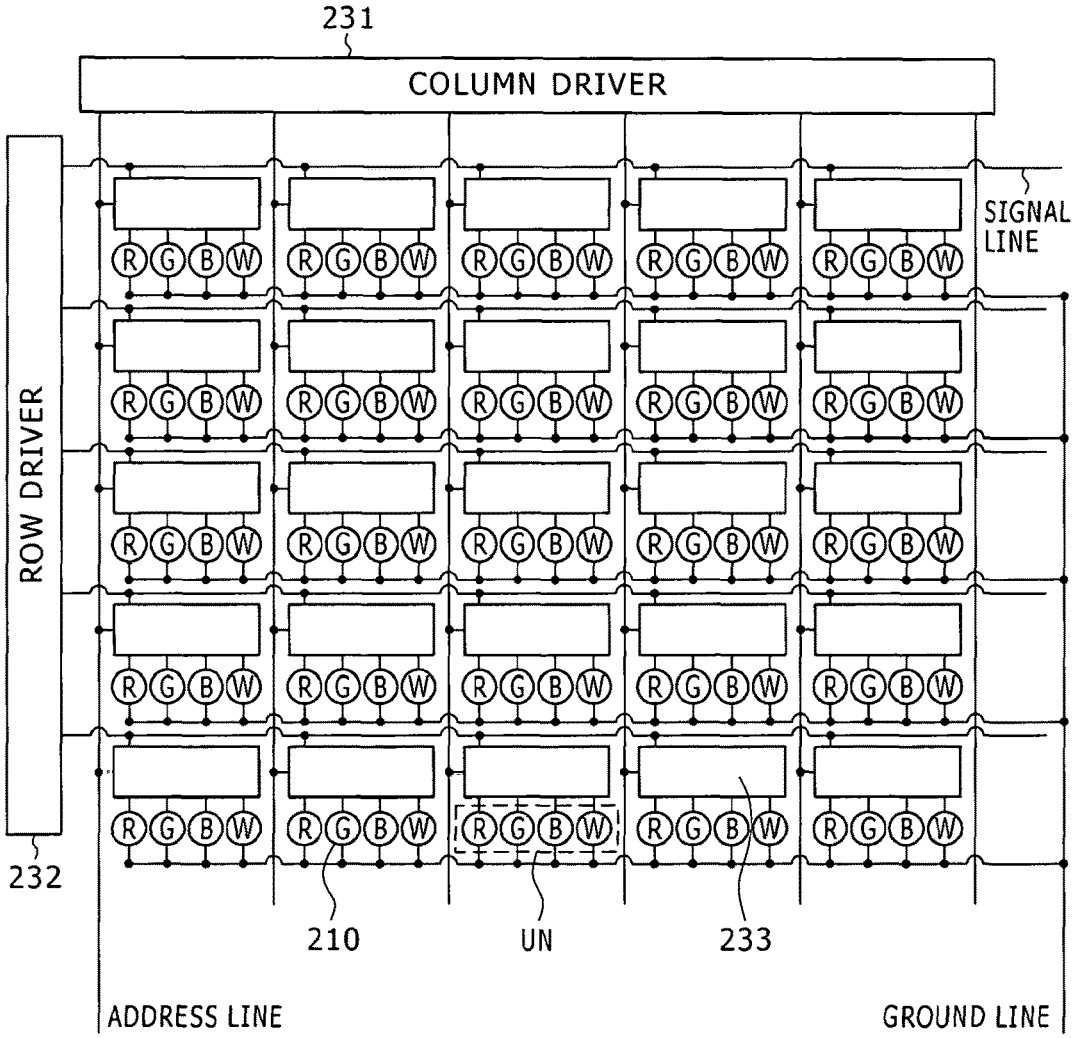
FIG. 12 is an equivalent circuit diagram of an image display apparatus of a working example 3 of the present invention.

For example, a light emitting element panel which configures a direct-vision color image display panel of the active matrix type is shown in FIG. 12. Referring to FIG. 12, a light emitting element for emitting red light, that is, a first subpixel, is denoted by "R"; a light emitting element for emitting green light, that is, a second subpixel, by "G"; a light emitting element for emitting blue light, that is, a third subpixel, by "B"; and a light emitting element for emitting white light, that is, a fourth subpixel, by "W." Each of light emitting elements 210 is connected at one electrode thereof, that is, at the p side electrode or the n side electrode thereof, to a driver 233. Such drivers 233 are connected to a column driver 231 and a row driver 232. Each light emitting element 210 is connected at the other electrode thereof, that is, at the n side electrode or the p side electrode thereof, to a ground line. Control of each light emitting element 210 between the light emitting state and the no-light emitting state is carried out, for example, by selection of the driver 233 by the row driver 232, and a luminance signal for driving each light emitting element 210 is supplied from the column driver 231 to the driver 233. Selection of any of the light emitting element R for emitting red light, that is, the first light emitting element or first subpixel R, the light emitting element G for emitting green light, that is, the second light emitting element or second subpixel G, the light emitting element B for emitting blue light, that is, the third light emitting element or third subpixel B and the light emitting element W for emitting white light, that is, the fourth light emitting element or fourth subpixel W, is carried out by the driver 233. The light emitting and no-light emitting states of the light emitting element R for emitting red light, the light emitting element G for emitting green light, the light emitting element B for emitting blue light and the light emitting element W for emitting white light may be controlled by time division control or may be controlled simultaneously. It is to be noted that, in the case where the image display apparatus is of the direct vision type, an image is viewed directly, but where the image display apparatus is of the projection type, an image is projected on a screen through a projection lens.

Figure 13:
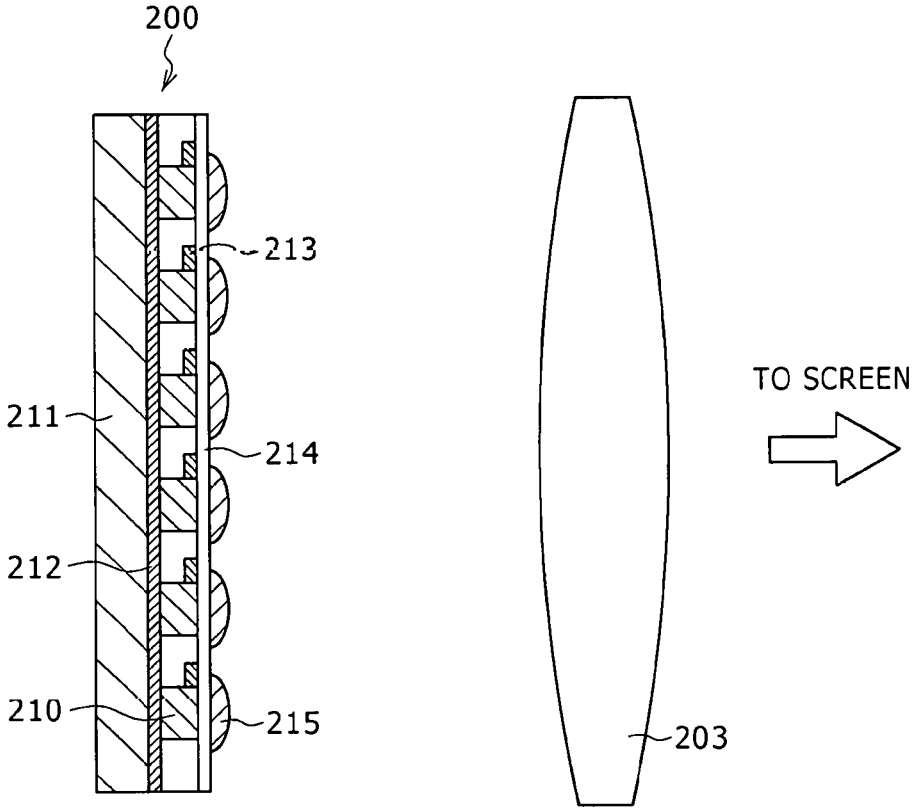
FIG. 13 is a schematic view of an image display panel which composes the image display apparatus of the working example 3.

It is to be noted that an image display panel which configures such an image display apparatus as described above is schematically shown in FIG. 13. In the case where the image display apparatus is of the direct-vision type, the image display panel is viewed directly, but where the image display apparatus is of the projection type, an image is projected from the display panel to the screen through a projection lens 203.

Or, also it is possible to form an image display panel which configures the image display apparatus of the working example 3 as such a color image display panel of the direct type or the projection type as described below. In particular, the image display panel includes a light transmission control apparatus for controlling transmission/non-transmission of emitted light from light emitting element units arrayed in a two-dimensional matrix such as a light valve apparatus, particularly a liquid crystal display apparatus which includes, for example, thin film transistors of the high-temperature polycrystalline silicon type. This similarly applies also in the following description. The light emitting/no-light emitting states of first, second, third and fourth light emitting elements of each light emitting element unit are controlled time-divisionally. Further, transmission/non-transmission of light emitted from the first, second, third and fourth light emitting elements is controlled by a light transmission control apparatus to display an image.

In the working example 3, output signals for controlling the light emission state of the first light emitting element (first subpixel R), second light emitting element (second subpixel G), third light emitting element (third subpixel B) and fourth light emitting element (fourth subpixel W), may be obtained based on the expansion process described hereinabove in connection with the working example 1. Then, if the image display apparatus is driven based on the output signal values $X_{1-(p,q)}$, $X_{2-(p,q)}$, $X_{3-(p,q)}$, and $X_{4-(p,q)}$ obtained by the expansion process, then the luminance of the entire image display apparatus can be increased to $\alpha_0$ times. Or, if the emitted light luminance of the first, second, third and fourth light emitting elements, that is, the first, second, third and fourth subpixels, is controlled to $1/\alpha_0$ times based on the output signal values $X_{1-(p,q)}$, $X_{2-(p,q)}$, $X_{3-(p,q)}$, and $X_{4-(p,q)}$, then reduction of the power consumption of the entire image display apparatus can be achieved without causing deterioration of the image quality.

Working Example 4

The working example 4 relates to a driving method for an image display apparatus according to the second, seventh, 12th, 17th and 22nd embodiments of the present invention and a driving method for an image display apparatus assembly according to the second, seventh, 12th, 17th and 22nd embodiments of the present invention.

Figure 14:
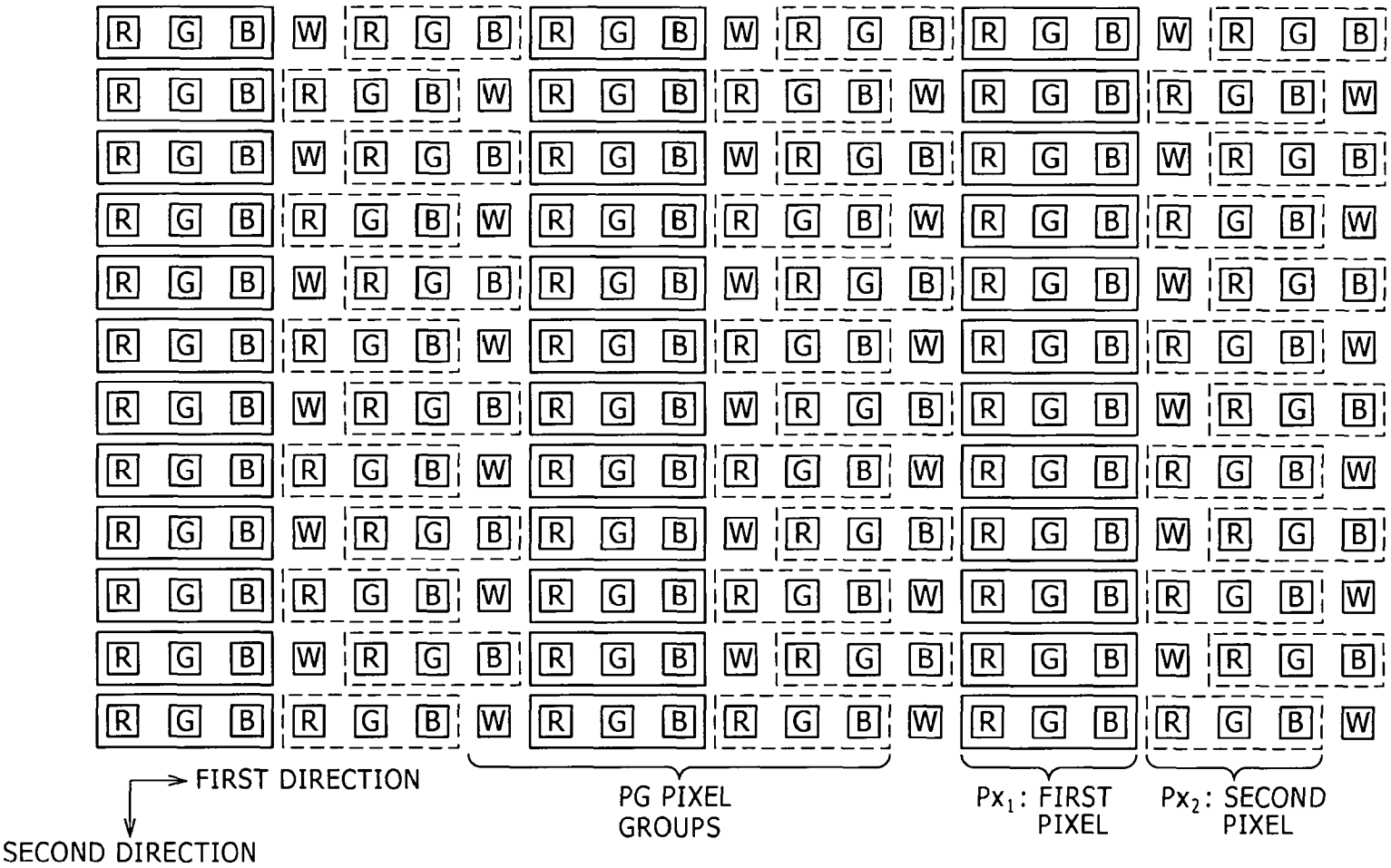
FIG. 14 is a view schematically illustrating different arrangements of pixels and pixel groups on an image display panel of a working example 4 of the present invention.
Figure 17:
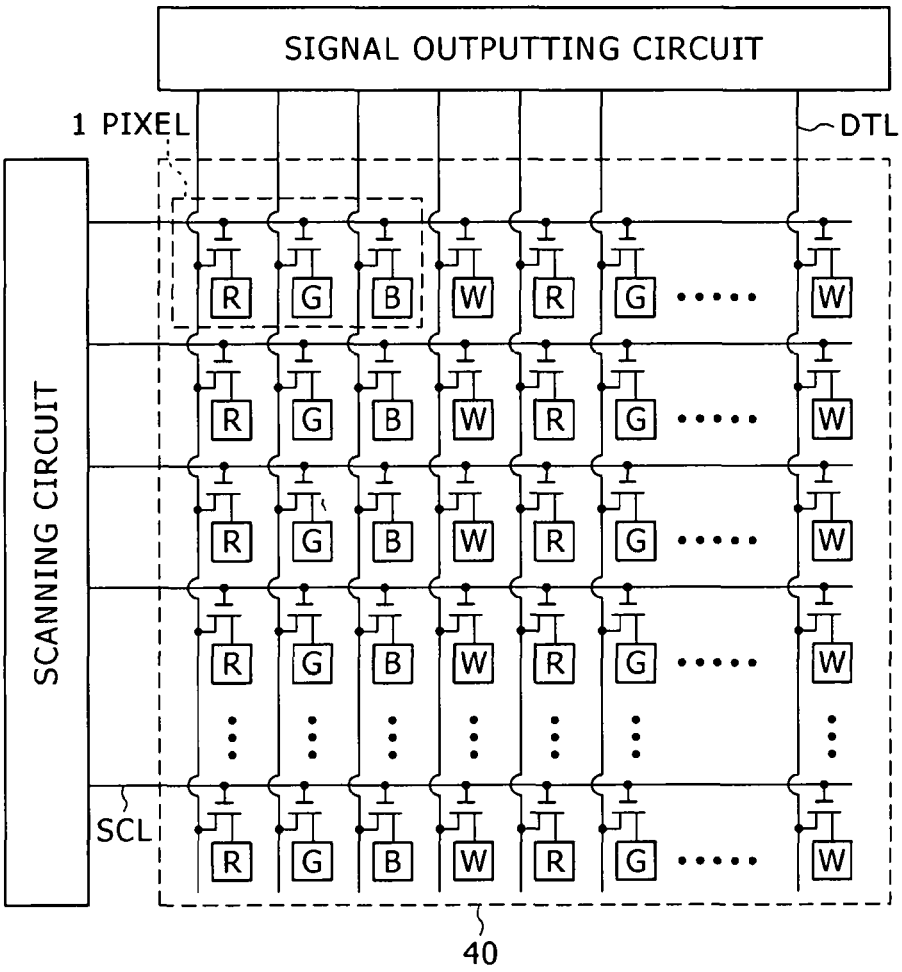
FIG. 17 is a circuit diagram of the image display panel and an image display panel driving circuit of the image display apparatus of the working example 4.

As seen in FIG. 14 which diagrammatically illustrates arrangement of pixels, in the image display panel 30 of the working example 4, a plurality of pixels Px each configured from a first subpixel R for displaying a first primary color such as, for example, red, a second subpixel G for displaying a second primary color such as, for example, green, and a third subpixel B for displaying a third primary color such as, for example, blue are arrayed in a first direction and a second direction so as to form a two-dimensional matrix. Further, a pixel group PG is configured at least from a first pixel $Px_1$ and a second pixel $Px_2$ arrayed in the first direction. It is to be noted that, in the working example 4, the pixel group PG is particularly configured from a first pixel $Px_1$ and a second pixel $Px_2$, and where the number of pixels which configure the pixel group PG is represented by $p_0$, $p_0=2$. Further, in each pixel group PG, a fourth subpixel W for displaying a fourth color, in the working example 4, particularly white, is disposed between the first pixel $Px_1$ and the second pixel $Px_2$. It is to be noted that, while the arrangement of the pixels is illustrated in FIG. 17 for the convenience of illustration, the arrangement illustrated in FIG. 17 is arrangement of pixels in the working example 6 hereinafter described.

Here, if a positive number P represents the number of pixel group PG along the first direction and another positive number Q represents the number of pixel group PG along the second direction, then more particularly P×Q pixels Px are arrayed in a two-dimensional matrix such that $p_0 \times P$ pixels Px are arrayed in a horizontal direction which is the first direction and Q pixels Px are arrayed in a vertical direction which is the second direction. Further, in the working example 4, in each pixel group PG, $p_0=2$ as described hereinabove.

Further, in the working example 4, in the case where the first direction is a row direction and the second direction is a column direction, a first pixel $Px_1$ in the q'th column where $1 \leq q' \leq Q-1$ and a first pixel $Px_1$ in the (q'+1)th column are disposed adjacent each other, and a fourth subpixel W in the q'th column and a fourth subpixel W in the (q'+1)th column are not disposed adjacent each other. In other words, second pixels $Px_2$ and fourth subpixels W are disposed alternately along the second direction. It is to be noted that, in FIG. 14, the first subpixel R, second subpixel G and third subpixel B which configure the first pixel $Px_1$ are surrounded by solid lines while the first subpixel R, second subpixel G and third subpixel B which configure the second pixel $Px_2$ are surrounded by broken lines. This similarly applies also to FIGS. 15, 16, 19, 20 and 21 hereinafter described. Since the second pixels $Px_2$ and the fourth subpixels W are disposed alternately along the second direction, although it depends upon the pixel pitch, such a situation that a striped pattern is caused to appear on an image by the presence of the fourth subpixels W can be prevented with certainty.

Here in the working example 4, regarding the first pixel $Px_{(p,q)-1}$ which configures the (p,q)th pixel group $PG_{(p,q)}$ where $1 \le p \le P$ and $1 \le q \le Q$, the signal processing section 20 receives a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, inputted thereto, and regarding the second pixel $Px_{(p,q)-2}$ which configures the (p,q)th pixel group $PG_{(p,q)}$, the signal processing section 20 receives a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, inputted thereto.

Further, in the working example 4, regarding the first pixel $Px_{(p,q)-1}$ which configures the (p,q)th pixel group $PG_{(p,q)}$, the signal processing section 20 outputs a first subpixel output signal having a signal value $X_{1-(p,q)-1}$ for determining a display gradation of the first subpixel R, a second subpixel output signal having a signal value $x_{2-(p,q)-1}$ for determining a display gradation of the second subpixel G, and a third subpixel output signal having a signal value $X_{3-(p,q)-1}$ for determining a display gradation of the third subpixel B.

Further, regarding the second pixel $Px_{(p,q)-2}$ which configures the (p,q)th pixel group $PG_{(p,q)}$, the signal processing section 20 outputs a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, a third subpixel output signal having a signal value $X_{3-(p,q)-2}$ for determining a display gradation of the fourth subpixel W, and further regarding the fourth subpixel W which configures the (p,q)th pixel group $PG_{(p,q)}$, a fourth subpixel output signal having a signal value $X_{4-(p,q)}$ for determining a display gradation of the fourth subpixel W.

Further, the signal processing section 20 in the working example 4, regarding the first pixel $Px_{(p,q)-1}$, calculates a first subpixel output signal, that is, a signal value $X_{1-(p,q)-1}$ based at least on a first subpixel input signal, that is, a signal value $x_{1-(p,q)-1}$ and the expansion coefficient $\alpha_0$, and outputs the calculated first subpixel output signal to the first subpixel R. Further, the signal processing section 20 calculates a second subpixel output signal, that is, a signal value $X_{2-(p,q)-1}$, based at least on a second subpixel input signal, that is, a signal value $x_{2-(p,q)-1}$ and the expansion coefficient $\alpha_0$, and outputs the calculated second subpixel output signal to the second subpixel G. The signal processing section 20 calculates a third subpixel output signal, that is, a signal value $X_{3-(p,q)-1}$, based at least on a third subpixel input signal, that is, a signal value $x_{3-(p,q)-1}$ and the expansion coefficient $\alpha_0$, and outputs the calculated third subpixel output signal to the third subpixel B. The signal processing section 20 calculates, regarding the second pixel $PX_{(p,q)-2}$, calculates a first subpixel output signal, that is, a signal value $X_{1-(p,q)-2}$ based at least on a first subpixel input signal, that is, a signal value $x_{1-(p,q)-2}$ and the expansion coefficient $\alpha_0$, and outputs the calculated first subpixel output signal to the first subpixel R. Further, the signal processing section 20 calculates a second subpixel output signal, that is, a signal value $X_{2-(p,q)-2}$, based at least on a second subpixel input signal, that is, a signal value $x_{2-(p,q)-2}$ and the expansion coefficient $\alpha_0$, and outputs the calculated second subpixel output signal to the second subpixel G. The signal processing section 20 calculates a third subpixel output signal, that is, a signal value $X_{3-(p,q)-2}$, based at least on a third subpixel input signal, that is, a signal value $x_{3-(p,q)-2}$ and the expansion coefficient $\alpha_0$, and outputs the calculated third subpixel output signal to the third subpixel B.

Further, regarding the fourth subpixel W, the signal processing section 20 calculates the fourth subpixel output signal of the signal value $X_{4-(p,q)}$ based on a fourth subpixel control first signal of a signal value $SG_{1-(p,q)}$ calculated from the first subpixel input signal of the signal value $x_{1-(p,q)-1}$, second subpixel input signal of the signal value $x_{2-(p,q)-1}$ and third subpixel input signal of the signal value $x_{3-(p,q)-1}$ to the first pixel $Px_{(p,q)-1}$ and a fourth subpixel control second signal of a signal value $SG_{2-(p,q)}$ calculated from the first subpixel input signal of the signal value $x_{1-(p,q)-2}$, second subpixel input signal of the signal value $x_{2-(p,q)-2}$ and third subpixel input signal of the signal value $x_{3-(p,q)-2}$ to the second pixel $Px_{(p,q)-2}$. The calculated subpixel output signal of the signal value $X_{4-(p,q)}$ is outputted to the fourth subpixel W.

In the working example 4, particularly the fourth subpixel control first signal value $SG_{1-(p,q)}$ is calculated based on $Min_{(p,q)-1}$ and the expansion coefficient $\alpha_0$ while the fourth subpixel control second signal value $SG_{2-(p,q)}$ is calculated based on $Min_{(p,q)-2}$ and the expansion coefficient $\alpha_0$. More particularly, the fourth subpixel control first signal value $SG_{1-(p,q)}$ and the fourth subpixel control second signal value $SG_{2-(p,q)}$ are calculated using expressions (41-1) and (41-2) which are based on the expressions (2-1-1) and (2-1-2), respectively.

$$SG_{1-(p,q)} = Min_{(p,q)-1} \cdot \alpha_0 \tag{41-1}$$

$$SG_{2-(p,q)} = Min_{(p,q)-2} \cdot \alpha_0 \tag{41-2}$$

Further, regarding the first pixel $P_{x(p,q)-1}$, the signal processing section 20 calculates, while it calculates the first subpixel output signal based at least on the first subpixel input signal and the expansion coefficient $\alpha_0$, the first subpixel output signal value $X_{1-(p,q)-1}$ based on the first subpixel input signal value $x_{1-(p,q)-1}$, expansion coefficient $\alpha_0$, fourth subpixel control first signal value $SG_{1-(p,q)}$ and constant $\chi$, that is, based on $$[x_{1-(p,q)-1}, \alpha_0, SG_{1-(p,q)}, \chi]$$

calculates, while it calculates the second subpixel output signal based at least on the second subpixel input signal and the expansion coefficient $\alpha_0$, the second subpixel output signal value $X_{2-(p,q)-1}$ based on the second subpixel input signal value $x_{2-(p,q)-1}$, expansion coefficient $\alpha_0$, fourth subpixel control first signal value $SG_{1-(p,q)}$ and constant $\chi$, that is, based on $$[x_{2-(p,q)-1}, \alpha_0, SG_{1-(p,q)}, \chi]$$

and calculates, while it calculates the third subpixel output signal based at least on the third subpixel input signal and the expansion coefficient $\alpha_0$, the third subpixel output signal value $X_{3-(p,q)-1}$ based on the third subpixel input signal value $x_{3-(p,q)-1}$, expansion coefficient $\alpha_0$, fourth subpixel control first signal value $SG_{1-(p,q)}$ and constant $\chi$, that is, based on $$[x_{3-(p,q)-1}, \alpha_0, SG_{1-(p,q)}, \chi]$$

and regarding the second pixel $Px_{(p,q)-2}$, the signal processing section 20 calculates, while it calculates the first subpixel output signal based at least on the first subpixel input signal and the expansion coefficient $\alpha_0$, the first subpixel output signal value $X_{1-(p,q)-2}$ based on the first subpixel input signal value $x_{1-(p,q)-2}$, expansion coefficient $\alpha_0$, fourth subpixel control second signal value $SG_{2-(p,q)}$ and constant $\chi$, that is, based on $$[x_{1-(p,q)-2}, \alpha_0, SG_{2-(p,q)}, \chi]$$

calculates, while it calculates the second subpixel output signal based at least on the second subpixel input signal and the expansion coefficient $\alpha_0$, the second subpixel output signal value $X_{2-(p,q)-2}$ based on the second subpixel input signal value $x_{2-(p,q)-2}$, expansion coefficient $\alpha_0$, fourth subpixel control second signal value $SG_{2-(p,q)}$ and constant $\chi$, that is, based on $$[x_{2-(p,q)-2}, \alpha_0, SG_{2-(p,q)}, \chi]$$

and calculates, while it calculates the third subpixel output signal based at least on the third subpixel input signal and the expansion coefficient $\alpha_0$, the third subpixel output signal value $X_{3-(p,q)-2}$ based on the third subpixel input signal value $x_{3-(p,q)-2}$, expansion coefficient $\alpha_0$, fourth subpixel control second signal value $SG_{2-(p,q)}$ and constant $\chi$, that is, based on $$[x_{3-(p,q)-2}, \alpha_0, SG_{2-(p,q)}, \chi]$$

In the signal processing section 20, the output signal values $X_{1-(p,q)-1}$, $X_{2-(p,q)-1}$, $X_{3-(p,q)-1}$, $X_{1-(p,q)-2}$ and $X_{2-(p,q)-2}$, $X_{3-(p,q)-2}$, as described above, can be calculated based on the expansion coefficient $\alpha_0$ and the constant $\chi$. More particularly, the output signal values mentioned can be calculated from the following expressions.

$$X_{1-(p,q)-1} = \alpha_0 \cdot x_{1-(p,q)-1} - \chi \cdot SG_{1-(p,q)} \quad (2\text{-A})$$

$$X_{2-(p,q)-1} = \alpha_0 \cdot x_{2-(p,q)-1} - \chi \cdot SG_{1-(p,q)} \quad (2\text{-B})$$

$$X_{3-(p,q)-1} = \alpha_0 \cdot x_{3-(p,q)-1} - \chi \cdot SG_{1-(p,q)} \quad (2\text{-C})$$

$$X_{1-(p,q)-2} = \alpha_0 \cdot x_{1-(p,q)-2} - \chi \cdot SG_{2-(p,q)} \quad (2\text{-D})$$

$$X_{2-(p,q)-2} = \alpha_0 \cdot x_{2-(p,q)-2} - \chi \cdot SG_{2-(p,q)} \quad (2\text{-E})$$

$$X_{3-(p,q)-2} = \alpha_0 \cdot x_{3-(p,q)-2} - \chi \cdot SG_{2-(p,q)} \quad (2\text{-F})$$

Further, the signal value $X_{4-(p,q)}$ is calculated from expressions (42-1) and (42-2) of arithmetic mean based on the expression (2-11), that is, from $$X_{4-(p,q)} = (SG_{1-(p,q)} + SG_{2-(p,q)})/(2\chi) \quad (42\text{-}1)$$

$$= (\mathrm{Min}_{(p,q)-1} \cdot \alpha_0 + \mathrm{Min}_{(p,q)-2} \cdot \alpha_0)/(2\chi) \quad (42\text{-}2)$$

It is to be noted that, while the right side of the expressions (42-1) and (42-2) includes division by $\chi$, the expression is not limited to this.

Here, the expansion coefficient $\alpha_0$ is determined for every one image display frame. Further, the luminance of the planar light source apparatus 50 is decreased based on the expansion coefficient $\alpha_0$. Particularly, the luminance of the planar light source apparatus 50 may be reduced to $1/\alpha_0$ times.

Also in the working example 4, a maximum value $V_{max}$ (S) of the brightness where the saturation S in an HSV color space expanded by addition of a fourth color (white) is variable is stored into the signal processing section 20 similarly as in the working example 1. In other words, by addition of a fourth color (white), the dynamic range of the brightness in the HSV color space is expanded.

In the following, a method (expansion process) of calculating the output signal values $X_{1-(p,q)-1}$, $X_{2-(p,q)-1}$, $X_{3-(p,q)-1}$, $X_{1-(p,q)-2}$, $X_{2-(p,q)-2}$, $X_{3-(p,q)-2}$ and $X_{4-(p,q)}$ of the (p,q)th pixel $Px_{(p,q)}$. It is to be noted that the following process is carried out so as to keep, in the whole of the first pixel and the second pixel, that is, in each pixel group, the ratio among the luminance of the first primary color displayed by the (first subpixel R+fourth subpixel W), the luminance of the second primary color displayed by the (second subpixel G+fourth subpixel W) and the luminance of the third primary color displayed by the (third subpixel B+fourth subpixel W). Besides, the process is carried out so as to keep or maintain the color tone as far as possible. Furthermore, the process is carried out so as to keep or maintain the gradation-luminance characteristic, that is, the gamma characteristic or γ characteristic).

Step 400

First, the signal processing section 20 calculates the saturation S and the brightness V(S) of a plurality of pixel groups $PG_{(p,q)}$ based on subpixel input signal values to a plurality of pixels. In particular, the signal processing section 20 calculates the saturation $S_{(p,q)-1}$ and $S_{(p,q)-2}$ and the brightness $V(S)_{(p,q)-1}$ and $V(S)_{(p,q)-2}$ from expressions substantially same as the expressions (43-1) to (43-4) based on the input signal value $x_{1-(p,q)-1}$, $x_{1-(p,q)-2}$ of the first subpixel input signal, the input signal value $x_{2-(p,q)-1}$, $x_{2-(p,q)-2}$ of the second pixel input signal and the input signal value $x_{3-(p,q)-1}$, $x_{3-(p,q)-2}$ of the third subpixel input signal to the (p,q)th pixel group $PG_{(p,q)}$. This process is carried out for all pixel groups $PG_{(p,q)}$.

$$S_{(p,q)-1} = (\mathrm{Max}_{(p,q)-1} - \mathrm{Min}_{(p,q)-1})/\mathrm{Max}_{(p,q)-1} \quad (43\text{-}1)$$

$$V(S)_{(p,q)-1} = \mathrm{Max}_{(p,q)-1} \quad (43\text{-}2)$$

$$S_{(p,q)-2} = (\mathrm{Max}_{(p,q)-2} - \mathrm{Min}_{(p,q)-2})/\mathrm{Max}_{(p,q)-2} \quad (43\text{-}3)$$

$$V(S)_{(p,q)-2} = \mathrm{Max}_{(p,q)-2} \quad (43\text{-}4)$$

Step 410

Then, the signal processing section 20 determines the expansion coefficient $\alpha_0$ from the value of $V_{max}(S)/V(S)$ calculated with regard to a plurality of pixel group $PG_{(p,q)}$ from a predetermined value $\beta_0$ in a similar manner as in the working example 1. Or, the expansion coefficient $\alpha_0$ is determined based on the provisions of the expression (15-2), expressions (16-1) to (16-5) or expressions (17-1) to (17-6).

Step 420

Thereafter, the signal processing section 20 calculates the signal value $X_{4-(p,q)}$ of the (p,q)th pixel group $PG_{(p,q)}$ based at least on the input signal values $x_{1-(p,q)-1}$, $x_{2-(p,q)-1}$, $x_{3-(p,q)-1}$, $x_{1-(p,q)-2}$, $x_{2-(p,q)-2}$ and $x_{3-(p,q)-2}$. In particular, in the working example 4, the signal value $X_{4-(p,q)}$ is calculated based on $Min_{(p,q)-1}$, $Min_{(p,q)-2}$, expansion coefficient $\alpha_0$ and constant $\chi$. More particularly, in the working example 4, the signal value $X_{4-(p,q)}$ is calculated based on $$X_{4-(p,q)}=(Min_{(p,q)-1}\cdot\alpha_0+Min_{(p,q)-2}\cdot\alpha_0)/(2\chi) \quad (42\text{-}2)$$

It is to be noted that the signal value $X_{4-(p,q)}$ is calculated with regard to all of the P×Q pixel groups $PG_{(p,q)}$.

Step 430

Then, the signal processing section 20 calculates the signal value $X_{1-(p,q)-1}$ of the (p,q)th pixel group $PG_{(p,q)}$ based on the signal value $x_{1-(p,q)-1}$, expansion coefficient $\alpha_0$ and the fourth subpixel control first signal $SG_{1-(p,q)}$. Further, the signal processing section 20 calculates the signal value $X_{2-(p,q)-1}$ based on the signal value $x_{2-(p,q)-1}$, expansion coefficient $\alpha_0$ and the fourth subpixel control first signal $SG_{1-(p,q)}$. Furthermore, the signal processing section 20 calculates the signal value $X_{3-(p,q)-1}$ based on the signal value $x_{3-(p,q)-1}$, expansion coefficient $\alpha_0$ and the fourth subpixel control first signal $SG_{1-(p,q)}$. Further, the signal processing section 20 calculates the signal value $X_{1-(p,q)-2}$ based on the signal value $x_{1-(p,q)-2}$, expansion coefficient $\alpha_0$ and the fourth subpixel control second signal $SG_{2-(p,q)}$, calculates the signal value $X_{2-(p,q)-2}$ based on the signal values $x_{2-(p,q)-2}$, expansion coefficient $\alpha_0$ and the fourth subpixel control second signal $SG_{2-(p,q)}$, and calculates the signal value $X_{3-(p,q)-2}$ based on the signal values $X_{3-(p,q)-2}$, expansion coefficient $\alpha_0$ and the fourth subpixel control second signal $SG_{2-(p,q)}$. It is to be noted that the step 420 and the step 430 may be executed simultaneously, or the step 420 may be executed after execution of the step 430.

In particular, the signal processing section 20 calculates the output signal values $X_{1-(p,q)-1}$, $X_{2-(p,q)-1}$, $X_{3-(p,q)-1}$, $X_{1-(p,q)-2}$, $X_{2-(p,q)-2}$ and $X_{3-(p,q)-2}$ of the (p,q)th pixel group $PG_{(p,q)}$ based on the expressions (2-A) to (2-F), respectively.

What is significant here resides in that the value of $Min_{(p,q)-1}$ and $Min_{(p,q)-2}$ is expanded by the expansion coefficient $\alpha_0$ as indicated by the expressions (41-1), (41-2) and (42-2). Since the value of $Min_{(p,q)-1}$ and $Min_{(p,q)-2}$ is expanded by the expansion coefficient $\alpha_0$ in this manner, not only the luminance of the white display subpixel (the fourth subpixel W) increases, but also the luminance of the red display subpixel, green display subpixel and blue display subpixel (the first subpixel R, second subpixel G and third subpixel B) increases as indicated by the expressions (2-A) to (2-F). Therefore, occurrence of such a problem that darkening in color occurs can be prevented with certainty. In particular, the luminance of an entire image increases to $\alpha_0$ times by expanding the value of $Min_{(p,q)-1}$ and $Min_{(p,q)-2}$ by the expansion coefficient $\alpha_0$ in comparison with the alternative case in which the value of $Min_{(p,q)-1}$ and $Min_{(p,q)-2}$ is not expanded. Accordingly, for example, image display of a still picture or the like can be carried out with a high luminance favorably.

Figure 18:
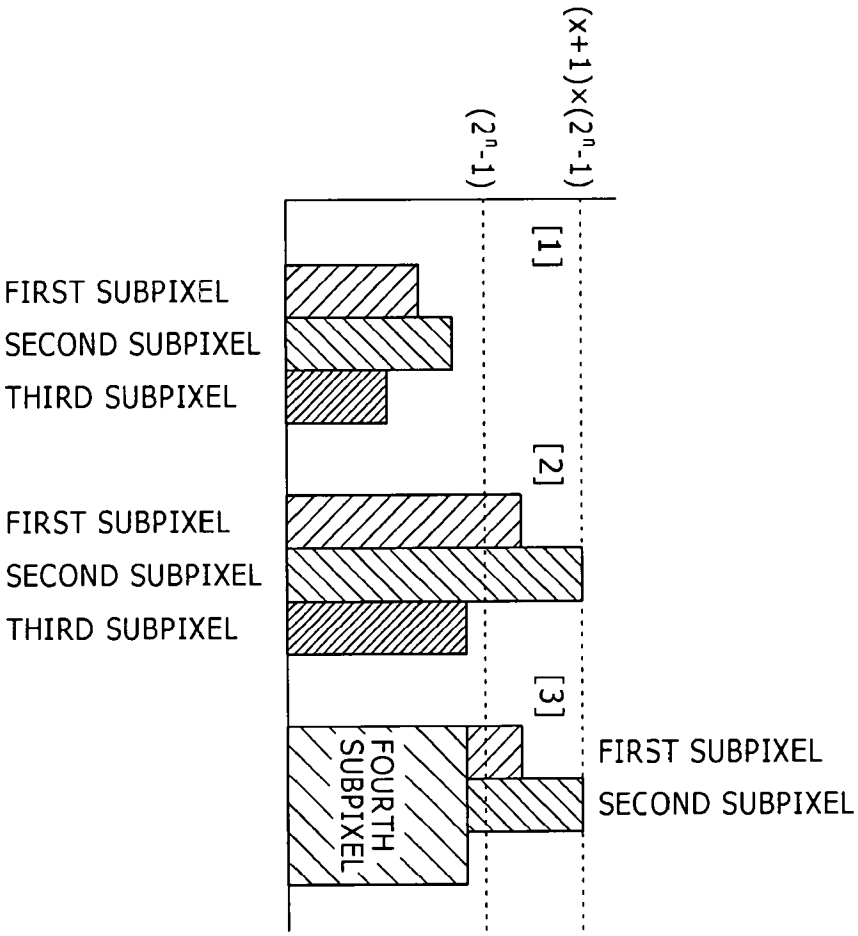
FIG. 18 diagrammatically illustrates input signal values and output signal values in the expansion process in the driving method for an image display apparatus and the driving method for an image display apparatus assembly of the working example 4.

An expansion process in the driving method for an image display apparatus and the driving method for an image display apparatus assembly of the working example 4 is described with reference to FIG. 18. FIG. 18 schematically illustrates input signal values and output signal values. Referring to FIG. 18, the input signal values of a set of the first subpixel R, second subpixel G and third subpixel B are indicated in [1]. Meanwhile, the input signal values expanded by an expansion operation, that is, by an operation of calculating the product of an input signal value and the expansion coefficient $\alpha_0$, are indicated in [2]. Furthermore, the output signal values after an expansion operation is carried out, that is, a state in which the output signal values $X_{1-(p,q)-1}$, $X_{2-(p,q)-1}$, $X_{3-(p,q)-1}$, and $X_{4-(p,q)-1}$ are obtained, are indicated in [3]. In the example illustrated in FIG. 18, a maximum luminance which can be implemented is obtained with the second subpixel G.

In the driving method for an image display apparatus or the driving method for an image display apparatus assembly of the working example 4, the signal processing section 20 calculates a fourth subpixel output signal based on a fourth subpixel control first signal value $SG_{1-(p,q)}$ and a fourth subpixel control second signal value $SG_{2-(p,q)}$ calculated from a first subpixel input signal, a second subpixel input signal and a third subpixel input signal to the first pixel $Px_1$ and the second pixel $Px_2$ of each pixel group PG and outputs the calculated fourth subpixel output signal. In particular, since the fourth subpixel output signal is calculated based on input signals to the first pixel $Px_1$ and the second pixel $Px_2$ which are positioned adjacent each other, optimization of the output signal to the fourth subpixel is achieved. Besides, since one fourth subpixel is disposed also for a pixel group PG which is configured at least from the first pixel $Px_1$ and the second pixel $Px_2$, reduction of the area of the aperture region of the subpixels can be suppressed. As a result, increase of the luminance can be achieved with certainty and improvement in display quality can be achieved.

For example, if the length of a pixel along the first direction is represented by $L_1$, then in the technique disclosed in Patent Document 1 or Patent Document 2, since it is necessary to divide one pixel into four subpixels, the length of one subpixel along the first direction is $L_1/4=0.25L_1$. Meanwhile, in the working example 4, the length of one subpixel along the first direction is $2L_1/7=0.286L_1$. Accordingly, the length of one pixel along the first direction is greater by 14% in comparison with the technique disclosed in Patent Document 1 or Patent Document 2.

It is to be noted that, in the working example 4, the signal values $X_{1-(p,q)-1}$, $X_{2-(p,q)-1}$, $X_{3-(p,q)-1}$, $X_{1-(p,q)-2}$, $X_{2-(p,q)-2}$ and $X_{3-(p,q)-2}$ can be calculated based respectively on $$[x_{1-(p,q)-1}, x_{1-(p,q)-2}, \alpha_0, SG_{1-(p,q)}, \chi]$$

$$[x_{2-(p,q)-1}, x_{2-(p,q)-2}, \alpha_0, SG_{1-(p,q)}, \chi]$$

$$[x_{3-(p,q)-1}, x_{3-(p,q)-2}, \alpha_0, SG_{1-(p,q)}, \chi]$$

$$[x_{1-(p,q)-1}, x_{1-(p,q)-2}, \alpha_0, SG_{2-(p,q)}, \chi]$$

$$[x_{2-(p,q)-1}, x_{2-(p,q)-2}, \alpha_0, SG_{2-(p,q)}, \chi]$$

$$[x_{3-(p,q)-1}, x_{3-(p,q)-2}, \alpha_0, SG_{2-(p,q)}, \chi]$$

Working Example 5

Figure 15:
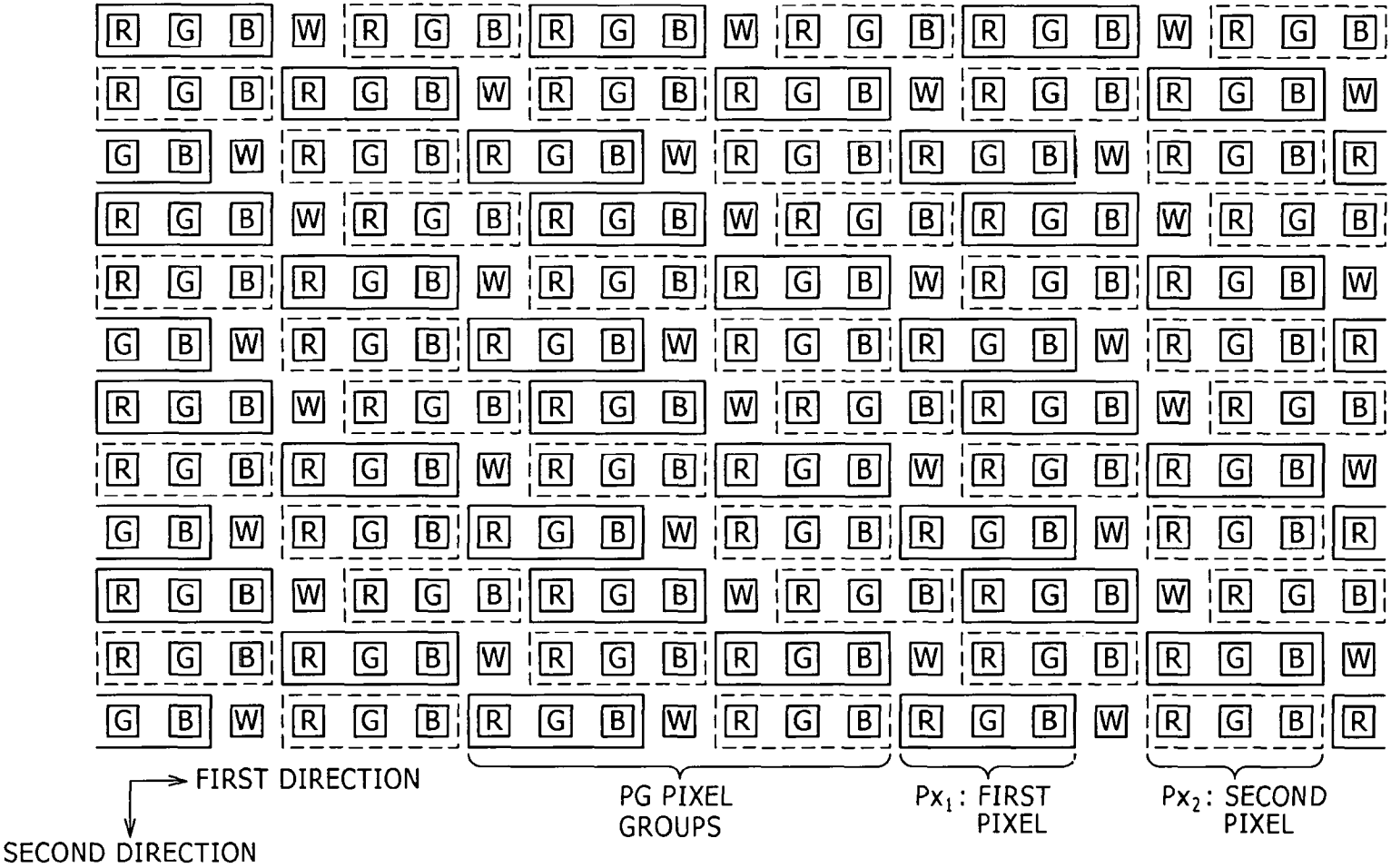
FIG. 15 is a view schematically illustrating different arrangements of pixels and pixel groups on an image display panel of a working example 5 of the present invention.

The working example 5 is a modification to the working example 4. In the working example 5, the array state of the first pixels, second pixels and fourth subpixels W is modified. In particular, in the configuration of the working example 5, as seen in FIG. 15 which schematically illustrates arrangement of the pixels, where the first direction is a row direction and the second direction is a column direction, a first pixel $Px_1$ of the q'th column where $1 \le q' \le Q-1$ and a second pixel $Px_2$ in the (q'+1)th column are disposed adjacent each other, and a fourth subpixel W in the q'th column and a fourth pixel W in the (q'+1)th column are not disposed adjacent each other.

Except this, an image display panel, the driving method for an image display apparatus, an image display apparatus assembly and the driving method for the image display apparatus assembly of the working example 5 can be made similar to those of the working example 4. Therefore, overlapping description of them is omitted herein to avoid redundancy.

Working Example 6

Figure 16:
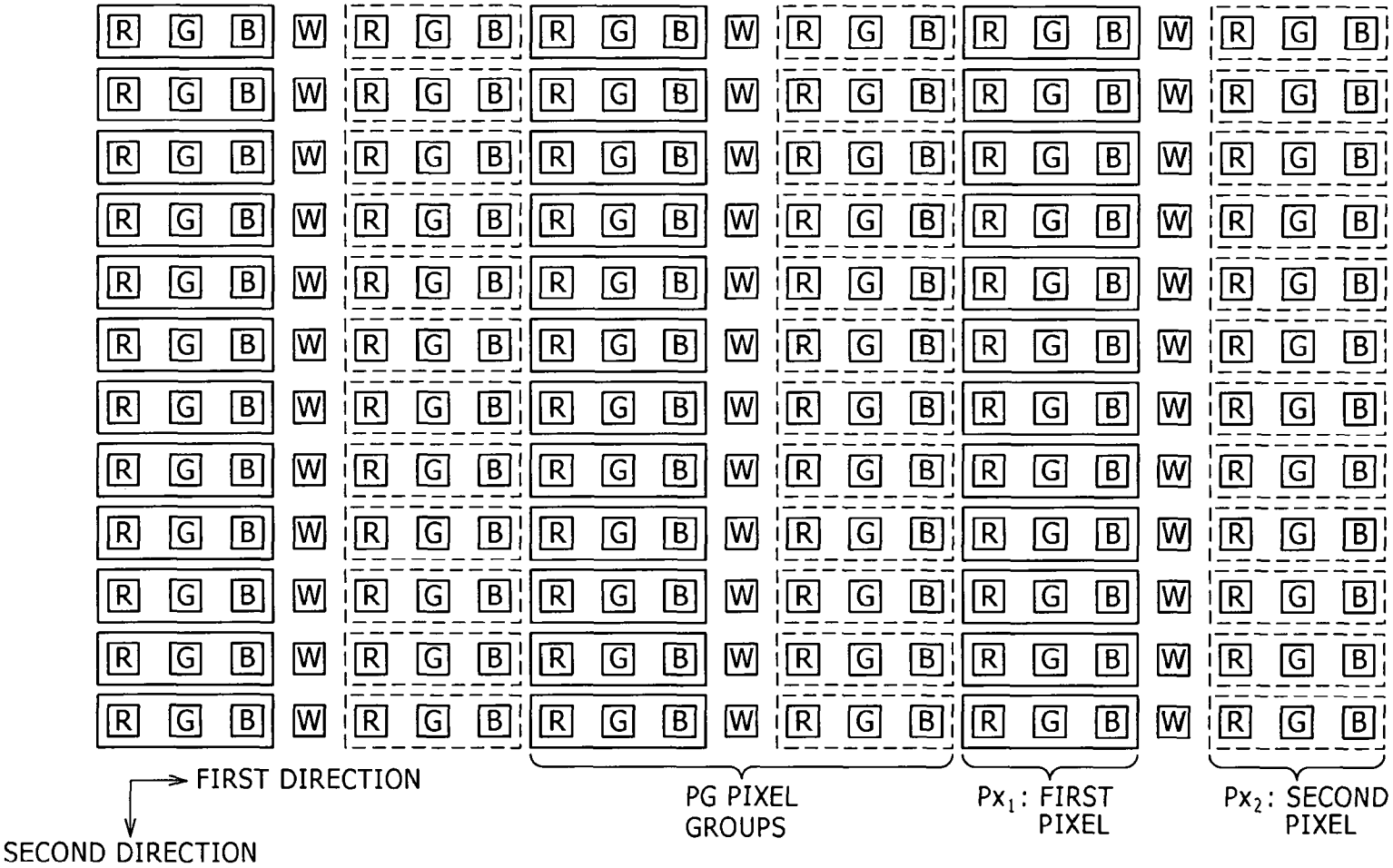
FIG. 16 is a view schematically illustrating different arrangements of pixels and pixel groups on an image display panel of a working example 6 of the present invention.

Also the working example 6 is a modification to the working example 4. Also in the working example 6, the array state of the first pixels, second pixels and fourth subpixels W is modified. In particular, in the configuration of the working example 6, as seen in FIG. 16 which schematically illustrates arrangement of the pixels, where the first direction is a row direction and the second direction is a column direction, a first pixel $Px_1$ of the q'th column where $1 \leq q' \leq Q-1$ and a first pixel $Px_1$ in the (q'+1)th column are disposed adjacent each other, and a fourth subpixel W in the q'th column and a fourth pixel W in the (q'+1)th column are disposed adjacent each other. In the examples illustrated in FIGS. 14 and 16, The first subpixels R, second subpixels G, third subpixels B and fourth subpixels W are arrayed in an array analogous to a stripe array.

Except this, an image display panel, the driving method for an image display apparatus, an image display apparatus assembly and the driving method for the image display apparatus assembly of the working example 6 can be made similar to those of the working example 4. Therefore, overlapping description of them is omitted herein to avoid redundancy.

Figure 19:
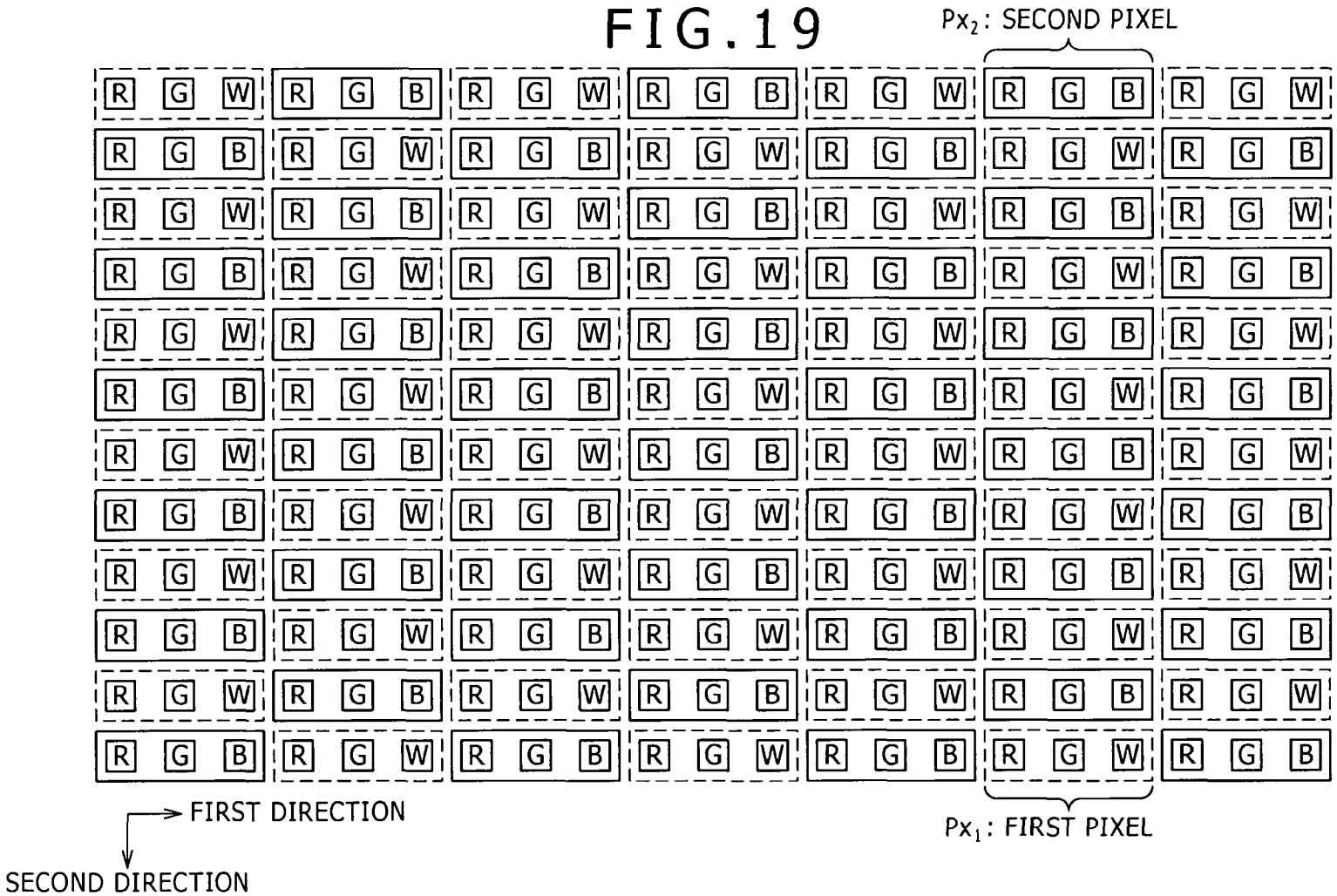
FIG. 19 is a view schematically illustrating different arrangements of pixels and pixel groups on an image display panel of working examples 7, 8, or 10 of the present invention.
Figure 20:
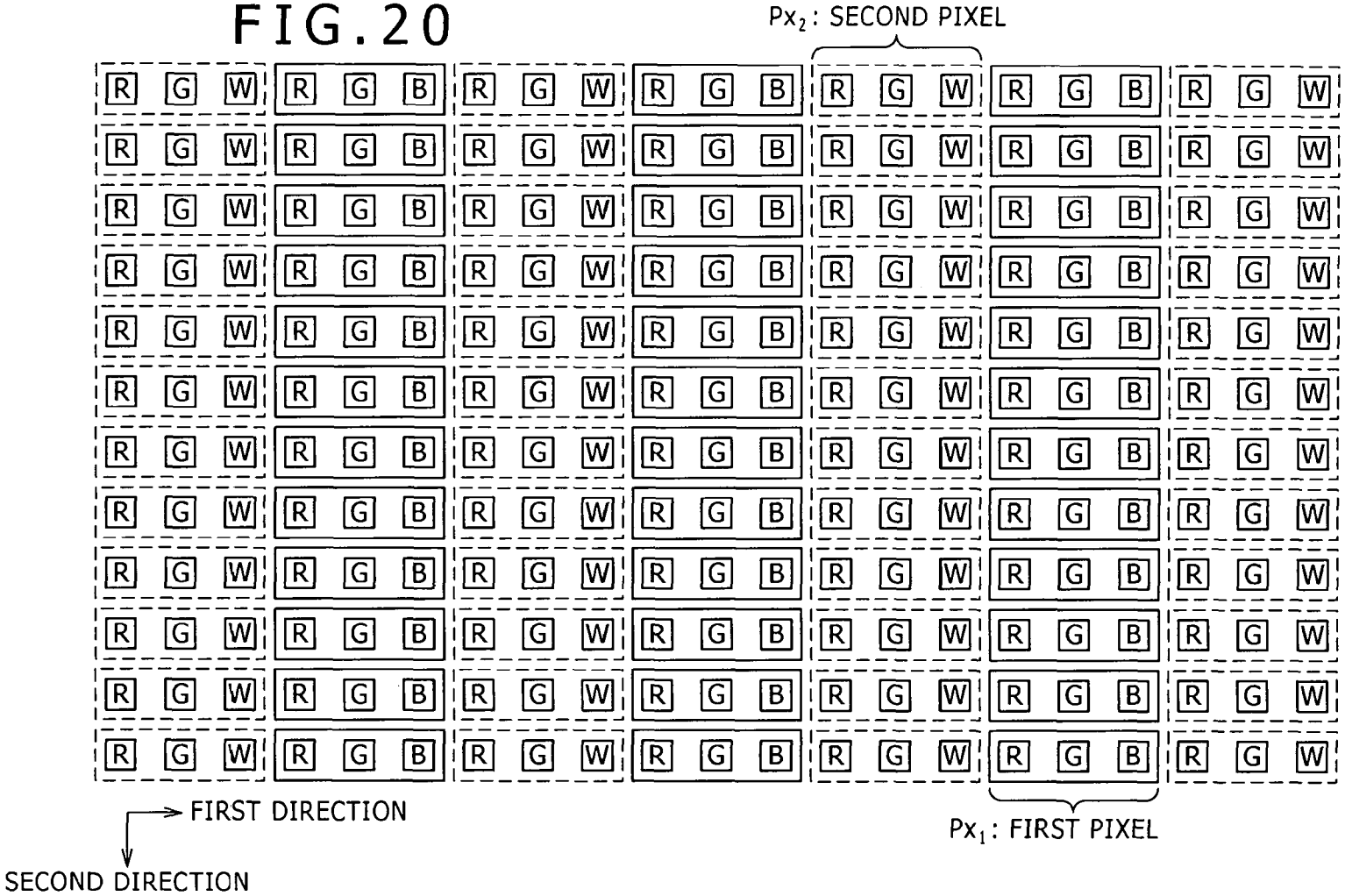
FIG. 20 is another view schematically illustrating different arrangements of pixels and pixel groups on an image display panel of the working example 7, 8, or 10 of the present invention.

The working example 7 relates to a driving method for an image display apparatus according to the third, eight, 13th, 18th and 23rd embodiments of the present invention and a driving method for an image display apparatus assembly according to the third, eight, 13th, 18th and 23rd embodiments of the present invention. FIGS. 19 and 20 are views schematically illustrating different arrangements of pixels and pixel groups on an image display panel of a working example 7 of the present invention.

The image display panel includes totaling P×Q pixel groups PG arrayed in a two-dimensional matrix including P pixel groups arrayed in a first direction and Q pixel groups arrayed in a second direction. Each pixel group PG includes a first pixel and a second pixel along the first direction. Also, the first pixel $Px_1$ includes a first subpixel "R" for displaying a first primary color such as, for example, red, a second subpixel "G" for displaying a second primary color such as, for example, green, and a third subpixel "B" for displaying a third primary color such as, for example, blue. Meanwhile, the second pixel $Px_2$ includes a first subpixel R for displaying the first primary color, a second subpixel G for displaying the second primary color, and a fourth subpixel W for displaying a fourth color such as, for example white. More particularly, in the first pixel $Px_1$, the first subpixel R for displaying the first primary color, the second subpixel G for displaying the second primary color and the third subpixel B for displaying the third primary color are arrayed in order along the first direction. Meanwhile, in the second pixel $Px_2$, the first subpixel R for displaying the first primary color, the second subpixel G for displaying the second primary color and the fourth subpixel W for displaying the fourth color are arrayed in order along the first direction. The third subpixel B which configures the first pixel $Px_1$ and the first subpixel R which configures the second pixel $Px_2$ are positioned adjacent each other. Meanwhile, the fourth subpixel W which configures the second pixel $Px_2$ and the first subpixel R which configures the first pixel $Px_1$ in a pixel group adjacent the pixel group are positioned adjacent each other. It is to be noted that the subpixels have a rectangular shape and are disposed such that the major side thereof extends in parallel to the second direction and the miner side thereof extends in parallel to the first direction.

In the working example 7, the third subpixel B is formed as a subpixel for displaying blue. This is because the visual sensitivity of blue is approximately ⅙ that of the green and, even if the number of subpixels for displaying blue is reduced to one half in the pixel groups, no significant problem occurs. This is similar to the working examples 8 and 10, as described later.

The image display apparatus and the image display apparatus assembly in the working example 7 may be similar to any of the image display apparatus and the image display apparatus assembly described hereinabove in connection with the working examples 1 to 3. In particular, also the image display apparatus 10 of the working example 7 includes, for example, an image display panel and a signal processing section 20. Further, the image display apparatus assembly of the working example 7 includes an image display apparatus 10, and a planar light source apparatus 50 for illuminating, for example, an image display apparatus, particularly an image display panel, from the back side. The signal processing section 20 and the planar light source apparatus 50 in the working example 7 may be similar to the signal processing section 20 and the planar light source apparatus 50 described hereinabove in connection with the working example 1, respectively. This similarly applies also various working examples hereinafter described.

Here in the working example 7, the signal processing section 20, regarding the first pixel $Px_{(p,q)-1}$, receives a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, inputted thereto, and regarding the second pixel $Px_{(p,q)-2}$, the signal processing section 20 receives a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, inputted thereto.

Further, regarding the first pixel $Px_{(p,q)-1}$, the signal processing section 20, regarding the first pixel $Px_{(p,q)-1}$, outputs a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the third subpixel B.

Further, regarding the second pixel $Px_{(p,q)-2}$, the signal processing section 20 outputs a first subpixel output signal having a signal value $x_{1-(p,q)-2}$ for determining a display gradation of the first subpixel R, a second subpixel output signal having a signal value $X_{2-(p,q)-2}$ for determining a display gradation of the second subpixel G, and regarding the fourth subpixel W, a fourth subpixel output signal having a signal value $X_{4-(p,q)-2}$ for determining a display gradation of the fourth subpixel W.

Further, the signal processing section 20 calculates a third subpixel output signal (signal value $X_{3-(p,q)-1}$) to the (p,q)th, where p=1, 2, . . . , P and q=1, 2, . . . , Q as counted along the first direction, first pixel based at least on the third subpixel input signal (signal value $x_{3-(p,q)-1}$) and the third subpixel input signal (signal value $x_{3-(p,q)-2}$) to the (p,q)th second pixel. Then, the signal processing section 20 outputs the third subpixel output signal to the third subpixel B of the (p,q)th first pixel. Further, the signal processing section 20 calculates the fourth subpixel output signal having the signal value $X_{4-(p,q)-2}$ to the (p,q)th second pixel based on a fourth subpixel control second signal having the signal value $SG_{2-(p,q)}$ calculated from the first subpixel input signal having the signal value $x_{1-(p,q)-2}$, second subpixel input signal having the signal value $x_{2-(p,q)-2}$ and third subpixel input signal having the $x_{3-(p,q)-2}$ and a fourth pixel control first signal having the signal value $SG_{1-(p,q)}$ calculated from the first subpixel input signal, second subpixel input signal and third subpixel input signal to the adjacent pixel disposed adjacent the (p,q)th second pixel along the first direction. Then, the signal processing section 20 outputs the calculated fourth subpixel output signal to the fourth subpixel W of the (p,q)th second pixel.

While the adjacent pixel here is disposed adjacent the (p,q)th second pixel along the first direction, in the working example 7, the adjacent pixel particularly is the (p,q)th first pixel. Accordingly, the fourth subpixel control first signal having the signal value $SG_{1-(p,q)}$ is calculated based on the first subpixel input signal having the signal value $x_{1-(p,q)-1}$, second subpixel input signal having the signal value and third subpixel input signal having the signal value $x_{3-(p,q)-1}$.

It is to be noted that, regarding the arrangement of the first and second pixels, the image display panel may be configured such that totaling P×Q pixel groups PG are arrayed in a two-dimensional matrix such that P pixel groups PG are arrayed in the first direction and Q pixel groups PG are arrayed in the second direction and a first pixel $Px_1$ and a second pixel $Px_2$ are disposed adjacent each other along the second direction as seen in FIG. 19. Or, the image display panel may be configured such that a first pixel $Px_1$ and another first pixel $Px_1$ are disposed adjacent each other along the second direction and besides a second pixel $Px_2$ and another second pixel $Px_2$ are disposed adjacent each other along the second direction.

In the working example 7, particularly the fourth subpixel control first signal value $SG_{1-(p,q)}$ is calculated based on $Min_{(p,q)-1}$ and the expansion coefficient $\alpha_0$ while the fourth subpixel control second signal value $SG_{2-(p,q)}$ is calculated based on $Min_{(p,q)-2}$ and the expansion coefficient $\alpha_0$. More particularly, the fourth subpixel control first signal value $SG_{1-(p,q)}$ and the fourth subpixel control second signal value $SG_{2-(p,q)}$ are calculated using expressions (41-1) and (41-2) similarly to the working example 4, respectively.

$$SG_{1-(p,q)}=Min_{(p,q)-1}\cdot\alpha_0 \tag{41-1}$$

$$SG_{2-(p,q)}=Min_{(p,q)-2}\cdot\alpha_0 \tag{41-2}$$

Further, regarding the second pixel $P_{x(p,q)-2}$, the signal processing section 20 calculates, while it calculates the first subpixel output signal based at least on the first subpixel input signal and the expansion coefficient $\alpha_0$, the first subpixel output signal value $X_{1-(p,q)-2}$ based on the first subpixel input signal value $x_{1-(p,q)-2}$, expansion coefficient $\alpha_0$, fourth subpixel control second signal value $SG_{2-(p,q)}$ and constant $\chi$, that is, based on $$[x_{1-(p,q)-2},\alpha_0,SG_{2-(p,q)},\chi]$$

calculates, while it calculates the second subpixel output signal based at least on the second subpixel input signal and the expansion coefficient $\alpha_0$, the second subpixel output signal value $X_{2-(p,q)-2}$ based on the second subpixel input signal value $x_{2-(p,q)-2}$, expansion coefficient $\alpha_0$, fourth subpixel control second signal value $SG_{2-(p,q)}$ and constant $\chi$, that is, based on $$[x_{2-(p,q)-2},\alpha_0,SG_{2-(p,q)},\chi]$$

and further calculates, regarding the first pixel $Px_{(p,q)-1}$, while it calculates the first subpixel output signal based at least on the first subpixel input signal and the expansion coefficient $\alpha_0$, the first subpixel output signal value $x_{1-(p,q)-1}$ based on the first subpixel input signal value $x_{1-(p,q)-1}$, expansion coefficient $\alpha_0$, fourth subpixel control first signal value $SG_{1-(p,q)}$ and constant $\chi$, that is, based on $$[x_{1-(p,q)-1},\alpha_0,SG_{1-(p,q)},\chi]$$

and regarding the second pixel $Px_{(p,q)-2}$, the signal processing section 20 calculates, while it calculates the second subpixel output signal based at least on the second subpixel input signal and the expansion coefficient $\alpha_0$, the second subpixel output signal value $X_{2-(p,q)-1}$ based on the second subpixel input signal value $x_{2-(p,q)-1}$, expansion coefficient $\alpha_0$, fourth subpixel control first signal value $SG_{1-(p,q)}$ and constant $\chi$, that is, based on $$[x_{2-(p,q)-2},\alpha_0,SG_{1-(p,q)},\chi]$$

calculates, while it calculates the third subpixel output signal based at least on the third subpixel input signal and the expansion coefficient $\alpha_0$, the third subpixel output signal value $X_{3-(p,q)-2}$ based on the third subpixel input signal value $x_{3-(p,q)-1}$, $x_{3-(p,q)-2}$, expansion coefficient $\alpha_0$, fourth subpixel control first signal value $SG_{1-(p,q)}$, fourth subpixel control second signal value $SG_{2-(p,q)}$ and constant $\chi$, that is, based on $$[x_{3-(p,q)-1},x_{3-(p,q)-2},\alpha_0,SG_{1-(p,q)},SG_{2-(p,q)},X_{4-(p,q)-2},\chi]$$

In particular, in the signal processing section 20, the output signal values $X_{1-(p,q)-2}$, $X_{2-(p,q)-2}$, $X_{1-(p,q)-1}$, $X_{2-(p,q)-1}$ and $X_{3-(p,q)-1}$, as described above, can be calculated based on the expansion coefficient $\alpha_0$ and the constant $\chi$. More particularly, the output signal values mentioned can be calculated from the following expressions (3-A) to (3-D) and (3-a'), (3-d), and (3-e).

$$X_{1-(p,q)-2}=\alpha_0\cdot x_{1-(p,q)-2}-\chi\cdot SG_{2-(p,q)} \tag{3-A}$$

$$X_{2-(p,q)-2}=\alpha_0\cdot x_{2-(p,q)-2}-\chi\cdot SG_{2-(p,q)} \tag{3-B}$$

$$X_{1-(p,q)-1}=\alpha_0\cdot x_{1-(p,q)-1}-\chi\cdot SG_{1-(p,q)} \tag{3-C}$$

$$X_{2-(p,q)-1}=\alpha_0\cdot x_{2-(p,q)-1}-\chi\cdot SG_{1-(p,q)} \tag{3-D}$$

$$X_{3-(p,q)-1}=(X'_{3-(p,q)-1}+X'_{3-(p,q)-2})/2 \tag{3-a'}$$

where $$X'_{3-(p,q)-1}=\alpha_0\cdot x_{3-(p,q)-1}-\chi\cdot SG_{1-(p,q)} \tag{3-d}$$

$$X'_{3-(p,q)-2}=\alpha_0\cdot x_{3-(p,q)-2}-\chi\cdot SG_{2-(p,q)} \tag{3-e}$$

Further, the signal value $X_{4-(p,q)-2}$ is calculated based on an expression of arithmetic mean, that is, based on expressions (71-1) and (71-2) similar to the expressions (42-1) and (42-2), respectively, similarly as in the working example 4.

Further, the signal value $X_{4-(p,q)}$ is calculated from expressions (42-1) and (42-2) of arithmetic mean based on the expression (2-11), that is, from $$X_{4-(p,q)-2} = (SG_{1-(p,q)} + SG_{2-(p,q)})/(2\chi) \quad (71\text{-}1)$$

$$= (\mathrm{Min}_{(p,q)-1} \cdot \alpha_0 + \mathrm{Min}_{(p,q)-2} \cdot \alpha_0)/(2\chi) \quad (71\text{-}2)$$

Here, the expansion coefficient $\alpha_0$ is determined for every one image display frame.

Also in the working example 7, a maximum value $V_{max}$ (S) of the brightness where the saturation S in an HSV color space expanded by addition of a fourth color (white) is variable is stored into the signal processing section 20. In other words, by addition of a fourth color (white), the dynamic range of the brightness in the HSV color space is expanded.

In the following, a method (expansion process) of calculating the output signal values $X_{1-(p,q)-2}$, $X_{2-(p,q)-2}$, $X_{4-(p,q)-2}$, $X_{1-(p,q)-1}$, $X_{2-(p,q)-1}$, and $X_{3-(p,q)-1}$ of the (p,q)th pixel $Px_{(p,q)}$. It is to be noted that the following process is carried out so as to keep, in the whole of the first pixel and the second pixel, that is, in each pixel group, the ratio among the luminance, similarly to the working example 4. Besides, the process is carried out so as to keep or maintain the color tone as far as possible. Furthermore, the process is carried out so as to keep or maintain the gradation-luminance characteristic, that is, the gamma characteristic or γ characteristic).

Step 700

First, as similar to Step 400 in working example 4, the signal processing section 20 calculates the saturation S and the brightness V(S) of a plurality of pixel groups $PG_{(p,q)}$ based on subpixel input signal values to a plurality of pixels. In particular, the signal processing section 20 calculates the saturation $S_{(p,q)-1}$ and $S_{(p,q)-2}$ and the brightness $V(S)_{(p,q)-1}$ and $V(S)_{(p,q)-2}$ from expressions substantially same as the expressions (43-1) to (43-4) based on the input signal value $x_{1-(p,q)-1}$, $x_{1-(p,q)-2}$ of the first subpixel input signal, the input signal value $x_{2-(p,q)-1}$, $x_{2-(p,q)-2}$ of the second pixel input signal and the input signal value $x_{3-(p,q)-1}$, $x_{3-(p,q)-2}$ of the third subpixel input signal to the (p,q)th pixel group $PG_{(p,q)}$. This process is carried out for all pixel groups $PG_{(p,q)}$.

Step 710

Then, the signal processing section 20 determines the expansion coefficient $\alpha_0$ from the value of $V_{max}(S)/V(S)$ calculated with regard to a plurality of pixel group $PG_{(p,q)}$ from a predetermined value $\beta_0$ in a similar manner as in the working example 1. Or, the expansion coefficient $\alpha_0$ is determined based on the provisions of the expression (15-2), expressions (16-1) to (16-5) or expressions (17-1) to (17-6).

Step 720

Thereafter, the signal processing section 20 calculates the fourth subpixel control first signal value $SG_{1-(p,q)}$ and the fourth subpixel control second signal value $SG_{2-(p,q)}$ for each of the pixel groups $PG_{(p,q)}$ based on the expressions (41-1) and (41-2), respectively. This process is carried out for all pixel groups $PG_{(p,q)}$. Further, the signal processing section 20 calculates the fourth subpixel output signal value $X_{4-(p,q)-2}$ based on the expression (71-2). Furthermore, the signal processing section 20 calculates $X_{1-(p,q)-2}$, $X_{2-(p,q)-2}$, $X_{1-(p,q)-1}$, $x_{2-(p,q)-1}$ and $X_{3-(p,q)-1}$. This operation is carried out for all of the P×Q pixel groups $PG_{(p,q)}$. Then, the signal processing section 20 supplies output signals having the output signal values calculated in this manner to the respective subpixels.

It is to be noted that, since the ratios of the output signal values at the first pixel and second pixel in each pixel group $$X_{1-(p,q)-1}:X_{2-(p,q)-1}:X_{3-(p,q)-1}$$

$$X_{1-(p,q)-2}:X_{2-(p,q)-2}$$

are a little different from the ratios of the input signal values $$x_{1-(p,q)-1}:x_{2-(p,q)-1}:x_{3-(p,q)-1}$$

$$x_{1-(p,q)-2}:x_{2-(p,q)-2}$$

if each pixel is viewed solely, then some difference occurs with the color tone among the pixels with respect to the input signal. However, when the pixels are observed as a pixel group, no problem occurs with the color tone of the pixel group. This similarly applies also to the description given below.

As well as working example 7, what is significant here resides in that the value of $\mathrm{Min}_{(p,q)-1}$ and $\mathrm{Min}_{(p,q)-2}$ is expanded by the expansion coefficient $\alpha_0$ as indicated by the expressions (41-1), (41-2) and (71-2). Since the value of $\mathrm{Min}_{(p,q)-1}$ and $\mathrm{Min}_{(p,q)-2}$ is expanded by the expansion coefficient $\alpha_0$ in this manner, not only the luminance of the white display subpixel (the fourth subpixel W) increases, but also the luminance of the red display subpixel, green display subpixel and blue display subpixel (the first subpixel R, second subpixel G and third subpixel B) increases as indicated by the expressions (3-A) to (3-D), and (3-a'). Therefore, occurrence of such a problem that darkening in color occurs can be prevented with certainty. In particular, the luminance of an entire image increases to $\alpha_0$ times by expanding the value of $\mathrm{Min}_{(p,q)-1}$ and $\mathrm{Min}_{(p,q)-2}$ by the expansion coefficient $\alpha_0$ in comparison with the alternative case in which the value of $\mathrm{Min}_{(p,q)-1}$ and $\mathrm{Min}_{(p,q)-2}$ is not expanded. Accordingly, for example, image display of a still picture or the like can be carried out with a high luminance favorably. This is similar to the working examples 8 and 10, described later.

In the driving method for an image display apparatus or the driving method for an image display apparatus assembly of the working example 7, the signal processing section 20 calculates a fourth subpixel output signal based on a fourth subpixel control first signal value $SG_{1-(p,q)}$ and a fourth subpixel control second signal value $SG_{2-(p,q)}$ calculated from a first subpixel input signal, a second subpixel input signal and a third subpixel input signal and outputs the calculated fourth subpixel output signal to the first pixel $Px_1$ and second pixel $Px_2$ of each pixel group PG. In particular, since the fourth subpixel output signal is calculated based on input signals to the first pixel $Px_1$ and the second pixel $Px_2$ which are positioned adjacent each other, optimization of the output signal to the fourth subpixel W is achieved. Besides, since one third subpixel B and one fourth subpixel W are disposed also for a pixel group PG which is configured at least from the first pixel $Px_1$ and the second pixel $Px_2$, reduction of the area of the aperture region of the subpixels can be more suppressed. As a result, increase of the luminance can be achieved with certainty and improvement in display quality can also be achieved.

Incidentally, in the case where the difference between $\mathrm{Min}_{(p,q)-1}$ of the first pixel $P_{x(p,q)-1}$ and $\mathrm{Min}_{(p,q)-2}$ of the second pixel $Px_{(p,q)-2}$ is great, if the expression (71-2) is used, then there are instances in which the luminance of the fourth subpixel W does not increase to a desired degree. In such an instance, preferably the expressions (2-12), (2-13) and (2-14) are adopted in place of the expression (71-2) to calculate the signal value $x_{4-(p,q)-2}$. What expression should used to obtain $X_{4-(p,q)-2}$ may be determined suitably by making a prototype of the image display apparatus or the image display apparatus assembly and carrying out evaluation of images, for example, by an image observer.

A relationship between the input signals and the output signals of the pixel groups in the working example 7 described hereinabove and the working example 8 which is described subsequently is indicated in Table 3 below.

Working Example 7

| | Pixel group | | | |
|---|---|---|---|---|
| | (p, q) | | (p + 1, q) | |
| | Pixel | | | |
| | First pixel | Second pixel | First pixel | Second pixel |
| Input signal | $x_{1-(p,q)-1}$ | $x_{1-(p,q)-2}$ | $x_{1-(p+1,q)-1}$ | $x_{1-(p+1,q)-2}$ |
| | $x_{2-(p,q)-1}$ | $x_{2-(p,q)-2}$ | $x_{2-(p+1,q)-1}$ | $x_{2-(p+1,q)-2}$ |
| | $x_{3-(p,q)-1}$ | $x_{3-(p,q)-2}$ | $x_{3-(p+1,q)-1}$ | $x_{3-(p+1,q)-2}$ |
| Output signal | $X_{1-(p,q)-1}$ | $X_{1-(p,q)-2}$ | $X_{1-(p+1,q)-1}$ | $X_{1-(p+1,q)-2}$ |
| | $X_{2-(p,q)-1}$ | $X_{2-(p,q)-2}$ | $X_{2-(p+1,q)-1}$ | $X_{2-(p+1,q)-2}$ |
| | $X_{3-(p,q)-1}$ | | $X_{3-(p+1,q)-1}$ | |
| | $:(x_{3-(p,q)-1} + x_{3-(p,q)-2})/2$ | | $:(x_{3-(p+1,q)-1} + x_{3-(p+1,q)-2})/2$ | |
| | | $X_{4-(p,q)-2}$ | | $X_{4-(p+1,q)-2}$ |
| | $:(SG_{1-(p,q)} + SG_{2-(p,q)})/2$ | | $:(SG_{1-(p+1,q)} + SG_{2-(p+1,q)})/2$ | |

| | Pixel group | | | |
|---|---|---|---|---|
| | (p + 2, q) | | (p + 3, q) | |
| | Pixel | | | |
| | First pixel | Second pixel | First pixel | Second pixel |
| Input signal | $x_{1-(p+2,q)-1}$ | $x_{1-(p+2,q)-2}$ | $x_{1-(p+3,q)-1}$ | $x_{1-(p+3,q)-2}$ |
| | $x_{2-(p+2,q)-1}$ | $x_{2-(p+2,q)-2}$ | $x_{2-(p+3,q)-1}$ | $x_{2-(p+3,q)-2}$ |
| | $x_{3-(p+2,q)-1}$ | $x_{3-(p+2,q)-2}$ | $x_{3-(p+3,q)-1}$ | $x_{3-(p+3,q)-2}$ |
| Output signal | $X_{1-(p+2,q)-1}$ | $X_{1-(p+2,q)-2}$ | $X_{1-(p+3,q)-1}$ | $X_{1-(p+3,q)-2}$ |
| | $X_{2-(p+2,q)-1}$ | $X_{2-(p+2,q)-2}$ | $X_{2-(p+3,q)-1}$ | $X_{2-(p+3,q)-2}$ |
| | $X_{3-(p+2,q)-1}$ | | $X_{3-(p+3,q)-1}$ | |
| | $:(x_{3-(p+2,q)-1} + x_{3-(p+2,q)-2})/2$ | | $:(x_{3-(p+3,q)-1} + x_{3-(p+3,q)-2})/2$ | |
| | | $X_{4-(p+2,q)-2}$ | | $X_{4-(p+3,q)-2}$ |
| | $:(SG_{1-(p+2,q)} + SG_{2-(p+2,q)})/2$ | | $:(SG_{1-(p+3,q)} + SG_{2-(p+3,q)})/2$ | |

Working Example 8

| | Pixel group | | | |
|---|---|---|---|---|
| | (p, q) | | (p + 1, q) | |
| | Pixel | | | |
| | First pixel | Second pixel | First pixel | Second pixel |
| Input signal | $x_{1-(p,q)-1}$ | $x_{1-(p,q)-2}$ | $x_{1-(p+1,q)-1}$ | $x_{1-(p+1,q)-2}$ |
| | $x_{2-(p,q)-1}$ | $x_{2-(p,q)-2}$ | $x_{2-(p+1,q)-1}$ | $x_{2-(p+1,q)-2}$ |
| | $x_{3-(p,q)-1}$ | $x_{3-(p,q)-2}$ | $x_{3-(p+1,q)-1}$ | $x_{3-(p+1,q)-2}$ |
| Output signal | $X_{1-(p,q)-1}$ | $X_{1-(p,q)-2}$ | $X_{1-(p+1,q)-1}$ | $X_{1-(p+1,q)-2}$ |
| | $X_{2-(p,q)-1}$ | $X_{2-(p,q)-2}$ | $X_{2-(p+1,q)-1}$ | $X_{2-(p+1,q)-2}$ |
| | $X_{3-(p,q)-1}$ | | $X_{3-(p+1,q)-1}$ | |
| | $:(x_{3-(p,q)-1} + x_{3-(p,q)-2})/2$ | | $:(x_{3-(p+1,q)-1} + x_{3-(p+1,q)-2})/2$ | |
| | | $X_{4-(p,q)-2}$ | | $X_{4-(p+1,q)-2}$ |
| | $:(SG_{2-(p,q)} + SG_{1-(p+1,q)})/2$ | | $:(SG_{2-(p+1,q)} + SG_{1-(p+2,q)})/2$ | |

-continued

| | Pixel group | | | |
|---|---|---|---|---|
| | (p + 2, q) | | (p + 3, q) | |
| | Pixel | | | |
| | First pixel | Second pixel | First pixel | Second pixel |
| Input signal | $x_{1-(p+2,q)-1}$ | $x_{1-(p+2,q)-2}$ | $x_{1-(p+3,q)-1}$ | $x_{1-(p+3,q)-2}$ |
| | $x_{2-(p+2,q)-1}$ | $x_{2-(p+2,q)-2}$ | $x_{2-(p+3,q)-1}$ | $x_{2-(p+3,q)-2}$ |
| | $x_{3-(p+2,q)-1}$ | $x_{3-(p+2,q)-2}$ | $x_{3-(p+3,q)-1}$ | $x_{3-(p+3,q)-2}$ |
| Output signal | $X_{1-(p+2,q)-1}$ | $X_{1-(p+2,q)-2}$ | $X_{1-(p+3,q)-1}$ | $X_{1-(p+3,q)-2}$ |
| | $X_{2-(p+2,q)-1}$ | $X_{2-(p+2,q)-2}$ | $X_{2-(p+3,q)-1}$ | $X_{2-(p+3,q)-2}$ |
| | $X_{3-(p+2,q)-1}$ | | $X_{3-(p+3,q)-1}$ | |
| | $:(x_{3-(p+2,q)-1} + x_{3-(p+2,q)-2})/2$ | | $:(x_{3-(p+3,q)-1} + x_{3-(p+3,q)-2})/2$ | |
| | | $X_{4-(p+2,q)-2}$ | | $X_{4-(p+3,q)-2}$ |
| | $:(SG_{2-(p+2,q)} + SG_{1-(p+3,q)})/2$ | | $:(SG_{2-(p+3,q)} + SG_{1-(p+4,q)})/2$ | |

Working Example 8

The working example 8 is a modification to the working example 7. In the working example 7, the adjacent pixel is disposed adjacent the (p,q)th second pixel along the first direction. On the other hand, in the working example 8, the adjacent pixel is the (p+1,q)th first pixel. The arrangement of pixels in the working example 8 is similar to that in the working example 7 and same as that schematically shown in FIG. 19 or 20.

In the example shown in FIG. 19, a first pixel and a second pixel are disposed adjacent each other along the second direction. In this instance, the first subpixel R which configures the first pixel and the first subpixel R which configures the second pixel may be disposed adjacent each other or may not be disposed adjacent each other. Similarly, the second subpixel G which configures the first pixel and the second subpixel G which configures the second pixel may be disposed adjacent each other or may not be disposed adjacent each other along the second direction. Similarly, the third subpixel B which configures the first pixel and the fourth subpixel W which configures the second pixel may be disposed adjacent each other or may not be disposed adjacent each other along the second direction. On the other hand, in the example shown in FIG. 20, a first pixel and another first pixel are disposed adjacent each other and a second pixel and another second pixel are disposed adjacent each other along the second direction. Also in this instance, the first subpixel R which configures the first pixel and the first subpixel R which configures the second pixel may be disposed adjacent each other or may not be disposed adjacent each other along the second direction. Similarly, the second subpixel G which configures the first pixel and the second subpixel G which configures the second pixel may be disposed adjacent each other or may not be disposed adjacent each other along the second direction. Similarly, the third subpixel B which configures the first pixel and the fourth subpixel W which configures the second pixel may be disposed adjacent each other or may not be disposed adjacent each other along the second direction. This is similar to the working examples 7 and 10 described later.

Similarly to the working example 7, the signal processing section 20

(1) calculates a first subpixel output signal to the first pixel $Px_1$ based at least on a first subpixel input signal to the first pixel $Px_1$ and an expansion coefficient $\alpha_0$ and outputs the calculated first subpixel output signal to the first subpixel R of the first pixel $Px_1$;

(2) calculates a second subpixel output signal to the first pixel $Px_1$ based at least on a second subpixel input signal to the first pixel $Px_1$ the expansion coefficient $\alpha_0$ and outputs the calculated second subpixel output signal to the second subpixel G of the first pixel $Px_1$;

(3) calculates a first subpixel output signal to the second pixel $Px_2$ based at least on a first subpixel input signal to the second pixel $Px_2$ the expansion coefficient $\alpha_0$ and outputs the calculated first subpixel output signal to the first subpixel R of the second pixel $Px_2$; and (4) calculates a second subpixel output signal to the second pixel $Px_2$ based at least on a second subpixel input signal to the second pixel $Px_2$ the expansion coefficient $\alpha_0$ and outputs the calculated second subpixel output signal to the second subpixel G of the second pixel $Px_2$.

Here in the working example 8, similarly to the working example 7, regarding the first pixel $Px_{(p,q)-1}$ which configures the (p,q)th pixel group $PG_{(p,q)}$ where $1 \le p \le P$ and $1 \le q \le Q$, the signal processing section 20 receives a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, inputted thereto, and regarding the second pixel $Px_{(p,q)-2}$ which configures the (p,q)th pixel group $PG_{(p,q)}$, the signal processing section 20 receives a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, inputted thereto.

Further, similarly to the working example 7, with regard to the first pixel $Px_{(p,q)-1}$ which configures the (p,q)th pixel group $PG_{(p,q)}$, the signal processing section 20 outputs a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the third subpixel B.

Further, with regard to the second pixel $Px_{(p,q)-2}$ which configures the (p,q)th pixel group $PG_{(p,q)}$, the signal processing section 20 outputs a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, and a fourth subpixel output signal having a signal value $X_{4-(p,q)-2}$ for determining a display gradation of the fourth subpixel W.

In the working example 8, similarly to the working example 7, the signal processing section 20 calculates a third subpixel output signal value $X_{3-(p,q)-1}$ to the (p,q)th first pixel $Px_{(p,q)-1}$ based at least on the third subpixel input signal value $x_{3-(p,q)-1}$ to the (p,q)th first pixel $Px_{(p,q)-1}$ and the third subpixel input signal value $x_{3-(p,q)-2}$ to the (p,q)th second pixel $Px_{(p,q)-2}$ and outputs the third subpixel output signal value $x_{3-(p,q)-1}$ to the third subpixel B. On the other hand, different from the working example 7, the signal processing section 20 calculates a fourth subpixel output signal value $X_{4-(p,q)-2}$ based on a fourth subpixel control second signal value $SG_{2-(p,q)}$ obtained from the first subpixel input signal value $x_{1-(p,q)-2}$ the second subpixel input signal value $x_{2-(p,q)-2}$, and the third subpixel input signal value $x_{3-(p,q)-2}$ to the (p,q)th second pixel $Px_{(p,q)-2}$ as well as based on a fourth subpixel control first signal value $SG_{1-(p,q)}$ obtained from the first subpixel input signal value $x_{1-(p',q)}$, the second subpixel input signal value $X_{2-(p',q)}$ and the third subpixel input signal value $x_{3-(p',q)}$ to the (p+1, q) th first pixel $Px_{(p+1,q)-1}$ and outputs the fourth subpixel output signal value $X_{4-(p,q)-2}$ to the fourth subpixel W.

Meanwhile, the output signal values $X_{4-(p,q)-2}$, $X_{1-(p,q)-2}$, $X_{2-(p,q)-1}$, $X_{1-(p,q)-1}$, $X_{2-(p,q)-1}$ and $X_{3-(p,q)-1}$ are calculated from expressions (71-2), (3-A), (3-B), (3-E), (3-F), (3-a'), (3-f), (3-g), (41'-1), (41'-2) and (41'-3) given below.

$$X_{1-(p,q)-2}=\alpha_0 \cdot x_{1-(p,q)-2}-\chi \cdot SG_{2-(p,q)} \quad (3\text{-A})$$

$$X_{2-(p,q)-2}=\alpha_0 \cdot x_{2-(p,q)-2}-\chi \cdot SG_{2-(p,q)} \quad (3\text{-B})$$

$$X_{1-(p,q)-1}=\alpha_0 \cdot x_{1-(p,q)-1}-\chi \cdot SG_{3-(p,q)} \quad (3\text{-E})$$

$$X_{2-(p,q)-1}=\alpha_0 \cdot x_{2-(p,q)-1}-\chi \cdot SG_{3-(p,q)} \quad (3\text{-F})$$

$$X_{3-(p,q)-1}=(X'_{3-(p,q)-1}+X'_{3-(p,q)-2})/2 \quad (3\text{-a}')$$

$$X'_{3-(p,q)-1}=\alpha_0 \cdot x_{3-(p,q)-1}-\chi \cdot SG_{3-(p,q)} \quad (3\text{-f})$$

$$X'_{3-(p,q)-2}=\alpha_0 \cdot x_{3-(p,q)-2}-\chi \cdot SG_{2-(p,q)} \quad (3\text{-g})$$

$$SG_{2-(p,q)}=\mathrm{Min}_{(p,q)-2} \cdot \alpha_0 \quad (41'\text{-2})$$

$$SG_{1-(p,q)}=\mathrm{Min}_{(p',q)-2} \cdot \alpha_0 \quad (41'\text{-1})$$

$$SG_{3-(p,q)}=\mathrm{Min}_{(p,q)-1} \cdot \alpha_0 \quad (41'\text{-3})$$

In the following, a method of calculating the output signal values $X_{1-(p,q)-2}$, $X_{2-(p,q)-2}$, $X_{4-(p,q)-2}$, $X_{1-(p,q)-1}$, $X_{2-(p,q)-1}$ and $X_{3-(p,q)-1}$ of the (p,q)th pixel group $PG_{(p,q)}$, that is, an expansion process, is described. It is to be noted that the following process is carried out such that the gradation-luminance characteristic, that is, the gamma characteristic or γ characteristic, is maintained. Further, in the following process, the process described below is carried out so as to keep the ratio on luminance as far as possible over all of the first and second pixels, that is, over all pixel groups. Besides, the process is carried out so as to keep or maintain the color tone as far as possible.

Step 800

First, the signal processing section 20 calculates the saturation S and the brightness V(S) of a plurality of pixel groups based on subpixel input signal values to a plurality of pixels. In particular, the signal processing section 20 calculates the saturation $S_{(p,q)-1}$ and $S_{(p,q)-2}$ and the brightness $V(S)_{(p,q)-1}$ and $V(S)_{(p,q)-2}$ from expressions substantially same as the expressions (43-1) to (43-4) based on the signal value $x_{1-(p,q)-1}$ of the first subpixel input signal, the signal value $x_{2-(p,q)-1}$ of the second pixel input signal and the signal value $x_{3-(p,q)-1}$ of the third subpixel input signal to the (p,q)th first pixel $Px_{(p,q)-1}$ and the signal value $x_{1-(p,q)-2}$ of the first subpixel input signal, the signal value $x_{2-(p,q)-2}$ of the second pixel input signal and the signal value $x_{3-(p,q)-2}$ of the third subpixel input signal to the (p,q)th second pixel $Px_{(p,q)-2}$. This process is carried out for all pixel groups.

Step 810

Then, the signal processing section 20 determines the expansion coefficient $\alpha_0$ from the value of $V_{max}(S)/V(S)$ calculated with regard to a plurality of pixel group from a predetermined value $\beta_0$ in a similar manner as in the working example 1. Or, the expansion coefficient $\alpha_0$ is determined based on the provisions of the expression (15-2), expressions (16-1) to (16-5) or expressions (17-1) to (17-6).

Step 820

Then, the signal processing section 20 calculates the fourth subpixel output signal value $X_{4-(p,q)-2}$ of the (p,q)th pixel group $PG_{(p,q)}$ from the expression (71-1) given hereinabove. The step 810 and the step 820 may be executed simultaneously.

Step 830

Then, the signal processing section 20 calculates the output signal value $X_{1-(p,q)-2}$, $X_{2-(p,q)-2}$, $X_{2-(p,q)-1}$ and $X_{3-(p,q)-1}$ of the (p,q)th pixel group based on the expressions (3-A), (3-B), (3-E), (3-F), (3-a'), (3-f), (3-g), (41'-1), (41'-2) and (41'-3) given hereinabove. It is to be noted that, the step 810 and the step 820 may be executed at the same time or the step 820 may be executed after the step 810 is carried out.

An alternative configuration may be adopted wherein, in the case where the fourth subpixel control first signal value $SG_{1-(p,q)}$ and the fourth subpixel control second signal value $SG_{2-(p,q)}$ satisfy a certain condition, for example, the working example 7 is executed, but in the case where the fourth subpixel control first signal value $SG_{1-(p,q)}$ and the fourth subpixel control second signal value $SG_{2-(p,q)}$ do not satisfy the certain condition, for example, the working example 8 is executed. For example, in the case where a process based on $$X_{4-(p,q)-2}=(SG_{1-(p,q)}+SG_{2-(p,q)})/2\chi$$

is to be carried out, if the value of $|SG_{1-(p,q)}+SG_{2-(p,q)}|$ is equal to or higher than (or equal to or lower than) a predetermined value $\Delta X_1$, the working example 7 may be executed, but in any other case, the working example 8 may be executed. Or else, for example, if the value of $|SG_{1-(p,q)}+SG_{2-(p,q)}|$ is equal to or higher than (or equal to or lower than) the predetermined value $\Delta X_1$, then a value based only on $SG_{1-(p,q)}$ may be adopted as the value of $X_{4-(p,q)-2}$ or else a value based only on $SG_{2-(p,q)}$ may be adopted to apply the working example 7 or the working example 8. Or otherwise, if the value of $SG_{1-(p,q)}+SG_{2-(p,q)}$ is equal to or higher than another predetermined value $\Delta X_2$ or if the value of $|(SG_{1-(p,q)}+SG_{2-(p,q)})$ is equal to or lower than a further predetermined value $\Delta X_3$, the working example 7 or the working example 8 may be executed, but in any other case, the working example 8 or the working example 7 may be executed.

In the working examples 7 or 8, the array order of the subpixels which configure the first pixel and the second pixel is set such that, where it is represented as [(first pixel), (second pixel)], it is determined as, [(first subpixel R, second subpixel G, third subpixel B), (first subpixel R, second subpixel G, fourth subpixel W)] or, where the array order is represented as [(second pixel), (first pixel)], it is determined as [(fourth subpixel W, second subpixel G, first subpixel R), (third subpixel B, second subpixel G, first subpixel R)]. However, the array order is not limited to this. For example, the array order of [(first pixel), (second pixel)] may be [(first subpixel R, third subpixel B, second subpixel G), (first subpixel R, fourth subpixel W, second subpixel G)].

Figure 21:
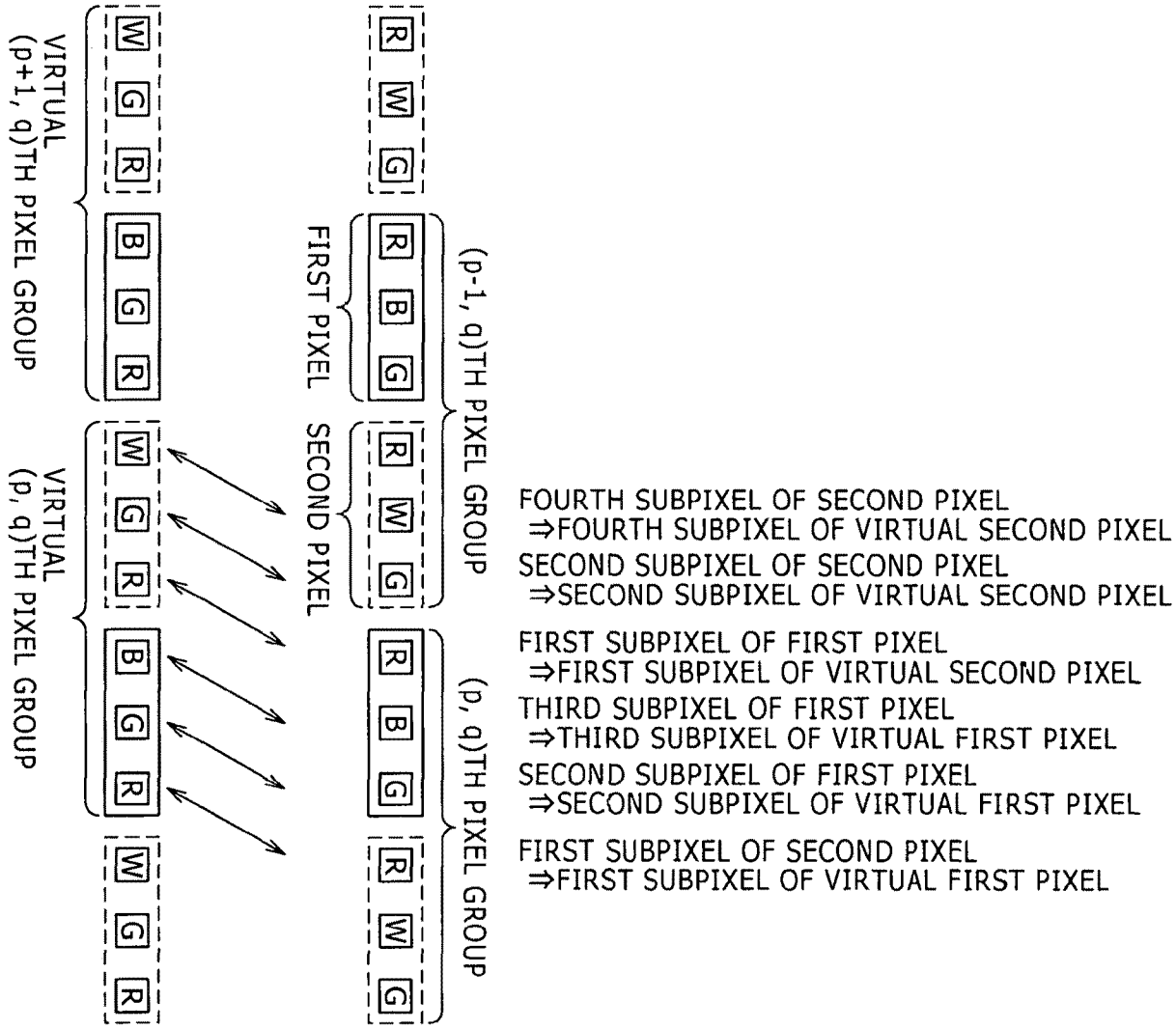
FIG. 21 is a diagrammatic view showing a modified array of first, second, third and fourth subpixels in first and second pixels which configure a pixel group in the working example 8.

Such a state as just described in the working example 8 is illustrated at an upper stage in FIG. 21. If this array order is viewed differently, then it is equivalent to an array order wherein three subpixels including the first subpixel R of the first pixel of the (p,q)th pixel group and the second subpixel G and the fourth subpixel W of the second pixel of the (p−1,q)th pixel group are virtually regarded as the (first subpixel R, second subpixel G, fourth subpixel W) of the second pixel of the (p,q)th pixel group as indicated by virtual pixel division at a lower stage in FIG. 18. Further, the array order is equivalent to an array order wherein three subpixels including the first subpixel R of the second pixel of the (p,q)th pixel group and the second subpixel G and the third subpixel B of the first pixel are virtually regarded as the those of the first pixel of the (p,q)th pixel group. Therefore, the working example 8 may be applied to the first and second pixels which configures such virtual pixel groups. Further, while it is described in the foregoing description of the working examples 7 or 8 that the first direction is a direction from the left toward the right, it may otherwise be defined as a direction from the right toward the left as can be recognized from the foregoing description of the [(second pixel), (first pixel)].

Working Example 9

The working example 9 relates to the driving method for an image display apparatus according to the fourth, ninth, 14th, 19th and 24th embodiments of the present invention and the driving method for an image display apparatus assembly according to the fourth, ninth, 14th, 19th and 24th embodiments of the present invention.

Figure 22:
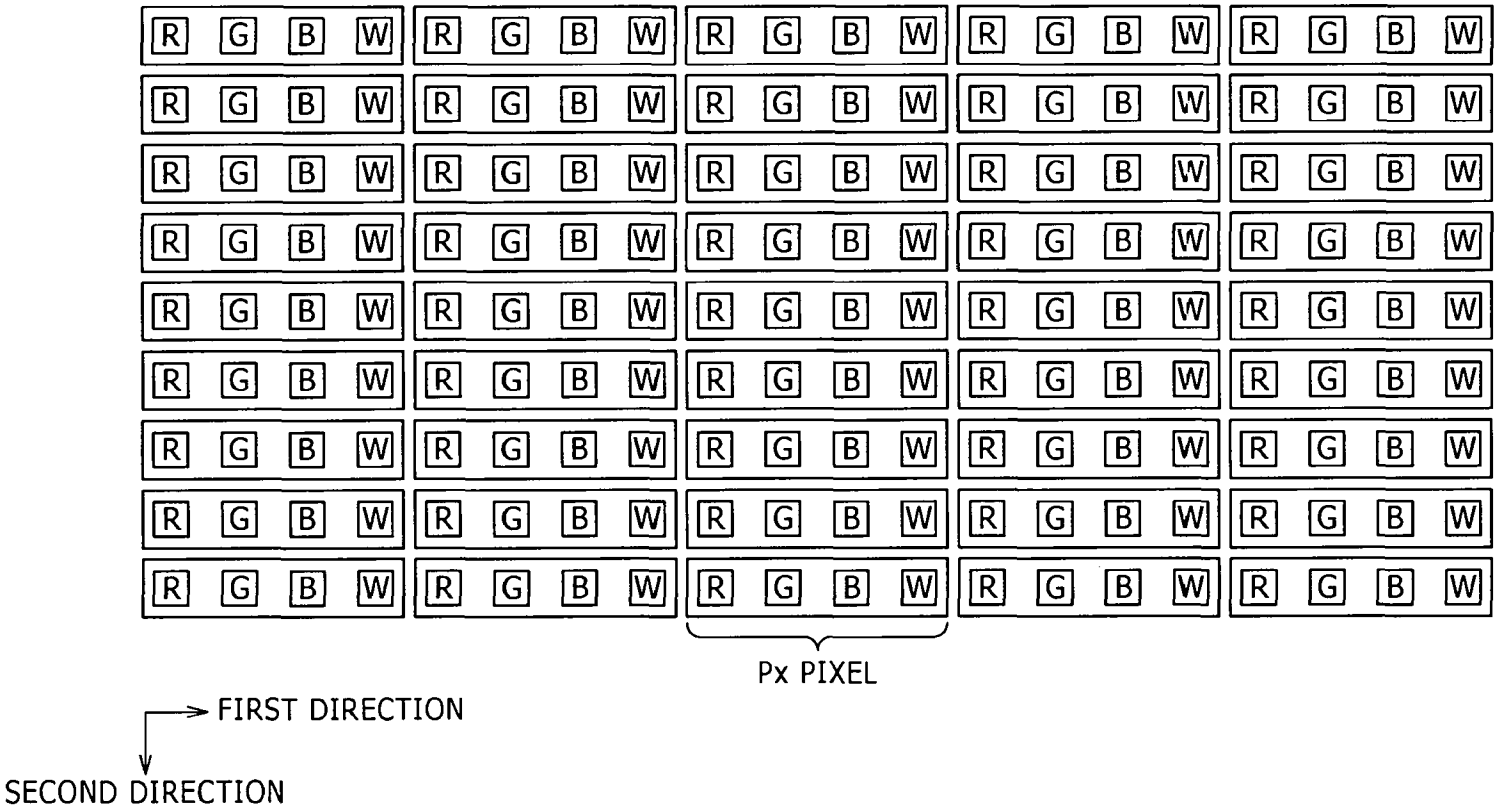
FIG. 22 is a view schematically illustrating different arrangements of pixels on the image display apparatus of a working example 9 of the present invention.

Referring now to FIG. 22 which schematically illustrates arrangement of pixels, the image display panel 30 of the working example 9 includes totaling $P_0 \times Q_0$ pixels Px arrayed in a two-dimensional matrix including $P_0$ pixels Px arrayed in a first direction and $Q_0$ pixels Px arrayed in a second direction. It is to be noted that, in FIG. 22, a first subpixel R, a second subpixel G, a third subpixel B and a fourth subpixel W are surrounded by solid lines. Each of the pixels Px includes a first subpixel R for displaying a first primary color such as, for example, red, a second subpixel G for displaying a second primary color such as, for example, green, a third subpixel B for displaying a third primary color such as, for example, blue, and a fourth subpixel W for displaying a fourth color such as white. The subpixels mentioned of each pixel Px are arrayed in the first direction. The arrangement of the pixels is illustrated in FIG. 3. Each subpixel has a rectangular shape and is disposed such that the major side of the rectangle extends in parallel to the second direction and the minor side of the rectangle extends in parallel to the first direction.

The signal processing section 20 calculates a first subpixel output signal, that is, a first subpixel output signal value $x_{1-(p,q)}$, to a pixel $Px_{(p,q)}$ based at least on a first subpixel input signal (signal value $x_{1-(p,q)}$) and the expansion coefficient $\alpha_0$, and outputs the calculated first subpixel output signal to the first subpixel R. Further, the signal processing section 20 calculates a second subpixel output signal (signal value $X_{2-(p,q)}$), to the pixel $Px_{(p,q)}$ based at least on a second subpixel input signal (signal value $x_{2-(p,q)}$) and the expansion coefficient $\alpha_0$, and outputs the calculated second subpixel output signal to the second subpixel G. The signal processing section 20 calculates a third subpixel output signal (signal value $X_{3-(p,q)}$), to the pixel $Px_{(p,q)}$ based at least on a third subpixel input signal (signal value $x_{3-(p,q)}$) and the expansion coefficient $\alpha_0$, and outputs the calculated third subpixel output signal to the third subpixel B.

Here, in the working example 9, to the signal processing section 20, regarding a (p,q)th pixel $Px_{(p,q)}$ (where $1 \le p \le P_0$, $1 \le q \le Q_0$), a first subpixel input signal having a signal value of $x_{1-(p,q)}$, a second subpixel input signal having a signal value of $x_{2-(p,q)}$ and a third subpixel input signal having a signal value of $x_{3-(p,q)}$ are inputted. Further, the signal processing section 20 outputs, regarding the pixel $Px_{(p,q)}$, a first subpixel output signal having a signal value $X_{1-(p,q)}$ for determining a display gradation of a first subpixel R, a second subpixel output signal having a signal value $X_{2-(p,q)}$ for determining a display gradation of a second subpixel G, a third subpixel output signal having a signal value $X_{3-(p,q)}$ for determining a display gradation of a third subpixel B, and a fourth subpixel output signal having a signal value $X_{4-(p,q)}$ for determining a display gradation of a fourth subpixel W.

Further, regarding an adjacent pixel positioned adjacent the (p,q)th pixel, a first subpixel input signal having a signal value of $x_{1-(p,q')}$, a second subpixel input signal having a signal value of $x_{2-(p,q')}$ and a third subpixel input signal having a signal value of $x_{3-(p,q')}$ are inputted.

It is to be noted that, in the working example 9, the adjacent pixel positioned adjacent the (p,q)th pixel is the (p,q−1)th pixel. However, the adjacent pixel is not limited to this, but may be a (p,q+1)th pixel or both of the (p,q−1)th pixel and the (p,q+1)th pixel.

Further, the signal processing section 20 calculates a fourth subpixel output signal based on a fourth subpixel control second signal calculated from the first subpixel input signal, second subpixel input signal and third subpixel input signal to a (p,q)th pixel (where p=1, 2, . . . , $P_0$ and q=1, 2, . . . , $Q_0$) as counted along the second direction and a fourth subpixel control first signal calculated from the first subpixel input signal, second subpixel input signal and third subpixel input signal to the adjacent pixel adjacent the (p,q)th pixel along the second direction. Then, the signal processing section 20 outputs the calculated subpixel output signal to the fourth subpixel of the (p,q)th pixel.

More particularly, the fourth subpixel control second signal value $SG_{2-(p,q)}$ is calculated from the first subpixel input signal $x_{1-(p,q)}$, second subpixel input signal value $x_{2-(p,q)}$ and third subpixel input signal value $x_{3-(p,q)}$ to the (p,q)th pixel $Px_{(p,q)}$. Meanwhile, the fourth subpixel control first signal value $SG_{1-(p,q)}$ is calculated from the first subpixel input signal value $x_{1-(p,q')}$, second subpixel input signal value $x_{2-(p,q')}$ and third subpixel input signal value $x_{3-(p,q')}$ to the adjacent pixel adjacent the (p,q)th pixel along the second direction. Then, the fourth subpixel output signal is calculated based on the fourth subpixel control first signal value $SG_{1-(p,q)}$ and the fourth subpixel control second signal value $SG_{2-(p,q)}$, and the calculated fourth subpixel output signal value $X_{4-(p,q)}$ is outputted to the (p,q)th pixel.

Further, the fourth subpixel output signal value $X_{4-(p,q)}$ is calculated from an expression (42-1) and (91) given below in the working example 9. In particular, the fourth subpixel output signal value $X_{4-(p,q)}$ is calculated from an arithmetic mean:

$$X_{4-(p,q)} = (SG_{1-(p,q)} + SG_{2-(p,q)})/(2\chi) \quad (42\text{-}1)$$

$$= (\mathrm{Min}_{(p,q)} \cdot \alpha_0 + \mathrm{Min}_{(p,q')} \cdot \alpha_0)/(2\chi) \quad (91)$$

It is to be noted that the fourth subpixel control first signal value $SG_{1-(p,q)}$ is calculated based on $\mathrm{Min}_{(p,q')}$ and the expansion coefficient $\alpha_0$, and the fourth subpixel control second signal value $SG_{2-(p,q)}$ is calculated based on $\mathrm{Min}_{(p,q)}$ and the expansion coefficient $\alpha_0$. In particular, the fourth subpixel control first signal value $SG_{1-(p,q)}$ and the fourth subpixel control second signal value $SG_{2-(p,q)}$ are calculated from the following expressions (92-1) and (92-2), respectively.

$$SG_{1-(p,q)} = \mathrm{Min}_{(p,q')} \cdot \alpha_0 \quad (92\text{-}1)$$

$$SG_{2-(p,q)} = \mathrm{Min}_{(p,q')} \cdot \alpha_0 \quad (92\text{-}2)$$

In the signal processing section 20, the output signal values $X_{1-(p,q)}$, $X_{2-(p,q)}$, $X_{3-(p,q)}$ of the first subpixel R, second subpixel G, and third subpixel B, can be calculated based on the expansion coefficient $\alpha_0$ and the constant $\chi$. More particularly, the output signal values mentioned can be calculated from the following expressions (1-D) to (1-F).

$$X_{1-(p,q)} = \alpha_0 \cdot x_{1-(p,q)} - \chi \cdot SG_{2-(p,q)} \quad (1\text{-D})$$

$$X_{2-(p,q)} = \alpha_0 \cdot x_{2-(p,q)} - \chi \cdot SG_{2-(p,q)} \quad (1\text{-E})$$

$$X_{3-(p,q)} = \alpha_0 \cdot x_{3-(p,q)} - \chi \cdot SG_{2-(p,q)} \quad (1\text{-F})$$

In the following, a method (expansion process) of calculating the output signal values $X_{1-(p,q)}$, $X_{2-(p,q)}$, $X_{3-(p,q)}$, $X_{4-(p,q)}$ of the (p,q)th pixel $Px_{(p,q)}$. It is to be noted that the following process is carried out, similarly to the working example 4, so as to keep, in the whole of the first pixel and the second pixel, that is, in each pixel group, the ratio among the luminance of the first primary color displayed by the (first subpixel R+fourth subpixel W), the luminance of the second primary color displayed by the (second subpixel G+fourth subpixel W) and the luminance of the third primary color displayed by the (third subpixel B+fourth subpixel W). Besides, the process is carried out so as to keep or maintain the color tone as far as possible. Furthermore, the process is carried out so as to keep or maintain the gradation-luminance characteristic, that is, the gamma characteristic or γ characteristic).

Step 900

First, the signal processing section 20 calculates the saturation S and the brightness V(S) of a plurality of pixel based on subpixel input signal values to a plurality of pixels. In particular, the signal processing section 20 calculates the saturation $S_{(p,q)}$ and $S_{(p,q')}$ and the brightness $V(S)_{(p,q)}$ and $V(S)_{(p,q')}$ from expressions substantially same as the expressions (43-1) to (43-4) based on the first subpixel input signal value $x_{1-(p,q)}$, second subpixel input signal value $x_{2-(p,q)}$, and third subpixel input signal value $x_{3-(p,q)}$ to the (p,q)th pixel $Px_{(p,q)}$ and the first subpixel input signal value $x_{1-(p,q')}$, second subpixel input signal value $x_{2-(p,q')}$, and third subpixel input signal value $x_{3-(p,q')}$ to the (p,q−1)th pixel $Px_{(p,q)}$ (adjacent pixel). This process is carried out for all pixels.

Step 910

Then, the signal processing section 20 calculates the expansion coefficient $\alpha_0$ from the value of $V_{max}(S)/V(S)$ calculated with regard to a plurality of pixel group $PG_{(p,q)}$ from a predetermined value $\beta_0$ in a similar manner as in the working example 1. Or, the expansion coefficient $\alpha_0$ is calculated based on the provisions of the expression (15-2), expressions (16-1) to (16-5) or expressions (17-1) to (17-6).

Step 920

Then, the signal processing section 20 calculates the fourth subpixel output signal value $X_{4-(p,q)}$ to the (p,q)th pixel $Px_{(p,q)}$ from the expression (92-1), (92-2) and (91) given hereinabove. The step 910 and the step 920 may be executed simultaneously.

Step 930

Next, the signal processing section 20 calculates the first subpixel output signal value $X_{1-}(p,q)$ to the (p,q)th pixel $Px_{(p,q)}$ based on the input signal value $x_{1-(p,q)}$, expansion coefficient $\alpha_0$ and constant $\chi$. Further, the signal processing section 20 calculates the second subpixel output signal value $X_{2-(p,q)}$ based on the input signal value $x_{2-(p,q)}$, expansion coefficient $\alpha_0$ and constant $\chi$. Furthermore, the signal processing section 20 calculates the third subpixel output signal value $X_{3-(p,q)}$ based on the input signal value $x_{3-(p,q)}$, expansion coefficient $\alpha_0$ and constant $\chi$. It is to be noted that the step 920 and the step 930 may be executed simultaneously, or the step 920 may be executed after execution of the step 930.

In particular, the signal processing section 20 calculates the output signal values $X_{1-(p,q)}$, $X_{2-(p,q)}$ and $X_{3-(p,q)}$ of the (p,q)th pixel $Px_{(p,q)}$ based on the expressions (1-D) to (1-F) given hereinabove, respectively.

Also in the driving method therefor of the working example 9, the output signal values $X_{1-(p,q)}$, $X_{2-(p,q)}$, and $X_{4-(p,q)}$ of the (p,q)th pixel group $PG_{(p,q)}$ are expanded to $\alpha_0$ times. Therefore, in order to form an image of a luminance equal to the luminance of an image which is not in an expanded state, the luminance of the planar light source apparatus 50 may be decreased based on the expansion coefficient $\alpha_0$. In particular, the luminance of the planar light source apparatus 50 may be reduced to $1/\alpha_0$ times. By this, reduction of the power consumption of the planar light source apparatus can be anticipated.

Working Example 10

The working example 10 relates to the driving method for an image display apparatus according to the fifth, tenth, 15th, 20th and 25th embodiments of the present invention and the driving method for an image display apparatus assembly according to the fifth, tenth, 15th, 20th and 25th embodiments of the present invention. Arrangement of pixels and pixel groups on an image display panel in the working example 10 is similar to that of the working example 7 and is same as that of a schematic view of FIG. 19 or 20.

In the working example 10, an image display panel 30 includes totaling P×Q pixel groups arrayed in a two-dimensional matrix including P pixel groups arrayed in a first direction such as, for example, in the horizontal direction and Q pixel groups arrayed in a second direction such as, for example, in the vertical direction. It is to be noted that, where the number of pixels which configure a pixel group is $p_0$, $p_0$=2. In particular, as seen from the arrangement of pixels of FIG. 19 or 20, in the image display panel 30 in the working example 10, each pixel group includes a first pixel $Px_1$ and a second pixel $Px_2$ along the first direction. The first pixel $Px_1$ includes a first subpixel R for displaying a first primary color such as, for example, red, a second subpixel G for displaying a second primary color such as, for example, green, and a third subpixel B for displaying a third primary color such as, for example, blue. Meanwhile, the second pixel $Px_2$ includes a first subpixel R for displaying the first primary color, a second subpixel G for displaying the second primary color, and a fourth subpixel W for displaying a fourth color such as, for example white. More particularly, in the first pixel $Px_1$, the first subpixel R for displaying the first primary color, the second subpixel G for displaying the second primary color and the third subpixel B for displaying the third primary color are arrayed in order along the first direction. Meanwhile, in the second pixel $Px_2$, the first subpixel R for displaying the first primary color, the second subpixel G for displaying the second primary color and the fourth subpixel W for displaying the fourth color are arrayed in order along the first direction. The third subpixel B which configures the first pixel $Px_1$ and the first subpixel R which configures the second pixel $Px_2$ are positioned adjacent each other. Meanwhile, the fourth subpixel W which configures the second pixel $Px_2$ and the first subpixel R which configures the first pixel $Px_1$ in a pixel group adjacent the pixel group are positioned adjacent each other. It is to be noted that the subpixels have a rectangular shape and are disposed such that the major side thereof extends in parallel to the second direction and the miner side thereof extends in parallel to the first direction. It is to be noted that, in the example shown in FIG. 19, a first pixel and a second pixel are disposed adjacent each other along the second direction. On the other hand, in the example shown in FIG. 20, a first pixel and another first pixel are disposed adjacent each other and a second pixel and another second pixel are disposed adjacent each other along the second direction.

The signal processing section 20 calculates a first subpixel output signal to the first pixel $Px_1$ based at least on a first subpixel input signal and an expansion coefficient $\alpha_0$ to the first pixel $Px_1$ and outputs the calculated first subpixel output signal to the first subpixel R of the first pixel $Px_1$; calculates a second subpixel output signal to the first pixel $Px_1$ based at least on a second subpixel input signal and an expansion coefficient $\alpha_0$ to the first pixel $Px_1$ and outputs the calculated second subpixel output signal to the second subpixel G of the first pixel $Px_1$; also calculates a first subpixel output signal to the second pixel $Px_2$ based at least on a first subpixel input signal and an expansion coefficient $\alpha_0$ to the second pixel $Px_2$ and outputs the calculated first subpixel output signal to the first subpixel R of the second pixel $Px_2$; and calculates a second subpixel output signal to the second pixel $Px_2$ based at least on a second subpixel input signal and an expansion coefficient $\alpha_0$ to the second pixel $Px_2$ and outputs the calculated second subpixel output signal to the second subpixel G of the second pixel $Px_2$.

Here in the working example 10, regarding the first pixel $Px_{(p,q)-1}$ which configures the (p,q)th pixel group $PG_{(p,q)}$ where $1 \le p \le P$ and $1 \le q \le Q$, the signal processing section 20 receives a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, inputted thereto, and regarding the second pixel $Px_{(p,q)-2}$ which configures the (p,q)th pixel group $PG_{(p,q)}$, the signal processing section 20 receives a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, inputted thereto.

Further, in the working example 10, with regard to the first pixel $Px_{(p,q)-1}$ which configures the (p,q)th pixel group $PG_{(p,q)}$, the signal processing section 20 outputs a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the third subpixel B.

Further, with regard to the second pixel $Px_{(p,q)-2}$ which configures the (p,q)th pixel group $PG_{(p,q)}$, the signal processing section 20 outputs a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, and a fourth subpixel output signal having a signal value $X_{4-(p,q)-2}$ for determining a display gradation of the fourth subpixel W.

Further, regarding an adjacent pixel positioned adjacent the (p,q)th second pixel, the signal processing section 20 receives a first subpixel input signal having a signal value $x_{1-(p,q')}$, a second subpixel input signal having a signal value $x_{2-(p,q')}$, and a third subpixel input signal having a signal value $x_{3-(p,q')}$ inputted thereto.

Further, in the working example 10, the signal processing section 20 calculates a fourth subpixel output signal (signal value $X_{4-(p,q)-2}$) based on a fourth subpixel control second signal (signal value $SG_{2-(p,q)}$) of the second pixel $Px_{(p,q)-2}$ which is the (p,q)th, where p=1, 2, . . . , P and q=2, 3, . . . , Q as counted along the second direction and a fourth subpixel control first signal (signal value $SG_{1-(p,q)}$) of an adjacent pixel positioned adjacent the second pixel $Px_{(p,q)-2}$ which is the (p,q)th along the second direction, and outputs the calculated fourth subpixel output signal to the fourth subpixel W of the (p,q)th second pixel $Px_{(p,q)-2}$. Here, the fourth subpixel control second signal (signal value $SG_{2-(p,q)}$) is calculated from the first subpixel input signal (signal value $x_{1-(p,q)-2}$), second subpixel input signal (signal value $x_{2-(p,q)-2}$), and third subpixel input signal (signal value $x_{3-(p,q)-2}$) to the (p,q)th second pixel $Px_{(p,q)-2}$. Further, the fourth subpixel control first signal (signal value $SG_{1-(p,q)}$) is calculated from the first subpixel input signal (signal value $x_{1-(p,q')}$), second subpixel input signal (signal value $x_{2-(p,q')}$) and third subpixel input signal (signal value $x_{3-(p,q')}$) to the adjacent pixel positioned adjacent the (p,q)th second pixel along the second direction.

Further, the signal processing section 20 calculates a third subpixel output signal (signal value $X_{3-(p,q)-1}$), based at least on the third subpixel input signal (signal value $x_{3-(p,q)-2}$) to the (p,q)th second pixel $Px_{(p,q)-2}$ and the third subpixel input signal (signal value $x_{3-(p,q)-1}$) to the (p,q)th first pixel, and outputs the third subpixel output signal to the third subpixel of the (p,q)th first pixel $Px_{(p,q)-1}$.

It is to be noted that, in the working example 10, the adjacent pixel adjacent the (p,q)th second pixel is represented as the (p,q−1)th pixel. However, the adjacent pixel is not limited to this, but may be the (p,q+1)th pixel or may be both of the (p,q−1)th pixel and the (p,q+1)th pixel.

In the working example 10, the expansion coefficient $\alpha_0$ is calculated for every one image display frame. Also, it is to be noted that the fourth subpixel control first signal value $SG_{1-(p,q)}$ and the fourth subpixel control second signal value $SG_{2-(p,q)}$ are calculated in accordance with expressions (101-1) and (101-2) corresponding to the expressions (2-1-1) and (2-1-2), respectively. Further, the control signal value or third subpixel control signal value $SG_{3-(p,q)}$ is calculated from the following expression (101-3).

$$SG_{1-(p,q)}=\mathrm{Min}_{(p,q')}\cdot\alpha_0 \tag{101-1}$$

$$SG_{2-(p,q)}=\mathrm{Min}_{(p,q)-2}\cdot\alpha_0 \tag{101-2}$$

$$SG_{3-(p,q)}=\mathrm{Min}_{(p,q)-1}\cdot\alpha_0 \tag{101-3}$$

Then, in the working example 10, the fourth subpixel output signal value $X_{4-(p,q)-2}$ is calculated from an expression (102) of an arithmetic mean given below. Also, the output signal values $X_{1-(p,q)-2}$, $X_{2-(p,q)-2}$, $X_{1-(p,q)-1}$, $X_{2-(p,q)-1}$, and $X_{3-(p,q)-1}$, are calculated from expressions (3-A), (3-B), (3-E), (3-F), (3-a'), (3-f), (3-g), (101-3).

$$\begin{aligned} X_{4-(p,q)-2} &= (SG_{1-(p,q)} + SG_{2-(p,q)})/(2\chi) \\ &= (\mathrm{Min}_{(p,q')}\cdot\alpha_0 + \mathrm{Min}_{(p,q)-2}\cdot\alpha_0)/(2\chi) \end{aligned} \tag{102}$$

$$X_{1-(p,q)-2} = \alpha_0\cdot x_{1-(p,q)-2} - \chi\cdot SG_{2-(p,q)} \tag{3-A}$$

$$X_{2-(p,q)-2} = \alpha_0\cdot x_{2-(p,q)-2} - \chi\cdot SG_{2-(p,q)} \tag{3-B}$$

$$X_{1-(p,q)-1} = \alpha_0\cdot x_{1-(p,q)-1} - \chi\cdot SG_{3-(p,q)} \tag{3-E}$$

$$X_{2-(p,q)-1} = \alpha_0\cdot x_{2-(p,q)-1} - \chi\cdot SG_{3-(p,q)} \tag{3-F}$$

$$X_{3-(p,q)-1} = (X'_{3-(p,q)-1} + X'_{3-(p,q)-2})/2 \tag{3-a'}$$

where $$X'_{3-(p,q)-1} = \alpha_0\cdot x_{3-(p,q)-1} - \chi\cdot SG_{3-(p,q)} \tag{3-f}$$

$$X'_{3-(p,q)-2} = \alpha_0\cdot x_{3-(p,q)-2} - \chi\cdot SG_{2-(p,q)} \tag{3-g}$$

In the following, a method of calculating the output signal values $X_{1-(p,q)-2}$, $X_{2-(p,q)-2}$, $X_{4-(p,q)-2}$, $X_{1-(p,q)-1}$, $X_{2-(p,q)-1}$ and $X_{3-(p,q)-1}$ of the (p,q)th pixel group $PG_{(p,q)}$, that is, an expansion process, is described. It is to be noted that the following process is carried out such that the gradation-luminance characteristic, that is, the gamma characteristic or γ characteristic, is maintained. Further, in the following process, the process described below is carried out so as to keep the ratio on luminance as far as possible over all of the first and second pixels, that is, over all pixel groups. Besides, the process is carried out so as to keep or maintain the color tone as far as possible.

Step 1000

First, similarly to the step-400 of the working example 4, the signal processing section 20 calculates the saturation S and the brightness V(S) of a plurality of pixel groups based on subpixel input signal values to a plurality of pixels. In particular, the signal processing section 20 calculates the saturation $S_{(p,q)-1}$ and $S_{(p,q)-2}$ and the brightness $V(S)_{(p,q)-1}$ and $V(S)_{(p,q)-2}$ from expressions substantially same as the expressions (43-1), (43-2), (43-3) and (43-4), based on the input signal value $x_{1-(p,q)-1}$ of the first subpixel input signal, the input signal value $x_{2-(p,q)-1}$ of the second pixel input signal and the input signal value $x_{3-(p,q)-1}$ of the third subpixel input signal to the (p,q)th first pixel $Px_{(p,q)-1}$ and the input signal value $x_{1-(p,q)-2}$ of the first subpixel input signal, the input signal value $x_{2-(p,q)-2}$ of the second pixel input signal and the input signal value $x_{3-(p,q)-2}$ of the third subpixel input signal to the (p,q)th second pixel $Px_{(p,q)-2}$. This process is carried out for all pixel groups.

Step 1010

Then, the signal processing section 20 determines the expansion coefficient $\alpha_0$ from the value of $V_{max}(S)/V(S)$ calculated with regard to a plurality of pixel group from a predetermined value $\beta_0$ in a similar manner as in the working example 1. Or, the expansion coefficient $\alpha_0$ is determined based on the provisions of the expression (15-2), expressions (16-1) to (16-5) or expressions (17-1) to (17-6).

Step 1020

Then, the signal processing section 20 calculates the fourth subpixel output signal value $X_{4-(p,q)-2}$ to the (p,q)th pixel group $PG_{(p,q)}$ from the above expression (101-1), (101-2) and (102) given hereinabove. The step 1010 and the step 1020 may be executed simultaneously.

Step 1030

Next, the signal processing section 20 calculates the first subpixel output signal value $X_{1-(p,q)-2}$ to the (p,q)th second pixel $Px_{(p,q)-2}$ in accordance with the expressions (3-A), (3-B), (3-E), (3-F), (3-a'), (3-f), and (3-g) based on the input signal value $x_{1-(p,q)-2}$, expansion coefficient $\alpha_0$ and constant $\chi$. Further, the signal processing section 20 calculates the second subpixel output signal value $X_{2-(p,q)-2}$ based on the input signal value $X_{2-(p,q)-2}$, expansion coefficient $\alpha_0$ and constant $\chi$. Furthermore, the signal processing section 20 calculates the first subpixel output signal value $x_{1-(p,q)-1}$ of the (p,q)th first pixel $Px_{(p,q)-1}$ based on the input signal value $x_{1-(p,q)-1}$, expansion coefficient $\alpha_0$ and constant $\chi$. Further, the signal processing section 20 calculates the second subpixel output signal value $X_{2-(p,q)-1}$ based on the input signal value $X_{2-(p,q)-1}$, expansion coefficient $\alpha_0$ and constant $\chi$, and calculates the third subpixel output signal value $X_{3-(p,q)-1}$ based on the input signal values $x_{3-(p,q)-1}$ and $x_{3-(p,q)-2}$, expansion coefficient $\alpha_0$ and constant $\chi$. It is to be noted that the step 1020 and the step 1030 may be executed simultaneously, or the step 1020 may be executed after execution of the step 1030.

In the image display apparatus assembly or the driving method of the working example 10, the output signal values $X_{1-(p,q)-2}$, $X_{2-(p,q)-2}$, $X_{4-(p,q)-2}$, $X_{1-(p,q)-1}$, $X_{2-(p,q)-1}$ and $X_{3-(p,q)-1}$ of the (p,q)th pixel group $PG_{(p,q)}$ are expanded to $\alpha_0$ times. Therefore, in order to form an image of a luminance equal to the luminance of an image which is not in an expanded state, the luminance of the planar light source apparatus 50 may be decreased based on the expansion coefficient $\alpha_0$. In particular, the luminance of the planar light source apparatus 50 may be reduced to $1/\alpha_0$ times. By this, reduction of the power consumption of the planar light source apparatus can be anticipated.

It is to be noted that, since the ratios of the output signal values of the first and second pixels in each pixel group $$x_{1-(p,q)-2}:x_{2-(p,q)-2}$$

$$x_{1-(p,q)-1}:x_{2-(p,q)-1}:x_{3-(p,q)-1}$$

are a little different from the ratios of the input signal values $$x_{1-(p,q)-2}:x_{2-(p,q)-2}$$

$$x_{1-(p,q)-1}:x_{2-(p,q)-1}:x_{3-(p,q)-1}$$

if each pixel is viewed solely, then some difference sometimes occurs with the color tone among the pixels with respect to the input signal. However, when the pixels are observed as a pixel group, no problem occurs with the color tone of the pixel group.

If the relationship between the fourth subpixel control first signal value $SG_{1-(p,q)}$ and the fourth subpixel control second signal value $SG_{2-(p,q)}$ is deviated from a certain condition, the adjacent pixel may be changed. In particular, where the adjacent pixel is the (p,q−1)th pixel, it may be changed to the (p,q+1)th pixel or may be changed to the (p,q−1)th pixel and the (p,q+1)th pixel.

Or else, if the relationship between the fourth subpixel control first signal value $SG_{1-(p,q)}$ and the fourth subpixel control second signal value $SG_{2-(p,q)}$ is deviated from a certain condition, then such an operation that the processes in each working example are not carried out may be used. For example, if the value of $|SG_{1-(p,q)}+SG_{2-(p,q)}|$ becomes equal to or higher (or equal to or lower than) a predetermined value $\Delta X_1$, a value based only on $SG_{1-(p,q)}$ is adopted or a value based only on $SG_{2-(p,q)}$ may be adopted as the value of $X_{4-(p,q)-2}$ to apply each working example. Or, if the value of $SG_{1-(p,q)}+SG_{2-(p,q)}$ becomes equal to or higher than another predetermined value $\Delta X_2$ and if the value of $SG_{2-(p,q)}+SG_{1-(p,q)}$ become equal to or lower than a further predetermined value $\Delta X_3$, such an operation as to carry out different processes from those in the working example 10 may be executed.

Figure 23:
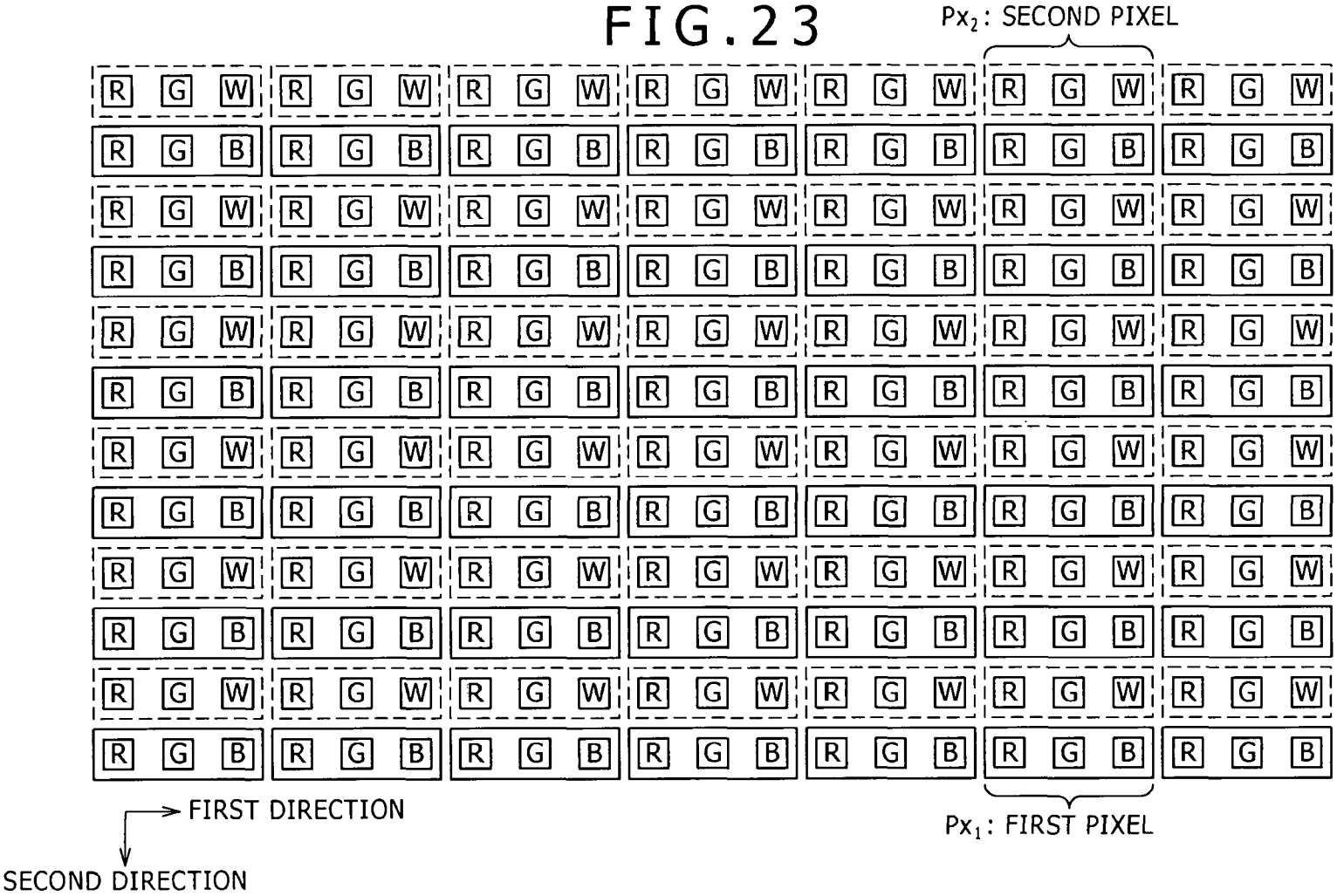
FIG. 23 is further view schematically illustrating different arrangements of pixels on the image display apparatus of a working example 10 of the present invention.

As occasion demands, the array of pixel groups described hereinabove in connection with the working example 10 may be changed in such a manner as described to execute the driving method for an image display apparatus or the driving method for an image display apparatus assembly substantially described hereinabove in connection with the working example 10. In particular, a driving method for an image display apparatus which includes an image display panel wherein totaling P×Q pixels arrayed in a two-dimensional matrix including P pixels arrayed in a first direction and Q pixels arrayed in a second direction as shown in FIG. 23 and a signal processing section may be adopted, the image display panel being configured from a plurality of first pixel columns including first pixels arrayed along the first direction and a plurality of second pixel columns disposed adjacent and alternately with the first pixel columns and including second pixels arrayed along the first direction;

the first pixel including a first subpixel R for displaying a first primary color, a second subpixel G for displaying a second primary color and a third subpixel B for displaying a third primary color;

the second pixel including a first subpixel R for displaying the first primary color, a second subpixel G for displaying the second primary color and a fourth subpixel W for displaying a fourth color;

the signal processing section being capable of:

calculating a first subpixel output signal to the first pixel based at least on a first subpixel input signal to the first pixel and an expansion coefficient $\alpha_0$ and outputting the first subpixel output signal to the first subpixel R of the first pixel;

calculating a second subpixel output signal to the first pixel based at least on a second subpixel input signal to the first pixel and the expansion coefficient $\alpha_0$ and outputting the second subpixel output signal to the second subpixel G of the first pixel;

calculating a first subpixel output signal to the second pixel based at least on a first subpixel input signal to the second pixel and the expansion coefficient $\alpha_0$ and outputting the first subpixel output signal to the first subpixel R of the second pixel; and calculating a second subpixel output signal to the second pixel based at least on a second subpixel input signal to the second pixel and outputting the second subpixel output signal to the expansion coefficient $\alpha_0$ and second subpixel G of the second pixel;

the driving method including the steps, further carried out by the signal processing section, of calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q, second pixel when the pixels are counted along the second direction and a fourth subpixel control first signal calculated from the first subpixel input signal, second subpixel input signal and third subpixel input signal to a first pixel positioned adjacent the (p,q)th second pixel along the second direction, and outputting the calculated fourth subpixel output signal to the (p,q)th second pixel; and further calculating a third subpixel output signal based at least on the third subpixel input signal to the (p,q)th second pixel and the third subpixel input signal to the first pixel adjacent the (p,q)th second pixel and outputting the calculated third subpixel output signal to the (p,q)th first pixel.

While the present invention has been described above in connection with preferred working examples thereof, the present invention is not limited to the working examples. The configuration and the structure of the color liquid crystal display apparatus assemblies, color liquid crystal display apparatus, planar light source apparatus, planar light source units and driving circuits described in the above examples are illustrative, and also the members, materials and so forth which configure them are illustrative and can be altered suitably.

It is possible to combine two suitable driving methods from among the driving method according to the first embodiment or the like of the present invention, the driving method according to the sixth embodiment or the like of the present invention, the driving method according to the 11th embodiment or the like of the present invention and the driving method according to the 16th embodiment or the like of the present invention, and also it is possible to combine three suitable driving methods from among the four driving methods or combine all of the four driving methods. Further, it is possible to combine two suitable driving methods from among the driving method according to the second embodiment or the like of the present invention, the driving method according to the seventh embodiment or the like of the present invention, the driving method according to the 12th embodiment or the like of the present invention and the driving method according to the 17th embodiment or the like of the present invention, and also it is possible to combine three suitable driving methods from among the four driving methods or combine all of the four driving methods. Further, it is possible to combine two suitable driving methods from among the driving method according to the third embodiment or the like of the present invention, the driving method according to the eighth embodiment or the like of the present invention, the driving method according to the 13th embodiment or the like of the present invention and the driving method according to the 18th embodiment or the like of the present invention, and also it is possible to combine three suitable driving methods from among the four driving methods or combine all of the four driving methods. Further, it is possible to combine two suitable driving methods from among the driving method according to the fourth embodiment or the like of the present invention, the driving method according to the ninth embodiment or the like of the present invention, the driving method according to the 14th embodiment or the like of the present invention and the driving method according to the 19th embodiment or the like of the present invention, and also it is possible to combine three suitable driving methods from among the four driving methods or combine all of the four driving methods. Also it is possible to combine two suitable driving methods from among the driving method according to the fifth embodiment or the like of the present invention, the driving method according to the tenth embodiment or the like of the present invention, the driving method according to the 15th embodiment or the like of the present invention and the driving method according to the 20th embodiment or the like of the present invention, and also it is possible to combine three suitable driving methods from among the four driving methods or combine all of the four driving methods.

While, in the working examples, a plurality of pixels, or a set of a first subpixel R, a second subpixel G and a third subpixel B, whose saturation S and brightness V(S) should be calculated, are all of P×Q pixels or all sets of first subpixels R, second subpixels G and third subpixels B or all of $P_0 \times Q_0$ pixel groups, the number of such pixels is not limited to this. In particular, the plural pixels, or the set of a first subpixel R, a second subpixel G and a third subpixel B or the pixel groups, whose saturation S and brightness V(S) should be calculated, may be set, for example, to one for every four or one for every eight.

Figure 24:
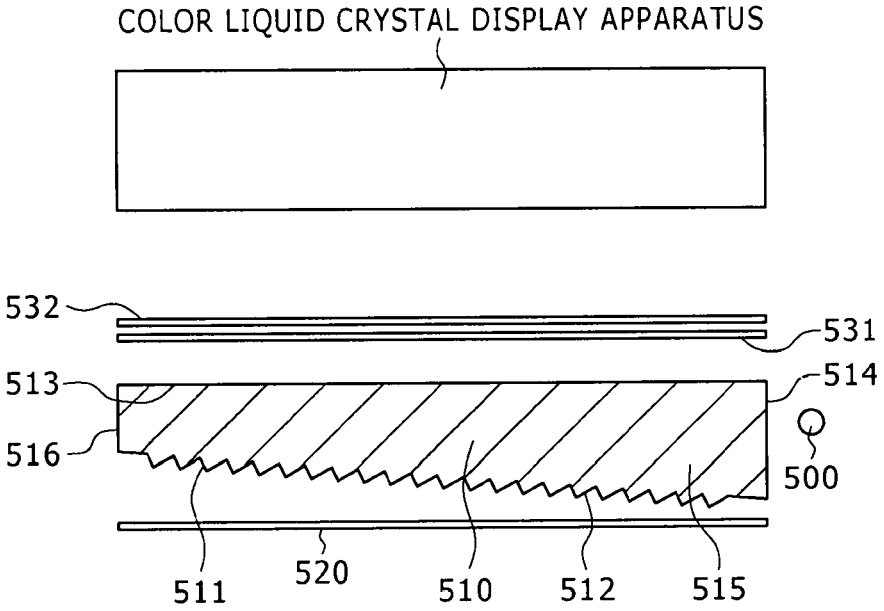
FIG. 24 is a schematic view of a planar light source apparatus of the edge light type or side light type.

While, in the working example 2 or the working example 1, the expansion coefficient $\alpha_0$ is calculated based on a first subpixel input signal, a second subpixel input signal and a third subpixel input signal, it may be calculated alternatively based on one of the first, second and third input signals or on one of subpixel input signals from within a set of a first subpixel R, a second subpixel G and a third subpixel B or else on one of first, second and third input signals. In particular, as an input signal value of one of such input signals, for example, an input signal value $x_{2-(p,q)}$ for green may be used. Then, the output signal value $X_{4-(p,q)}$, further the values $X_{1-(p,q)}$, $X_{2-(p,q)}$ and $X_{3-(p,q)}$ may be calculated from the calculated expansion coefficient $\alpha_0$ in a similar manner as in the working examples. It is to be noted that, in this instance, without using the saturation $S_{(p,q)}$ or $V(S)_{(p,q)}$ in the expression (12-1) and (12-2), "1" may be used as the value of the saturation $S_{(p,q)}$. In other words, $x_{2-(p,q)}$ is used as the value of $Max_{(p,q)}$ in the expression (12-1) and the value of $Min_{(p,q)}$ is set to "0." Then, $x_{2-(p,q)}$ may be used as the value of $V(S)_{(p,q)}$. Similarly, the expansion coefficient $\alpha_0$ may be calculated based on input signal values of two different ones of first, second and third subpixel input signals, or on two different input signals from among subpixel input signals for a set of first subpixel R, second subpixel G and third subpixel B or else on two different input signals from among the first, second and third input signals. More particularly, for example, the input signal value $x_{1-(p,q)}$ for red and the input signal value $x_{2-(p,q)}$ for green can be used. Then, an output signal values $X_{4-(p,q)}$, further the values $X_{1-(p,q)}$, $X_{2-(p,q)}$ and $X_{3-(p,q)}$ may be calculated from the calculated expansion coefficient $\alpha_0$ in a similar manner as in the working example. It is to be noted that, in this instance, without using $S_{(p,q)}$ and $V(S)_{(p,q)}$ of the expressions (12-1) and (12-2), for example, as a value of $S_{(p,q)}$, in the case where $x_{1-(p,q)} \geq x_{2-(p,q)}$, $$S_{(p,q)}=(x_{1-(p,q)}-x_{2-(p,q)})/x_{1-(p,q)}$$

$$V(S)=x_{1-(p,q)}$$

may be used, but in the case where $x_{1-(p,q)}<x_{2-(p,q)}$ $$S_{(p,q)}=(x_{2-(p,q)}-x_{1-(p,q)})/x_{2-(p,q)}$$

$$V(S)=x_{2-(p,q)}$$

may be used. For example, in the case where a monochromatic image is to be displayed on a color image display apparatus, it is sufficient if such an expansion process as given by the expressions above is carried out. This is similar to the other working examples Also it is possible to adopt a planar light source apparatus of the edge light type, that is, of the side light type. In this instance, as seen in FIG. 24, a light guide plate 510 formed, for example, from a polycarbonate resin has a first face 511 which is a bottom face, a second face 513 which is a top face opposing to the first face 511, a first side face 514, a second side face 515, a third side face 516 opposing to the first side face 514, and a fourth side face opposing to the second side face 515. A more particular shape of the light guide plate 510 is a generally wedge-shaped truncated quadrangular pyramid shape, and two opposing side faces of the truncated quadrangular pyramid correspond to the first face 511 and the second face 513 while the bottom face of the truncated quadrangular pyramid corresponds to the first side face 514. Further, concave-convex portions 512 are provided on a surface portion of the first face 511. The cross sectional shape of continuous concave-convex portions when the light guide plate 510 is cut along a virtual plane perpendicular to the first face 511 in a first primary color light incoming direction to the light guide plate 510 is a triangular shape. In other words, the concave-convex portions 512 provided on the surface portion of the first face 511 have a prism shape. The second face 513 of the light guide plate 510 may be smooth, that is, may be formed as a mirror face, or may have blast embosses which have a light diffusing effect, that is, may be formed as a fine concave-convex face. A light reflecting member 520 is disposed in an opposing relationship to the first face 511 of the light guide plate 510. Further, an image display panel such as, for example, a color liquid crystal display panel, is disposed in an opposing relationship to the second face 513 of the light guide plate 510. Furthermore, a light diffusing sheet 531 and a prism sheet 532 are disposed between the image display panel and the second face 513 of the light guide plate 510. First primary color light emitted from a light source 500 advances into the light guide plate 510 through the first side face 514, which is a face corresponding to the bottom face of the truncated quadrangular pyramid, of the light guide plate 510. Then, the first primary color light comes to and is scattered by the concave-convex portions 512 of the first face 511 and goes out from the first face 511, whereafter it is reflected by the light reflecting member 520 and advances into the first face 511 again. Thereafter, the first primary color light goes out from the second face 513, passes through the light diffusing sheet 531 and the prism sheet 532 and irradiates the image display panel, for example, of various working examples.

As the light source, a fluorescent lamp or a semiconductor laser which emits blue light as the first primary color light may be adopted in place of light emitting diodes. In this instance, the wavelength $\lambda_1$ of the first primary color light which corresponds to the first primary color, which is blue, to be emitted from the fluorescent lamp or the semiconductor laser may be, for example, 450 nm. Meanwhile, green light emitting particles which correspond to second primary color light emitting particles which are excited by the fluorescent lamp or the semiconductor laser may be, for example, green light emitting phosphor particles made of, for example, $SrGa_2S_4$:Eu. Further, red light emitting particles which correspond to third primary color light emitting particles may be red light emitting phosphor particles made of, for example, CaS:Eu. Or else, where a semiconductor laser is used, the wavelength $\lambda_1$ of the first primary color light which corresponds to the first primary color, that is, blue, which is emitted by the semiconductor laser, may be, for example, 457 nm. In this instance, green light emitting particles which correspond to second primary color light emitting particles which are excited by the semiconductor laser may be green light emitting phosphor particles made of, for example, $SrGs_2S_4$:Eu, and red light emitting particles which correspond to third primary color light emitting particles may be red color light emitting phosphor particles made of, for example, CaS:Eu. Or else, it is possible to use, as the light source of the planar light source apparatus, a fluorescent lamp (CCFL) of the cold cathode type, a fluorescent lamp (HCFL) of the hot cathode type or a fluorescent lamp of the external electrode type (EEFL, External Electrode Fluorescent Lamp).

The present application contains subject matter related to that disclosed in Japanese Priority Patent Application JP 2010-017297 filed in the Japan Patent Office on Jan. 28, 2010, the entire content of which is hereby incorporated by reference.

While preferred embodiments of the present invention have been described using specific terms, such description is for illustrative purpose only, and it is to be understood that changes and variations may be made without departing from the spirit or scope of the following claims.

What is claimed is:

1. A method of driving an image display apparatus which includes (A) an image display panel including a plurality of pixels arrayed in a two-dimensional matrix and each configured with a first subpixel for displaying a first primary color, a second subpixel for displaying a second primary color, a third subpixel for displaying a third primary color, and a fourth subpixel for displaying a fourth color, and (B) a signal processing section capable of, for each pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal based on the first subpixel input signal, second subpixel input signal, and third subpixel input signal and outputting the calculated fourth subpixel output signal to the fourth subpixel, the method comprising:

a step, carried out by the signal processing section, of setting the expansion coefficient ($\alpha_0$) to a value equal to or lower than a predetermined value when a ratio to all pixels of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 + 56G/60$$

$$G \geq 0.78 \times (2^n - 1)$$

$$B \leq 0.50R$$

exceeds a predetermined value ($\beta'_0$), n being a display gradation bit number.

2. A method for driving an image display apparatus which includes (A) an image display panel including a plurality of pixels each configured with a first subpixel for displaying a first primary color, a second subpixel for displaying a second primary color, and a third subpixel for displaying a third primary color and arrayed in a first direction and a second direction in a two-dimensional matrix such that a pixel group is configured at least with a first pixel and a second pixel arrayed in the first direction, and a fourth subpixel disposed between the first pixel and the second pixel in each pixel group for displaying a fourth color, and (B) a signal processing section capable of, in each pixel group, regarding the first pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, regarding the second pixel, calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, and calculating a third subpixel output signal based at least on a third subpixel input signal and the expansion coefficient ($\alpha_0$) and outputting the calculated third subpixel output signal to the third subpixel, and regarding the fourth subpixel, calculating a fourth subpixel output signal based on a fourth subpixel control first signal calculated from the first subpixel input signal, second subpixel input signal, and third subpixel input signal to the first pixel and a fourth subpixel control second signal calculated from the first subpixel input signal, second subpixel input signal, and third subpixel input signal to the second pixel and outputting the calculated fourth subpixel output signal to the fourth subpixel, the method comprising:

a step, carried out by the signal processing section, of setting the expansion coefficient ($\alpha_0$) to a value equal to or lower than a predetermined value when a ratio to all pixels of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 + 56G/60$$

$$G \geq 0.78 \times (2^n - 1)$$

$$B \leq 0.50R$$

exceeds a predetermined value ($\beta'_0$), n being a display gradation bit number.

3. A method of driving an image display apparatus which includes (A) an image display panel wherein totaling P×Q pixel groups arrayed in a two-dimensional matrix including P pixel groups arrayed in a first direction and Q pixel groups arrayed in a second direction, each of the pixel groups being configured with a first pixel and a second pixel along the first direction, the first pixel including a first subpixel for displaying a first primary color, a second subpixel for displaying a second primary color, and a third subpixel for displaying a third primary color, the second pixel including a first subpixel for displaying the first primary color, a second subpixel for displaying the second primary color, and a fourth subpixel for displaying a fourth color, and (B) a signal processing section capable of calculating a third subpixel output signal to a (p, q)th first pixel, where p is 1, 2, . . . , P and q is 1, 2, . . . , Q when the pixels are counted along the first direction, based at least on a third subpixel input signal to the (p, q)th first pixel and a third subpixel input signal to the (p, q)th second pixel and outputting the third subpixel output signal to the third subpixel of the (p, q)th first pixel, and calculating a fourth subpixel output signal to the (p, q)th second pixel based on a fourth subpixel control second signal calculated from a first subpixel input signal, a second subpixel input signal, and the third subpixel input signal to the (p, q)th second pixel and a fourth subpixel control first signal calculated from a first subpixel input signal, a second subpixel input signal, and a third subpixel input signal to an adjacent pixel disposed adjacent to the (p, q)th second pixel along the first direction, the method comprising:

a step, carried out by the signal processing section, of setting the expansion coefficient ($\alpha_0$) to a value equal to or lower than a predetermined value when a ratio to all pixels of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 + 56G/60$$

$$G \geq 0.78 \times (2^n - 1)$$

$$B \leq 0.50R$$

exceeds a predetermined value ($\beta'_0$), n being a display gradation bit number.

4. A method of driving an image display apparatus which includes (A) an image display panel wherein totaling $P_0 \times Q_0$ pixels arrayed in a two-dimensional matrix including $P_0$ pixels arrayed in a first direction and $Q_0$ pixels arrayed in a second direction, each of the pixels being configured with a first subpixel for displaying a first primary color, a second subpixel for displaying a second primary color, a third subpixel for displaying a third primary color, and a fourth subpixel for displaying a fourth color, and (B) a signal processing section capable of calculating a first subpixel output signal based at least on a first subpixel input signal and an expansion coefficient ($\alpha_0$) and outputting the calculated first subpixel output signal to the first subpixel, calculating a second subpixel output signal based at least on a second subpixel input signal and the expansion coefficient ($\alpha_0$) and outputting the calculated second subpixel output signal to the second subpixel, calculating a third subpixel output signal based at least on a third subpixel input signal and the expansion coefficient ($\alpha_0$) and outputting the calculated third subpixel output signal to the third subpixel, and calculating a fourth subpixel output signal to a (p, q)th pixel, where p is 1, 2, . . . , $P_0$ and q is 1, 2, . . . , $Q_0$ when the pixels are counted along the second direction, based on a fourth subpixel control second signal calculated from a first subpixel input signal, a second subpixel input signal, and a third subpixel input signal to the (p, q)th pixel and a fourth subpixel control first signal calculated from a first subpixel input signal, a second subpixel input signal, and a third subpixel input signal to an adjacent pixel disposed adjacent to the (p, q)th pixel along the second direction, and outputting the calculated fourth subpixel output signal to the fourth subpixel of the (p, q)th pixel, the method comprising:

a step, carried out by the signal processing section, of setting the expansion coefficient ($\alpha_0$) to a value equal to or lower than a predetermined value when a ratio to all pixels of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 + 56G/60$$

$$G \geq 0.78 \times (2^n - 1)$$

$$B \leq 0.50R$$

exceeds a predetermined value ($\beta'_0$), n being a display gradation bit number.

5. A method of driving an image display apparatus which includes (A) an image display panel wherein totaling P×Q pixel groups arrayed in a two-dimensional matrix including P pixel groups arrayed in a first direction and Q pixel groups arrayed in a second direction, each of the pixel groups being configured with a first pixel and a second pixel along the first direction, the first pixel including a first subpixel for displaying a first primary color, a second subpixel for displaying a second primary color, and a third subpixel for displaying a third primary color, the second pixel including a first subpixel for displaying the first primary color, a second subpixel for displaying the second primary color, and a fourth subpixel for displaying a fourth color, and (B) a signal processing section capable of calculating a fourth subpixel output signal based on a fourth subpixel control second signal calculated from a first subpixel input signal, a second subpixel input signal, and a third subpixel input signal to a (p, q)th second pixel, where p is 1, 2, . . . , P and q is 1, 2, . . . , Q when the pixels are counted along the second direction, and a fourth subpixel control first signal calculated from a first subpixel input signal, a second subpixel input signal, and a third subpixel input signal to an adjacent pixel disposed adjacent to the (p, q)th second pixel along the second direction and outputting the calculated fourth subpixel output signal to the fourth subpixel of the (p, q)th second pixel, and calculating a third subpixel output signal based at least on a third subpixel input signal to the (p, q)th second pixel and a third subpixel input signal to the (p, q)th first pixel and outputting the third subpixel output signal to the third subpixel of the (p, q)th first pixel, the method comprising:

a step, carried out by the signal processing section, of setting the expansion coefficient ($\alpha_0$) to a value equal to or lower than a predetermined value when a ratio to all pixels of those pixels with regard to which, where a color defined by (R, G, B) is displayed by each pixel, (R, G, B) satisfy, where R among (R, G, B) exhibits a maximum value and B exhibits a minimum value, $$R \geq 0.78 \times (2^n - 1)$$

$$G \geq 2R/3 + B/3$$

$$B \leq 0.50R$$

but satisfy, where G among (R, G, B) exhibits a maximum value and B exhibits a minimum value, $$R \geq 4B/60 + 56G/60$$

$$G \geq 0.78 \times (2^n - 1)$$

$$B \leq 0.50R$$

exceeds a predetermined value ($\beta'_0$), n being a display gradation bit number.

* * * * *